US010232222B2

(12) United States Patent
Breach et al.

(10) Patent No.: US 10,232,222 B2
(45) Date of Patent: Mar. 19, 2019

(54) TRAINING FOOTWEAR

(71) Applicant: SkiA Designs Ltd., Haydock (GB)

(72) Inventors: Martin James Wallace Breach, Ormskirk (GB); Alexander James Start, Wetherby (GB); Peter Viner, Wetherby (GB)

(73) Assignee: SkiA Designs Limited, Haydock (GB)

( * ) Notice: Subject to any disclaimer, the term of this patent is extended or adjusted under 35 U.S.C. 154(b) by 460 days.

(21) Appl. No.: 14/785,781

(22) PCT Filed: Jan. 21, 2014

(86) PCT No.: PCT/GB2014/000019
§ 371 (c)(1),
(2) Date: Oct. 20, 2015

(87) PCT Pub. No.: WO2014/170622
PCT Pub. Date: Oct. 23, 2014

(65) Prior Publication Data

US 2016/0067550 A1 Mar. 10, 2016

(30) Foreign Application Priority Data

Apr. 20, 2013 (GB) ..... 1307229.3
Jul. 8, 2013 (GB) ..... 1312244.5

(51) Int. Cl.
*A43B 3/24* (2006.01)
*A43B 5/00* (2006.01)
(Continued)

(52) U.S. Cl.
CPC ..... *A63B 26/003* (2013.01); *A43B 3/246* (2013.01); *A43B 5/00* (2013.01); *A43B 7/00* (2013.01);
(Continued)

(58) Field of Classification Search
CPC .... A61F 5/0102; A61F 5/0104; A61F 5/0111; A61F 5/0113; A61F 5/0127; A61F 13/06;
(Continued)

(56) References Cited

U.S. PATENT DOCUMENTS 1,021,142 A * 3/1912 Freeman ..... A43B 5/18 36/7.6
2,244,719 A 6/1941 Mansfield
(Continued)

FOREIGN PATENT DOCUMENTS

FR 2735334 A1 12/1996
JP 2006055600 A 3/2006
(Continued)

OTHER PUBLICATIONS

International Search Report for International Application No. PCT/GB2014/000019, dated Apr. 24, 2014.
(Continued)

*Primary Examiner* — Gary D Urbiel Goldner
(74) *Attorney, Agent, or Firm* — Heslin Rothenberg Farley & Mesiti P.C.; Victor A. Cardona, Esq.

(57) ABSTRACT

A kit includes a pair of items of footwear; wherein each item of footwear includes a brace that is arranged to be releasably secured to at least part of a wearer's leg and/or foot; a platform that is operably connected to the brace; and a securing mechanism for releasably securing a balancing member, or a stack of balancing members, underneath the platform. The kit includes balancing members for each item of footwear so that one balancing member can be replaced with another balancing member that has a smaller ground-contacting area, or so that it can have another balancing member with a smaller ground-contacting area stacked underneath it.

18 Claims, 41 Drawing Sheets

(51) Int. Cl.

| | |
|---|---|
| ***A43B 7/00*** | (2006.01) |
| ***A43B 13/14*** | (2006.01) |
| ***A43C 19/00*** | (2006.01) |
| ***A63B 21/00*** | (2006.01) |
| ***A63B 22/16*** | (2006.01) |
| ***A63B 26/00*** | (2006.01) |
| ***A63B 69/00*** | (2006.01) |
| ***A63B 23/035*** | (2006.01) |

(52) U.S. Cl.

CPC ..... *A43B 13/145* (2013.01); *A43C 19/00* (2013.01); *A63B 21/4011* (2015.10); *A63B 21/4013* (2015.10); *A63B 21/4015* (2015.10); *A63B 21/4025* (2015.10); *A63B 21/4033* (2015.10); *A63B 21/4047* (2015.10); *A63B 22/16* (2013.01); *A63B 23/03508* (2013.01); *A63B 69/0028* (2013.01); *A63B 2026/006* (2013.01); *A63B 2225/09* (2013.01)

(58) Field of Classification Search

CPC ..... A63B 21/0004; A63B 21/00058; A63B 21/00061; A63B 21/00065; A63B 21/00069; A63B 21/00072; A63B 21/00178; A63B 21/00185; A63B 21/002; A63B 21/0023; A63B 21/0615; A63B 21/0616; A63B 21/0617; A63B 21/065; A63B 21/068; A63B 21/08; A63B 21/15; A63B 21/159; A63B 21/4001; A63B 21/4011; A63B 21/4013; A63B 21/4015; A63B 21/4023; A63B 21/4025; A63B 21/4027; A63B 21/4033; A63B 21/4034; A63B 21/4039; A63B 21/4045; A63B 21/4047; A63B 21/4049; A63B 22/0015; A63B 22/0017; A63B 22/0046; A63B 22/16; A63B 22/18; A63B 2022/185; A63B 23/035; A63B 23/03508; A63B 23/04; A63B 23/0405; A63B 23/0482; A63B 23/0494; A63B 23/08; A63B 23/085; A63B 23/10; A63B 26/00; A63B 26/003; A63B 2026/006; A63B 69/0022; A63B 69/0028; A63B 69/0035; A63B 69/0057; A63B 69/0059; A63B 69/18; A63B 2069/0062; A63B 71/0054; A63B 2071/0063; A63B 2071/0072; A63B 2208/0204; A63B 2208/0209; A63B 2225/09; A63B 2225/093; A63B 2244/18; A63B 2244/19

See application file for complete search history.

(56) References Cited

U.S. PATENT DOCUMENTS

| | | | | |
|---|---|---|---|---|
| 3,971,144 | A | 7/1976 | Brugger-Stuker | |
| 4,008,901 | A | 2/1977 | Conn | |
| 4,821,432 | A | 4/1989 | Reiber | |
| 5,188,578 | A | 2/1993 | Voigt | |
| 5,393,077 | A | 2/1995 | Wanous | |
| 5,839,734 | A | 11/1998 | Steinhauser, Jr. | |
| 5,921,009 | A * | 7/1999 | Hice | A43B 13/143 36/140 |
| 6,349,487 | B1 * | 2/2002 | Hice | A43B 13/143 36/140 |
| 6,648,803 | B1 | 11/2003 | Jay | |
| 6,648,843 | B1 | 11/2003 | Marciano et al. | |
| 7,500,324 | B1 | 3/2009 | Power et al. | |
| 7,740,567 | B2 * | 6/2010 | Bailar | A43B 5/18 36/140 |
| 2006/0130594 | A1 * | 6/2006 | Ikeuchi | A61F 5/0102 73/862.08 |
| 2007/0054777 | A1 * | 3/2007 | Kawai | A61H 3/00 482/1 |
| 2008/0127515 | A1 | 6/2008 | Lohrer | |
| 2010/0174219 | A1 * | 7/2010 | Franke | A61F 5/0111 602/16 |
| 2013/0116726 | A1 * | 5/2013 | Mor | A43B 13/145 606/204 |
| 2013/0165834 | A1 * | 6/2013 | Elbaz | A61F 5/0127 602/28 |
| 2013/0196829 | A1 * | 8/2013 | Elbaz | A43B 5/00 482/79 |
| 2013/0267878 | A1 * | 10/2013 | Franke | A61F 5/0111 602/7 |
| 2014/0309692 | A1 * | 10/2014 | Mor | A43B 7/144 606/237 |
| 2015/0119767 | A1 * | 4/2015 | Mor | A43B 7/144 601/28 |

FOREIGN PATENT DOCUMENTS

| | | | |
|---|---|---|---|
| WO | 98/31245 | A1 | 7/1998 |
| WO | 03/024382 | A1 | 3/2003 |
| WO | 2011/042680 | A1 | 4/2011 |
| WO | 2011/113450 | A1 | 9/2011 |

OTHER PUBLICATIONS

Search and Examination Report for priority British Application No. 1312244.5, dated Nov. 28, 2013.

* cited by examiner

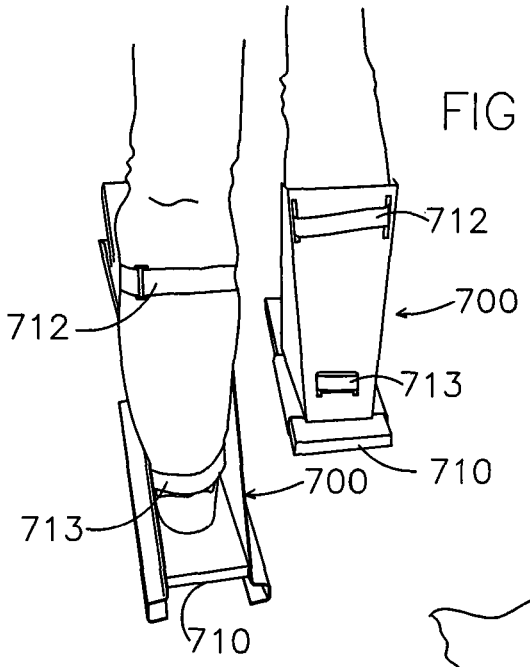
FIG 11
FIG 12
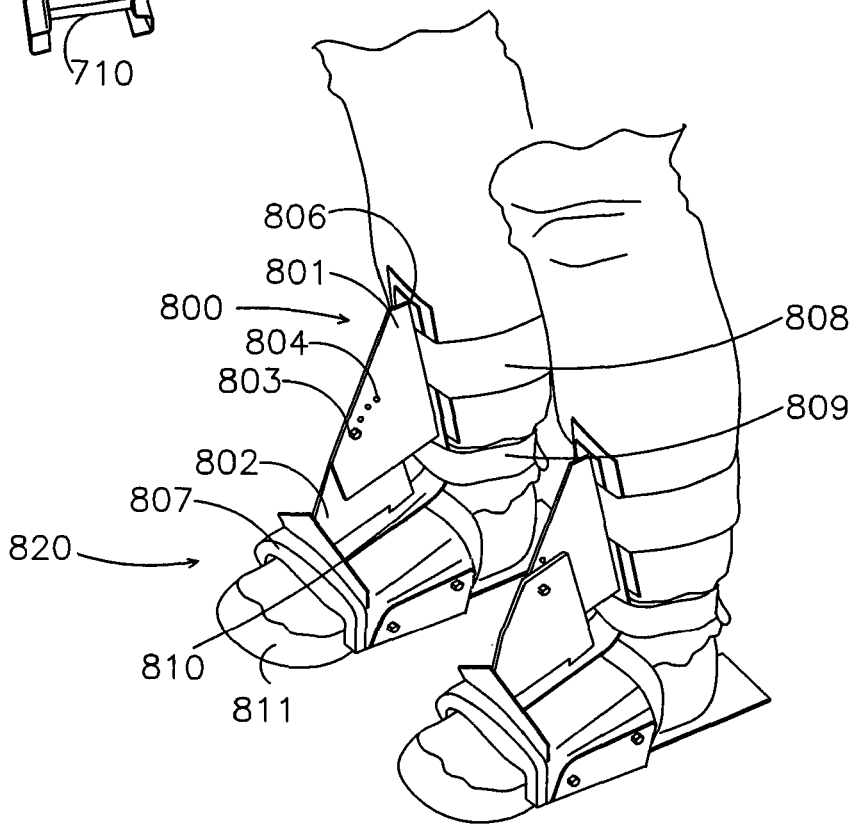

TRAINING FOOTWEAR

CROSS REFERENCE TO RELATED APPLICATIONS

This application is a national stage of PCT International Application No. PCT/GB2014/000019, filed on Jan. 21, 2014, and published in English on Oct. 23, 2014, as WO 2014/170622 A1, which claims priority to GB 1307229.3 filed on Apr. 20, 2013 and GB 1312244.5 filed on Jul. 8, 2013, the entire disclosures of which are incorporated herein by reference.

The present invention relates to footwear suitable for use in training a wearer thereof to shift his/her weight in a suitable manner for achieving high level performance in a given sport or activity. The invention relates in particular to footwear for training a user in improving or maintaining one or more balancing skills.

It allows a user to train in 'dynamic' balancing skills, i.e. where a user's feet move relative to the ground and some distance is travelled by the user (e.g. for training the user in skiing, skating, walking, running, riding, etc.). Alternatively, it allows a user to train in in 'static' balancing skills, i.e. where no significant distance is travelled relative to the ground by the user (e.g. during standing, performing yoga, swinging a golf club, etc.) It even allows a user to train in both static and dynamic balancing, given that some sports or activities (e.g. gymnastics, martial arts, etc.) involve both.

One of the aims of the present invention is to train a user so that a balancing skill can become almost second nature, i.e. without the user needing to think actively about it. This is sometimes known as the autonomous phase of learning (which can follow on from the more conscious cognitive and associative phases of learning). By repeating training and by focussing upon a smaller and smaller area for balancing a user can become much more adept in a sport or activity. Thus techniques involving adopting a suitable posture can be learned at both a conscious and subconscious level.

A user may even adopt visualisation techniques whilst training, by imagining that he or she is engaged in the given sport or activity. This can make the training seem more real and more relevant to the user, although it is of course not obligatory to use such techniques in conjunction with the present invention.

By using training footwear of the present invention a user can train in a safe and convenient environment (e.g. at home) prior to participating in, beginning, or resuming, a given sport or activity. This is particularly useful for sports or activities that may involve an element of risk (e.g. skiing, skating, tightrope walking, etc.) but it is useful anyway, simply for convenience.

It should of course be appreciated that a given position or posture need not be adopted for the whole of a given sport or activity, but may be useful to adopt or seek to adopt for a particular part thereof.

For example, it may be useful when a golfer is preparing to make a swing, when a tennis player is waiting to return a serve, when a martial arts participant is getting ready for an opponent to make an attack, etc. (NB: The activity may even be an everyday activity where balancing is important, such as standing.)

A beneficial posture is sometimes referred to as one that provides "centred balance". This provides a sound base for dynamic movement in balance in many sports and activities. The term "centred balance" is used generally herein to indicate that a person is in a relatively stable position, where balance can be maintained using relatively fine/small adjustments of posture rather than requiring sudden or excessive movements. This can help reduce effort and strain. It also reduces the risk of the person becoming unbalanced and falling when undertaking a sport of activity.

One aim in training a person in achieving or trying to achieve centred balance is to try to avoid the person leaning too far backwards on the ball of the heel, or leaning too far forwards on the ball of the forefoot or on the toes. If the person leans too far in either direction then a relatively unstable position can result and the person can become unbalanced and can even fall if balance is challenged further.

In many sports or activities (e.g. skiing) a person may occasionally/periodically need to shift weight forwards or backwards, but it is still desired to avoid becoming unbalanced. Thus it is desirable for example to practise fore-aft balancing techniques without excessive swaying or sudden jerky movements.

It is therefore desirable to seek to achieve centred balance, to seek to maintain it or to seek to regain it if it has temporarily been lost (e.g. if a skier hits an unexpected bump). Training can be facilitated by focussing upon a special point/small region below each foot that is often known as the "sweet spot".

Some people (including many amateur skiers) believe that the sweet spot is located much further forwards than it actually is. This can arise if a ski instructor urges a student to lean forwards, as is often done to counteract a tendency in many students to adopt too upright a stance. Such people may therefore try to shift their weight/centre of gravity too far forwards, based on a mistaken belief regarding the location of the sweet spot. For example they may try to focus on a point that lies vertically under the ball of the forefoot or even further forwards (e.g. on a point underneath the toe region).

In fact, the sweet spot for a wide variety of sports and activities will normally lie under the arch of the foot, i.e. vertically underneath a point located between the heel and the ball of the forefoot. More specifically it is often considered to lie vertically below the location of the navicular and/or cuneiform bone of the ankle or vertically below a location that is proximal thereto. However internal anatomy, such as the location of the navicular and/or cuneiform bones is not always widely understood by the public, or indeed by many instructors/coaches.

Rules of thumb may therefore sometimes used to try to locate the sweet spot. One rule of thumb is that the sweet spot is located vertically below a point that is at/about mid-way between the back of the heel and the front of the foremost toe. A more preferred rule of thumb is that it is located vertically below a point that is a/about a third of the distance from the back of the heel to the tip of the foremost toe. (In practice, these rules of thumb will normally be useful in locating the sweet spot under the arch of the foot. The latter rule of thumb will usually locate it closer to the navicular/cuneiform bones than the former.)

In the case of items of footwear, such rules of thumb can also be used to determine where the sweet spot would be expected, assuming the footwear is of the correct size for the wearer. Thus a position underneath a point located at/about the mid-point of the sole, or underneath a point located at/about a third of the length of the sole (from front to the back of the sole) may be considered as the sweet spot. It is therefore clear that for an item of footwear of the correct size for a wearer the sweet spot will lie under a point along the sole that is spaced a significant distance from either end of the sole. (This significant distance is generally at least 10% at least of the total length of the sole. More preferably this significant distance is at least 20%, at least 25%, at least 30%, or at least 33% of the total length of the sole.)

It can bring numerous advantages if a person attempts, consciously or subconsciously, to adopt a posture that focuses weight bearing down on each foot above the sweet spot. A posture that achieves this can be regarded as one that is useful in providing centred balance. (The concepts of the sweet spot and of centred balance are discussed in further detail on the skia.com web site.)

Centred balance can allow pressure to be distributed over the the heel and forefoot regions of the foot so that there is not undue stress or strain on either. A posture of centred balance is helpful in maintaining stability. Furthermore, it also facilitates efficient use of muscles and helps conserve energy. It can assist in using sports equipment, such as skis, in the manner in which it was designed to be used. (In contrast, skiers who are not properly balanced over the sweet spot may struggle to keep control of their skis, which can be wasteful of strength and energy and can lead to loss of confidence and of enthusiasm.)

In practice, centred balance may be desirable, but is not always easy to achieve, especially for non-experts. Indeed in many sports or activities a person may become very poorly balanced or even unbalanced at various times and may need to make rapid/severe adjustments to his/her posture. This can have a deleterious effect on performance and can also lead to accidents and injuries. Indeed, an individual with his/her centre of gravity too far forwards or too far backwards may become unstable, and may lose the ability to move/respond freely.

Furthermore, in the case of a martial arts activity it may be much easier for a participant in a bout to lose to an opponent if the participant does not adopt centred balance techniques. In the case of golf, if the golfer is not properly balanced when this may adversely affect a golfer's swing. (This can be the difference between winning and losing a golf tournament.) In the case of skiing, a skier may be at increased risk of falling, may need to work much harder to ski effectively, may not adopt a properly balanced skiing technique, etc., unless he/she is appropriately balanced. Indeed, in a wide range of sports and activities a user can significantly reduce the risk of injury and/or can improve performance practising to achieve centred balance.

Although many items of footwear are of course known, few are specifically designed to train a user in achieving centred balance. There are of course some specialised items of footwear, such as ballet shoes, that are highly flexible and may allow users to adopt a wide range of postures. For example, ballet shoes can be used for a dancer seeking to balance on tip-toe. However, most footwear, even if highly specialised, simply does not usually allow a wearer to easily identify a properly balanced position. This is a particularly the case for a non-expert, who may have little idea of how to continuously shift his/her weight by slight movements in order to maintain a desired balanced position for a given sport or activity, or a particular stage thereof.

A specialised training aid is disclosed in EP 2485617, which is derived from WO2011/042680. This is known as the "SkiA Sweetspot Trainer". It is designed to be attached to a ski boot and to help train a wearer of the ski boot with the device attached underneath to focus pressure on the sweet spot. Once a user has been trained to do this by using this training aid, then the user can then adopt an appropriate posture during skiing to focus pressure on the sweet spot of each ski and thereby to significantly improve the user's skiing technique. The SkiA Sweetspot trainer can be used for training a user in fore-and-aft balance in a unique manner by utilising the properties of ski boots. Because ski boots are designed to significantly restrict the range of movement of the ankle joint, users are unable to stand and balance on the centred balancing member of the SkiA Sweetspot Trainer using ankle flexion or extension.

Free movements of the ankle joints (for example, in bare feet) would allow a user to stand on the centred balancing members in almost any posture, making adjustments to their balance almost entirely with their ankles. Instead, to achieve centred balance on the SkiA Sweetspot Trainer, it is necessary to engage the whole body to adjust posture and centre of mass. Paradoxically, limiting movements of the ankle joints provides a much more natural simulation of normal balance than allowing free movement of the ankle joints. (For example, when standing at rest on a flat surface, people generally balance by small adjustments of their posture, rather than by large movements of the ankle joints.)

Although the SkiA Sweetspot Trainer is very useful as a training aid for skiers, it is limited in the applications in which it can be used. In the case of skiing for example, it is intended for use with the user already wearing ski boots, which can be cumbersome. Furthermore, ski boots are also often expensive to purchase and someone wanting to learn to ski may be reluctant to commit to such a purchase at an early stage, preferring to wait until he/she has become more accomplished before purchasing skiing boots, skis, etc. However it can be difficult to become accomplished in skiing or in other sports or activities requiring high level balancing skills. It can also be difficult for certain individuals to achieve basic level balancing skills. Indeed some individuals may need to learn, relearn or improve balancing skills for everyday activities (e.g. if disabled, elderly, and/or recovering from an operation or accident).

The present inventors have now made an important breakthrough in the field of training aids.

According to the present invention there is provided a kit comprising a pair of items of footwear; wherein each item of footwear comprises:

a) a brace that is arranged to be releasably secured to at least part of a wearer's leg and/or foot;

b) a platform that is operably connected to the brace; and c) securing means for releasably securing a balancing member, or a stack of balancing members, underneath the platform;

wherein the kit includes a plurality of balancing members for each item of footwear so that one balancing member can be replaced with another balancing member that has a smaller ground-contacting area, or so that it can have another balancing member with a smaller ground-contacting area stacked underneath it.

The brace is preferably designed to secure at least part of a wearer's leg and/or foot during balancing so as to help train the user in adopting or trying to adopt a desired position for balancing (e.g. for achieving or trying to achieve centred balance.) The securing means preferably releasably secures the balancing member, or a stack of balancing members, underneath the platform at a suitable location for such training.

In many embodiments the brace acts as acts as a restrictor that substantially restricts flexion and/or extension of the ankle of a wearer of the item of footwear of the present invention is in use (i.e. when the wearer is balancing or attempting to balance on a balancing member). This is however not essential for all embodiments. Indeed in other embodiments the brace may allow flexion and/or extension of the ankle during use (e.g. in training for tightrope walking or in a variety of other activities involving stepping/lifting one or more feet off the ground). Whatever the nature of the brace, desirably it restricts lateral movement of a user's foot relative to the platform. The foot on the platform may however be free to pivot backwards or forwards about a balancing block (fore and aft pivoting).

In some embodiments, the brace can be used to keep the shin of a wearer (more specifically a line or plane generally aligned with the front of the shin) at a substantially fixed position relative to the platform. Desirably, it keeps the shin (more specifically a line or plane generally aligned with the front of the shin) at a substantially fixed angle relative to the platform during training with the training footwear of the invention. (NB: "Training footwear" is also sometimes referred to herein as a "training aid".)

An angle adjustment means may optionally be provided. Thus, when the device is not in use (i.e. when the user is not balancing or attempting to balance), the angle of the brace relative to the platform (or relative to a horizontal or vertical axis) can be adjusted to another angle. This can then be used as a new, substantially fixed angle, unless and until it is desired to adjust it again. Adjustment can be achieved, for example, with the aid of a releasable lock. When the lock is released the angle can be adjusted (e.g. by a pivoting action). Once a new desired angle has been selected, the brace can be locked in position at the new desired angle until it is desired to adjust the angle again.

It is preferred that the brace comprises at least one substantially rigid bracing member (which is desirably elongate) that is maintained at a substantially fixed position and/or angle relative to the platform, at least whilst the wearer is balancing or attempting to balance. This may for example comprise a strut, a resilient moulded structure, a wall or any another suitable substantially rigid structure that can be used for bracing. The material used to provide substantial rigidity may for example comprise a metal, an alloy, a plastics material, a composite material (e.g. carbon fibre), a wood, a laminate, etc. There is a very wide range of possibilities here, as is well known in the art of materials science. Combinations of different materials or components can of course be used. Reinforcement can also be provided if it desired to increase rigidity (e.g. via inner or outer supports, clamps, scaffolds, meshes, wires, frames, etc.)

In one embodiment, during use, at least part of the front of the lower leg of the wearer (e.g. the shin region) is adjacent to/abuts/is proximal to the substantially rigid bracing member (once any padding, cushioning, lining, sock or other protective material has been taken into account). In this embodiment the brace can be considered as a "front brace". More desirably, at least part of the front of the lower leg of the wearer presses against the substantially rigid bracing member (allowing for any intermediate padding, cushioning, etc.)

In another embodiment, the substantially rigid bracing member is adjacent to/abuts/is proximal to at least part of the back of the lower leg of the wearer (e.g. the calf, the back of heel and/or or the back of the ankle). This is again once any once padding, cushioning, lining, sock or other protective material is taken into account. In this embodiment the brace can be considered as a "rear brace". Desirably, this brace presses against at least part of the back of the lower leg of the wearer (again allowing for any intermediate padding, cushioning, etc.).

It is even possible to provide both front and rear bracing by having one bracing member that braces at least part of the front of the lower leg (or a part thereof) and one that braces at least part of the rear of the lower leg. Indeed a single bracing member may even be provided that does both (e.g. one that surrounds/almost surrounds the lower leg and can be gradually tightened or loosened).

One or more side bracing members can be used. They may be used instead of, or in additional to, one or more front and/or rear bracing members. Thus a wide variety of possibilities exist.

As indicated above, cushioning, padding, lining or other protective material may be provided on or close to the substantially rigid bracing member. The user may also wear a sock or other soft material.

Thus the terms "adjacent to", "abuts", "presses against" etc., should be construed accordingly to allow for such "intermediate" material. Such material can reduce the risk of and/or extent of bruising. However, the cushioning or other protective material should not be excessive and the fit should still be a tight one rather than a loose one so that, when the item of footwear is in use, undesired movement is significantly restricted. (A useful analogy here is a ski-boot, where a small amount of discomfort will often be tolerated and may even indicate that a sound technique is being adopted.)

It is preferred that at least part of the brace is generally complementarily shaped to at least part of a leg or foot (e.g. to the calf, heel, shin region, and/or ankle region, or to at least part of any such region).

Thus, for example, one or more appropriately shaped collars, pockets, hollows, recesses, etc., may be provided. This can be done by casting, moulding, etc., as is known in the art. Modern techniques such as 3D printing of objects can also be used. The shape need not be an exact fit for a given user, although this is possible. It is sufficient that the shape when combined with the other features of the item of footwear allows the brace to be positioned correctly and perform its function. In practice the shape is preferably one that can be used for a variety of different users (e.g. users with a given shoe size or within a given range of shoe sizes).

As indicated earlier, one or more releasable securing means are desirably used for releasably securing the brace to the leg and/or foot of a user. The one or more releasable securing means may, for example, comprise one or more straps, ties, catches, claps or clamps.

Turning now to another optional aspect of the present invention, in some embodiments the brace may be releasably secured relative to the platform. This may be done in a manner so that it can be released from a given position and can then be moved and releasably secured again in at least one other position along the platform. (This approach represents a further radical departure from the prior art.) There are many ways of achieving this. All are within the scope of the present invention. For example, the brace may be provided with one or more engaging members that can releasably engage one or more receiving means located at different positions along the platform, or vice versa. The one or more engaging members may, for example, be protruding members and the one or more receiving means comprise one or more apertures (e.g. slots) for receiving the one or more protruding members. Alternatively, the brace may be slidably mounted relative to the platform so that it can be released from one position, slid to at least one other position along the platform and then be releasably secured in said at least one other position. In a further alternative, the brace may be releasably secured using a hook-and-eye arrangement, such as Velcro™.

As indicated earlier, whatever the nature of the device, a balancing member will normally be located underneath the platform and will be releasably secured in a desired position for balancing on when the device is in use.

In some embodiments the balancing member may be located substantially away from both the front and/or back of the platform. For example the centre point of the balancing member may be located underneath the platform at a position that is located at least 10% (preferably at least 20%, at least 25%, or at least 30%) of the length of the platform away from the front and/or back of the platform. Preferably the centre point of the balancing member is located at a position that is at/about a third of the way along the length of the platform (measured from the rear of the platform) or at/about the mid-point of the platform.

The above figures are guides and are useful if the platform is similar in length to the length of a foot of a user. In practice however the platform may well be significantly longer t (e.g. to accommodate a variety of different foot sizes). Embodiments allowing the brace to be moved relative to the platform from one position and then releasably secured at a desired position can be particularly useful here. They allow the brace to be moved along the platform and secured in a position that takes into account the foot size of a user. This assists in allowing a given user to practise focussing pressure over a sweet spot.

As discussed earlier the sweet spot position preferably corresponds to a position located roughly a third of the way along the length of the foot when measured from the back of the heel (although, less desirably, some people may prefer to focus on position located at about the mid-point of the sole of the foot if they consider that to be the "sweet spot"). A key point here is that if the brace is moved to a desired position along the platform and releasably secured thereto this can be used to take into account not only different possible interpretations for the location of the sweet spot, but also different sizes/shapes of the foot, as discussed earlier.

The sweet spot is represented by the balancing member. Thus the brace can be moved until a desired part of a user's foot would be located over the balancing member so as to focus pressure on the sweet spot. In practice this will usually be done by eye. Alternatively the user's foot could be measured with a measuring device (e.g. a tape measure or ruler) and mark could be made at a given position along the foot. This could then be aligned with the balancing member. A further possibility is to incorporate a measuring scale on the training aid itself (e.g. on the upper surface of the platform or on a side thereof). This allows a user to measure his/her foot and determine where a given measurement along the foot is (e.g. a third of the way along the foot or half way along). As an alternative to providing a scale, one or more other indicators that may assist the user in positioning his/her foot as a desired position in relation to the balancing member may be used. This could, for example, include one or more outlines of foot, one or more lines, or other markings indicating different foot sizes and/or shapes.

However, as indicated earlier, in many circumstances it is envisaged that the position where a brace should be positioned along a platform for a user of a given foot size can be assessed by eye. It is, for example, possible to approximate a position a third or a half along the length of the foot and then to seek to align this with a balancing member.

Of course if it appears that the brace has been moved too far forwards or too far backwards then it can be released from the platform and adjusted accordingly until a desired part of the foot (e.g. a mid-point or a point a third along the length of the foot) lies over the balancing member.

Turning now to the balancing member (sometimes also referred to herein as a balancing block), this can be any appropriate component used for balancing or attempting to balance on. Non-limiting shapes include cylindrical shapes, frustoconical shapes, cuboid shapes, rectangular or square blocks, etc.

The balancing member may have one or more rounded, angled or bevelled edges at its base, or other pivot point, to assist in pivoting/balancing. Normally it will be relatively small in comparison to a complete item of footwear of the present invention. Desirably, it will be sufficiently strong to support the weight of the user without breaking and/or becoming damaged. (Typically the block will be designed to withstand a weight of at least 15 stone, e.g. of at least 18 stone, or at least 20 stone.)

It is preferred that when the balancing member is in use, it has a ground-contacting area (on which pivoting can occur) that is small, especially in relation to the upper surface area of the platform on which a user stands. For example the ground-contacting area may be less than 30 $cm^2$, less that 25 $cm^2$, less than 20 $cm^2$, less than 15 $cm^2$, or less than 10 $cm^2$. More desirably, it is less than 8 $cm^2$ or less than 5 $cm^2$. Generally speaking, the smaller this area, the greater the difficulty a wearer may have in balancing upon it (until the wearer has improved his/her balancing skills by repeated practice).

Thus a user will normally begin by practising balancing using a balancing member with a relatively large ground-contacting area. Once the user has become competent at balancing on said balancing member, it can be removed and can be replaced with one having a smaller contact area, until the user becomes competent at balancing on that. This can then in turn be replaced with one having a still smaller contact area. This procedure gradually hones a user's balancing skills so the user can focus pressure on an increasingly smaller area. Of course if the user finds it too difficult to balance on a balancing member having a relatively small ground-contacting contact area and loses confidence, then the balancing member may be replaced with one having a relatively large contact area. The user can then practice on this until the user has become more confident/more accomplished. Thus a user can simply practice at his/her own pace so as to improve his/her balancing skills to a desired level.

As indicated earlier, an embodiment of the present invention in which the brace can be moved from one position relative to the platform and then releasably secured at a another position has various benefits. In an optional refinement of this embodiment, it may also be desired to adjust the angle at which a user's shin is held by the brace relative to the platform. Here an angle adjustment means as discussed earlier can be used.

It should however be appreciated that the angle adjustment means is not limited to particular narrow embodiments. It can be used to train someone who might wish to adopt a variety of different positions for a given sport or activity and to use the footwear in a training program. Thus, for example, a skier might wish to train to achieve centred balance in a crouched posture, a semi-upright posture and also an upright posture. The angle adjustment means can be used to take account of all of these (and many others). It can be used to take into account a variety of angles at which a skier might seek to lean in ski boots mounted on skis. The skier will however not need to wear skis or even ski boots when training.

Thus the training footwear of the present invention is very convenient to use and can be adapted to different, postures, sports, activities, etc.

It is preferred that a training aid of the present invention is arranged so that a wearer can wear it either barefoot or (more usually) whilst wearing socks, stockings or another soft foot covering. Here it is referred to as a "barefoot trainer", simply because shoes are not used In a less preferred embodiment, the training aid of the present invention is shaped to be worn by someone who is already wearing a shoe, with the brace acting on the shoe with the user's foot inside it. Thus the platform, brace, etc., will normally be significantly larger than required for the preferred device for a wearer who is not wearing a shoe or boot.

Training footwear of the present invention can therefore be provided in various forms. It can be used for a variety of purposes, e.g. as a trainer for a sport or activity. It may, for example, be used as a trainer for a martial art, yoga, surfing, skating, surfing, skiing, or simply for standing, as discussed earlier.

In practice, a pair of left and right items of footwear of the present invention will of course normally be worn when a user is balancing or attempting to balance. Such a pair is part of the present invention, as is the individual item of footwear. A single item of footwear can be useful, for example, if a user is training for one legged balancing (which may be useful, for example, if a ski comes away from a binding). It may also be useful as a spare part.

If desired, one or more items of footwear (preferably a pair) may be provided in a container (e.g. a box or package). Instructions for use may optionally also be provided. This is one type of kit of the present invention.

A wide variety of different kits are covered. Another kit comprises a pair of items of footwear of the present invention and one or more additional pairs of balancing members, so as to provide differing degrees of difficulty in balancing. Here it is preferred that different pairs of balancing members have different ground contacting surface areas, as discussed earlier. Another kit within the scope of the present invention is a kit comprising left and right items of footwear of the present invention but without the balancing member attached thereto. Here, the kit further comprises at least one pair of balancing members that can be attached to said items of footwear. Preferably it comprises a plurality of pairs of balancing members that can provide different degrees of difficulty in balancing.

Some kits may even include one or more pressure sensors. These can be useful in providing additional feedback indicating regions where a user is focussing pressure (especially if used in combination with a computer). Pressure sensors can even be incorporated in/on socks. Such socks (sometimes known as "smart socks" may be included in a kit). Alternatively it is possible to incorporate one or more pressure sensors in/on a platform or in/on a balancing member of the present invention. It is even possible to provide an insert or pad that includes one or more pressure sensors (e.g. one shaped to fit on the platform of an item of training footwear of the present invention).

As well as items of footwear, pairs of such items and kits, the present invention also provides various methods. For example, it provides a method of a user improving or trying to improve one or more balancing skills by wearing a pair of items of footwear of the present invention and balancing or attempting to balance on one or more balancing members. Preferably the method is repeated by the user once the balancing members have been removed and replaced with other balancing members that are either more difficult or less difficult to balance on. More preferably the other balancing members are more difficult to balance on, as discussed earlier.

A training method may be performed under supervision (e.g. by a coach in a given sport or activity). However this is not essential. The method may be performed with the user having one or more physical supports or helpers close at hand so as to reduce the risk of the user falling over. For example a user may attempt to balance whilst stood between two sturdy chairs or other sturdy articles positioned so that they can be gripped if the user becomes unbalanced. Two assistants (if available) may be positioned either side for similar purposes. There are of course many other possibilities. For example a user may use a sturdy frame (e.g. a Zimmer® frame) for support or may even use parallel rails or bars (as are sometime found in gymnasia, for example). It is also possible to provide the training aid in a form so that it is unlikely that a user will fall even if he/she becomes unbalanced. For example the balancing block may not be very deep and the platform may be large. Thus, when in use, the training aid may not be able to tilt too far in any direction before further tilting is prevented by an edge of the platform contacting the ground. It is also possible to provide the balancing block with curved or bevelled edges that can aid balancing and/or reduce the risk of a user falling over.

In some embodiments one or more additional structures (e.g. stops) may be provided underneath the platform that help prevent/reduce excessive fore and aft pivoting. They may also help provide increased strength/rigidity.

As a further safety feature it is even possible to provide a quick release system (similar to ski bindings) so that a brace quickly disengages from the platform or a foot/leg is released from the brace under certain circumstances. This may, for example, be triggered if a force is exerted that might otherwise result in a high risk of injury (e.g. if a user leans too far forwards or backwards). However the provision of such a system will not normally be necessary.

It is important to note that, although much of the above discussion (and in that in some of the initial examples that follow) is in respect of replacing a balancing member with another one having a smaller ground-contacting area, it is possible to add a balancing member with a smaller ground contacting area underneath a given balancing member without removing the given balancing member. Here the user can still practise balancing on a smaller ground-contacting area than was possible with the initial balancing member.

Thus the present invention encompasses not only the option of replacing balancing members underneath a platform but also the option of adding additional ones underneath the platform so as to form a stack (as discussed in some of the later examples that follow.) Both options allow a user to develop skills useful for a wide variety of sports and activities.

The present invention will now be described by way of example only and with reference to the accompanying drawings, wherein.

Figure 1:
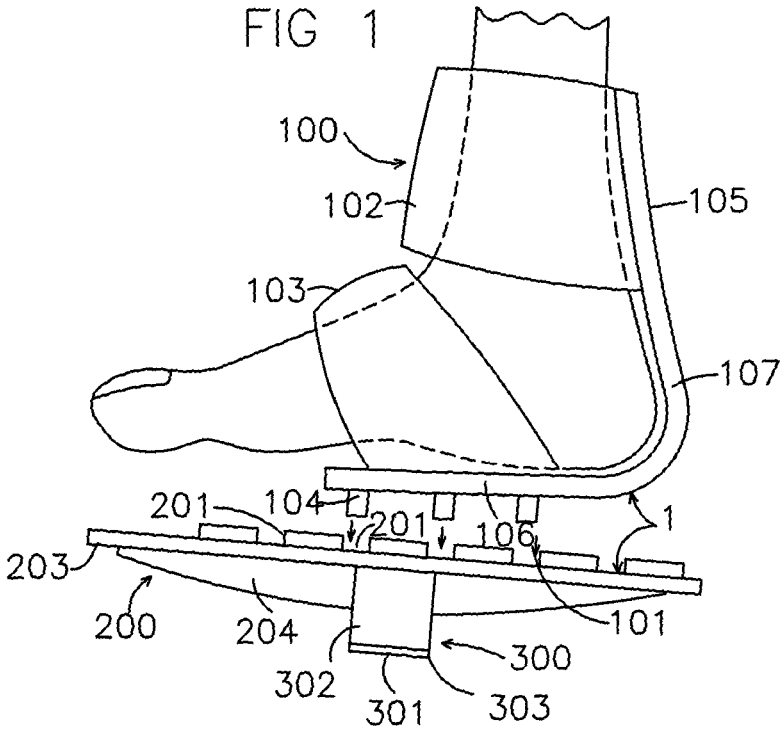
FIG. 1 shows an upper part comprising a brace and a lower part that receives the brace, with the parts about to be fitted together so that they form a training aid of the present invention.
Figure 4:
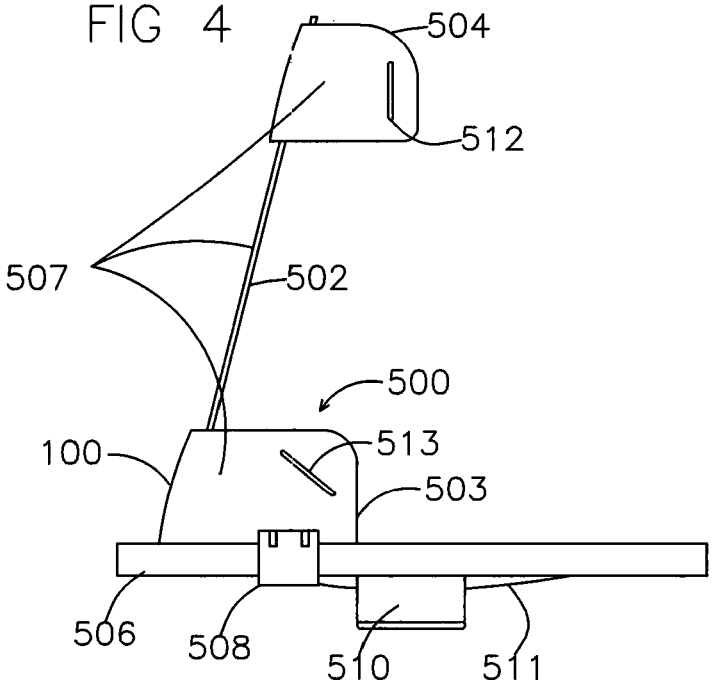

FIG. 4 provides a side view of a further training aid of the present invention with a different brace to that illustrated in FIG. 1.

Figure 5:
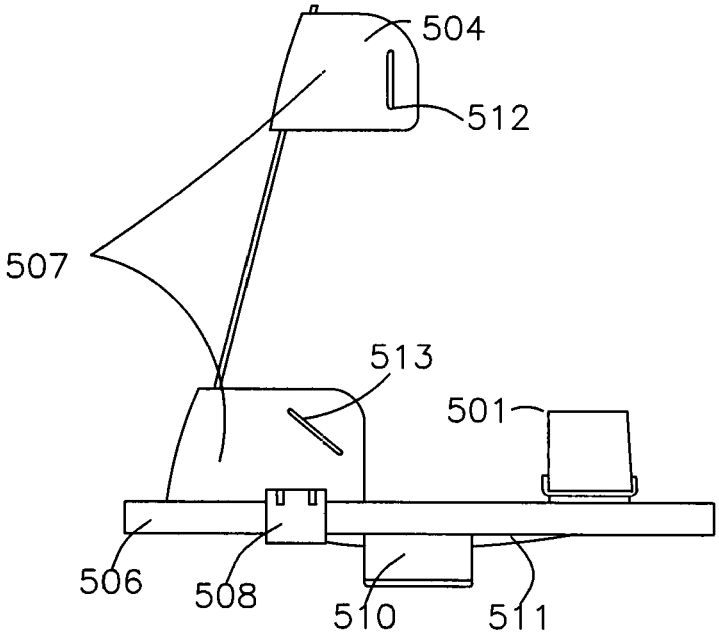

FIG. 5 is the same as FIG. 4, apart from the fact that the training aid also has a toe-strap.

Figure 6:
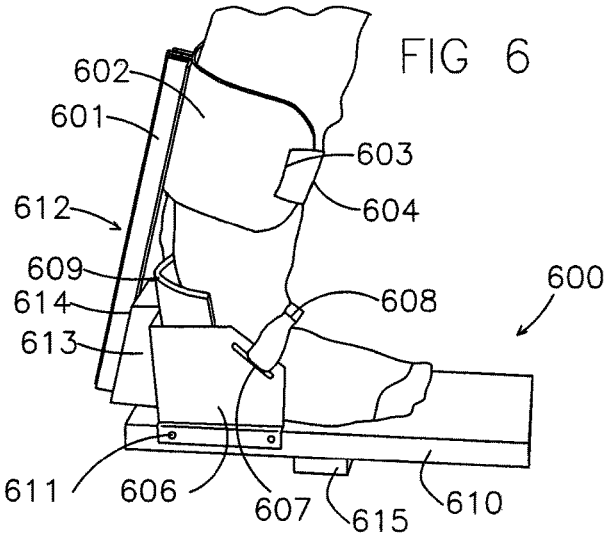

FIG. 6 shows from one side a working model that has similarities with the training aid illustrated in FIGS. 4 and 5 in that a brace is shown that has a strut and two spaced apart receiving components (one for receiving a heel region and the other for receiving a part of the lower leg of a user).

Figure 7:
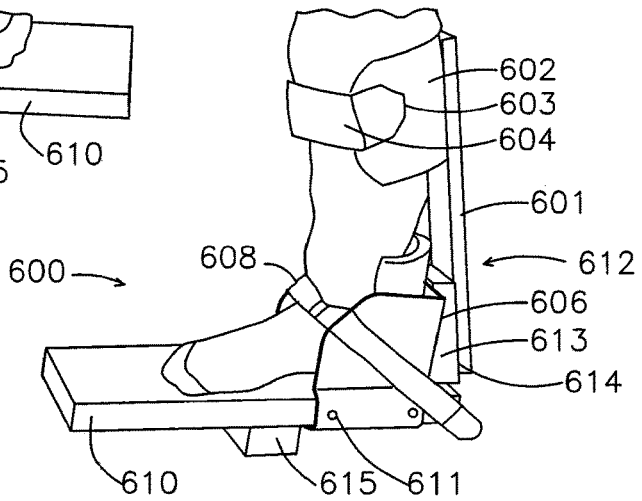

FIG. 7 shows the working model shown in FIG. 6 when seen from the other side.

Figure 8:
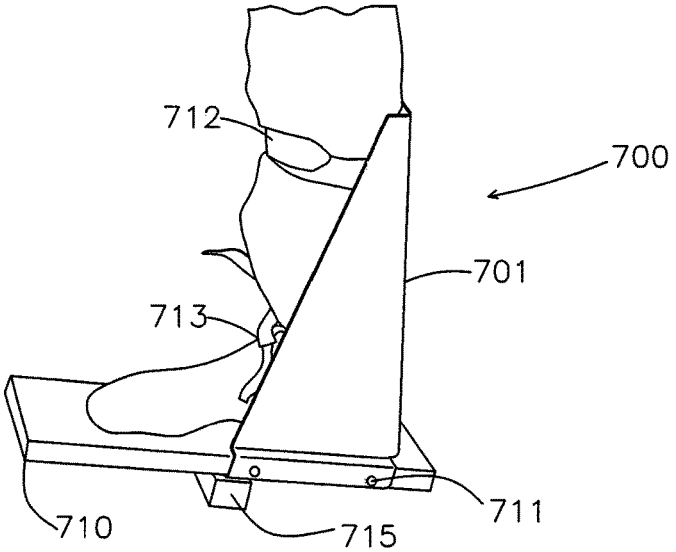

FIG. 8 shows an embodiment that is similar to that shown in FIGS. 6 and 7, apart from having fewer components and thereby not needing spaced apart receiving components for receiving a heel region and for receiving a part of the lower leg of a user.

Figure 9:
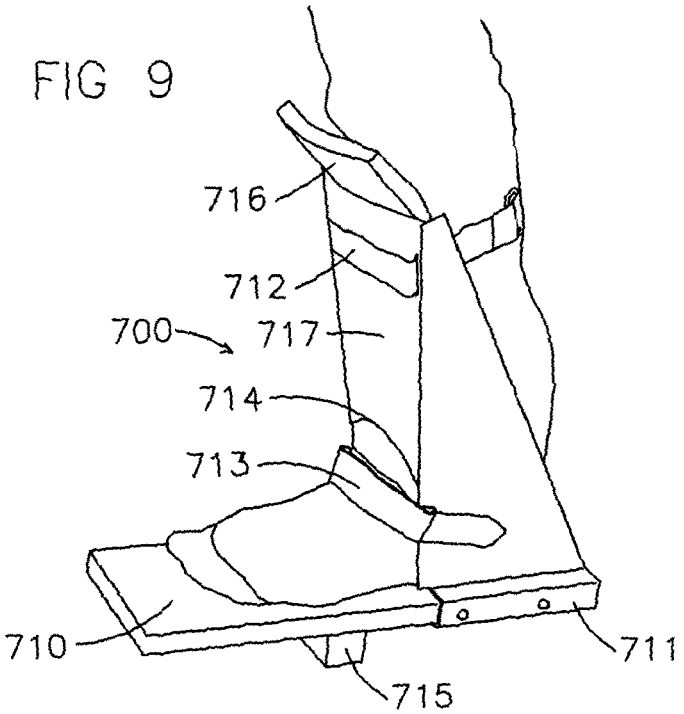

FIG. 9 is similar in some respects to FIG. 8, but with the brace essentially turned through 180 degrees and an arch shaped aperture provided to allow the front of a foot to be inserted through it. (Such an aperture is not needed in FIG. 8 because only the heel is in this position.)

Figure 10:
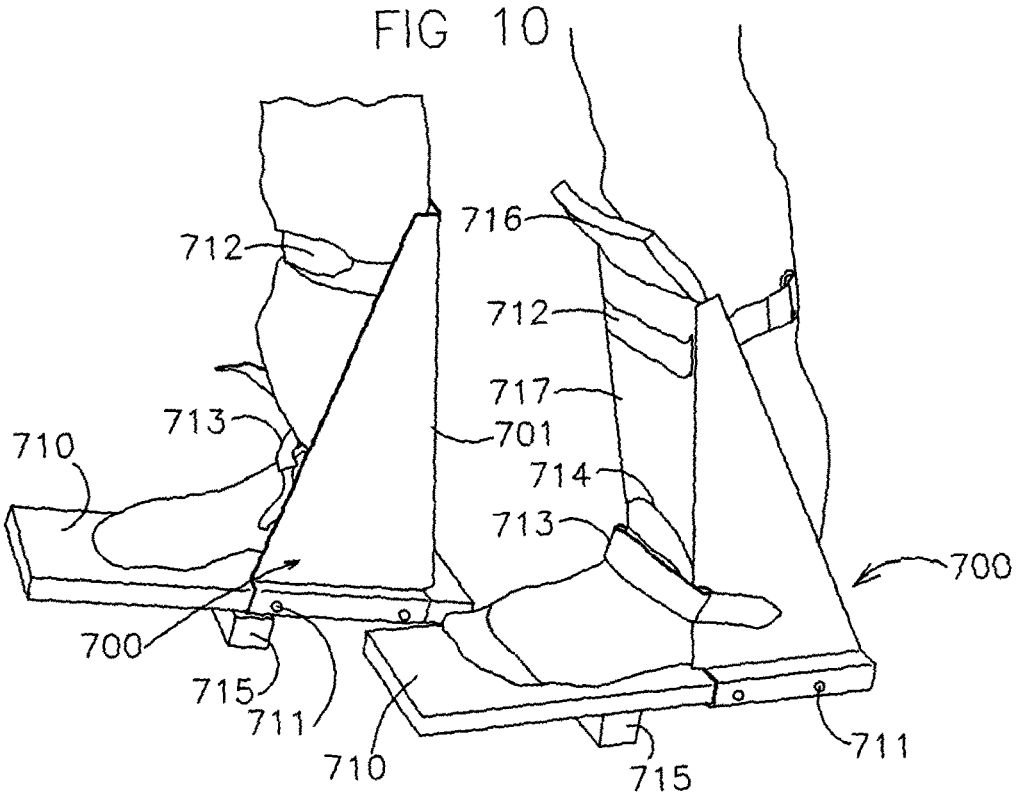

FIG. 10 shows for comparison the embodiments of the training aid shown in FIGS. 8 and 9 when worn on different feet of a user.

FIG. 11 is similar to FIG. 10, but is a view from the rear

FIG. 12 illustrates an embodiment of a training aid of the present invention, where the angle a brace is set can be adjusted relative to a platform.

Figure 2:
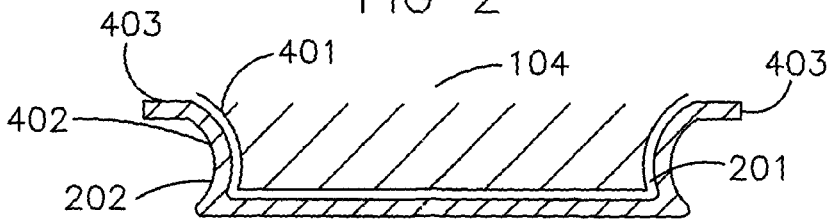
FIG. 2 shows a cross-section illustrating how a downwardly protruding member with convex sides can be received in a slot with concave inner walls.
Figure 13:
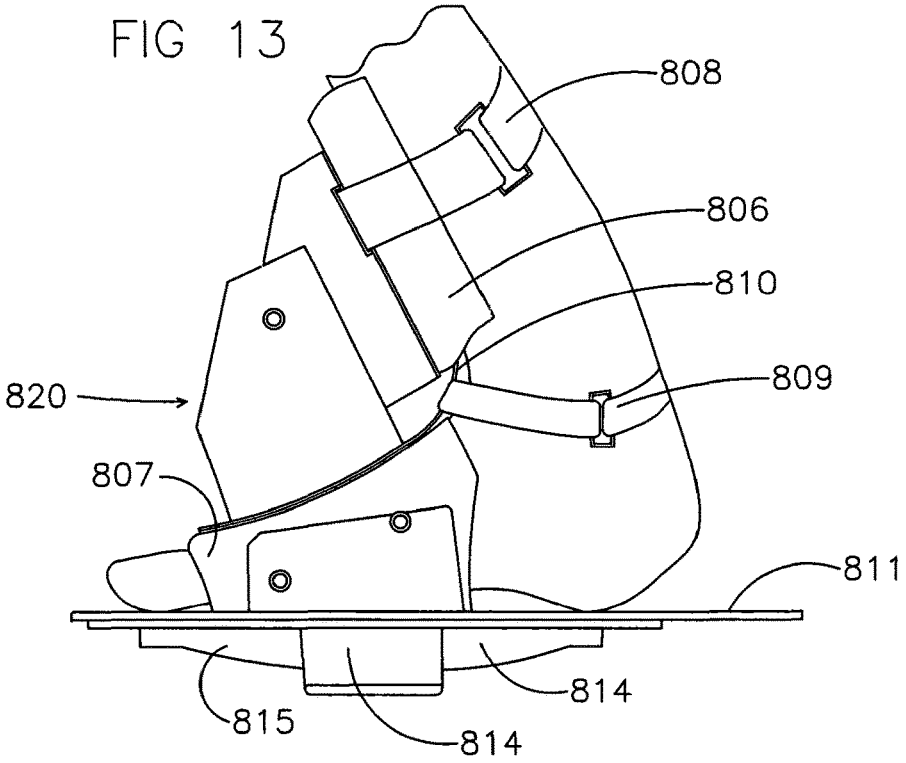
Figure 14:
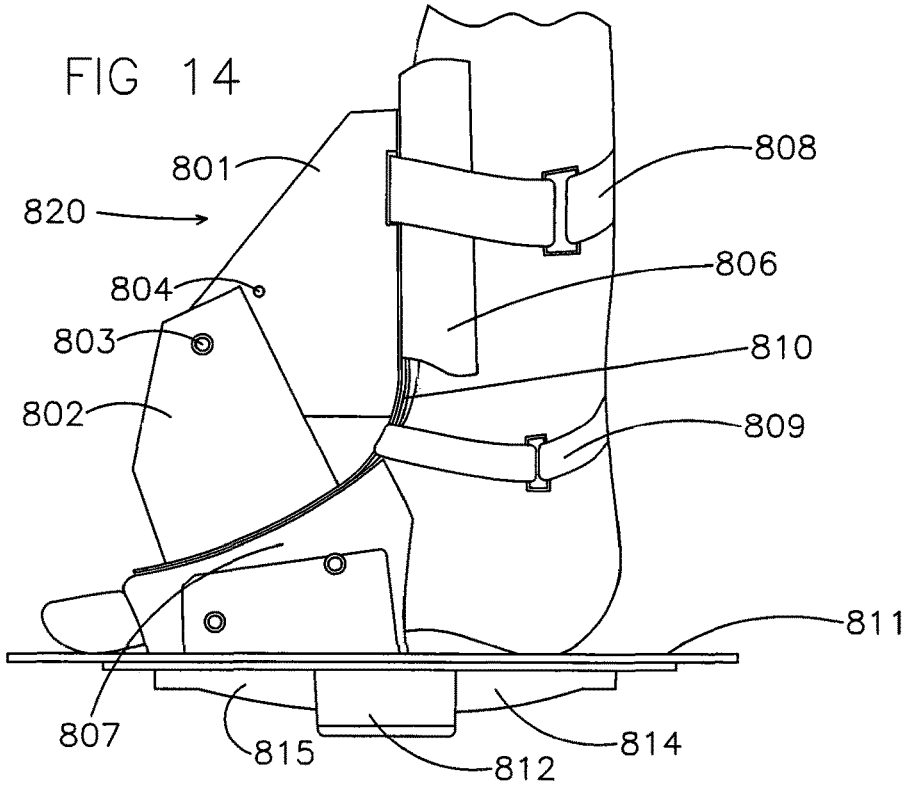

FIGS. 13 and 14 provide side views of the embodiment shown in FIG. 12, but with the brace set at two different angles (22 degrees from the vertical for FIG. 13 and 2 degrees from the vertical for FIG. 14).

Figure 15:
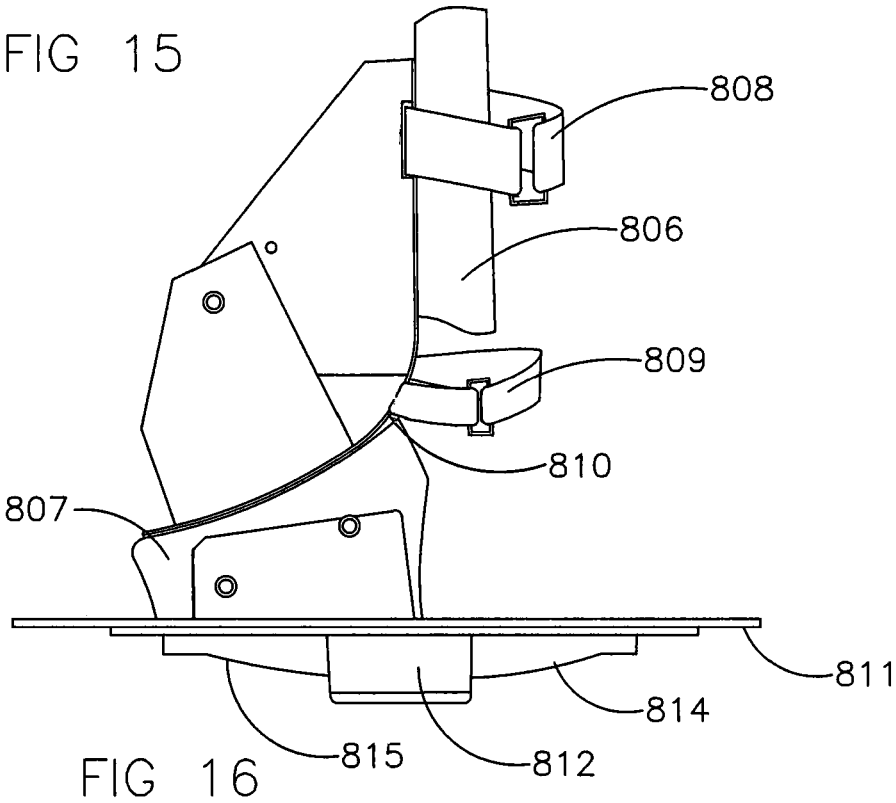

FIG. 15 is a side view showing the training aid illustrated in FIG. 12, but with the foot removed from the training aid.

Figure 16:
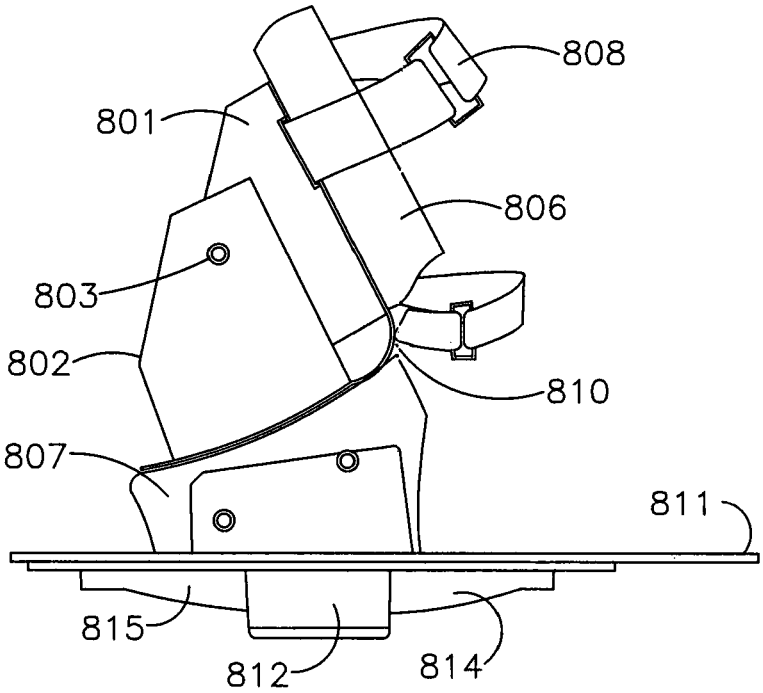

FIG. 16 shows the training aid illustrated in FIG. 15, but with the brace set at a larger angle from the vertical (18 degrees from the vertical) and the block shown in a more forwards position.

Figure 17:
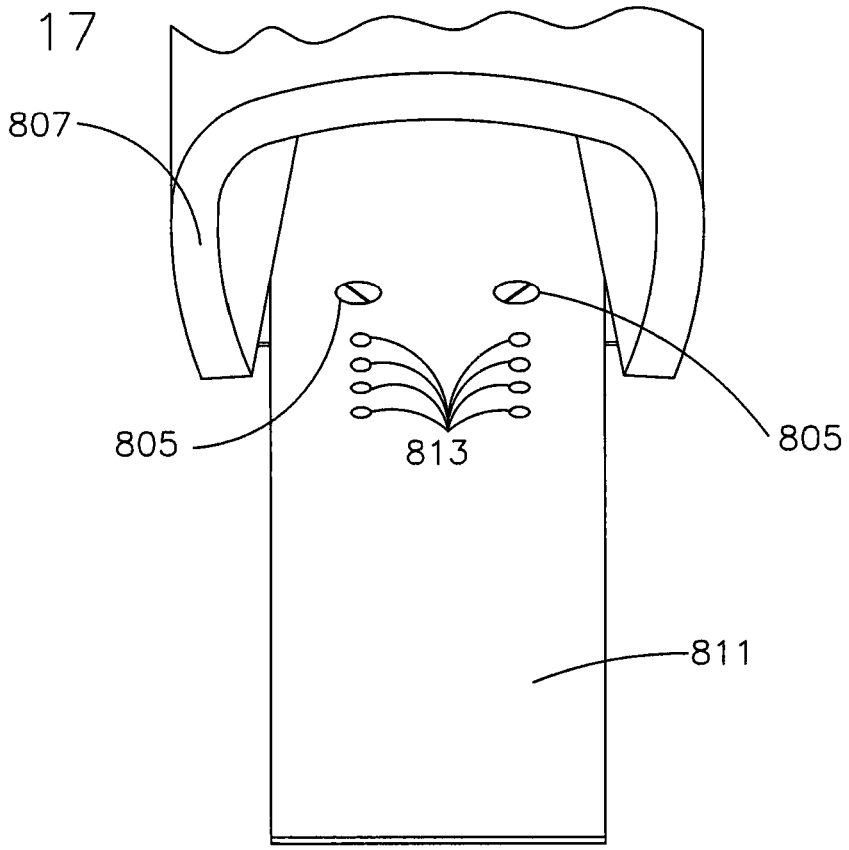

FIG. 17 is an elevated view showing a part of the platform of a training aid of the type shown in FIG. 16 and is useful in illustrating how the balancing block is secured by a pair screws that can be screwed into pairs of apertures at various spaced locations along the platform.

Figure 18:
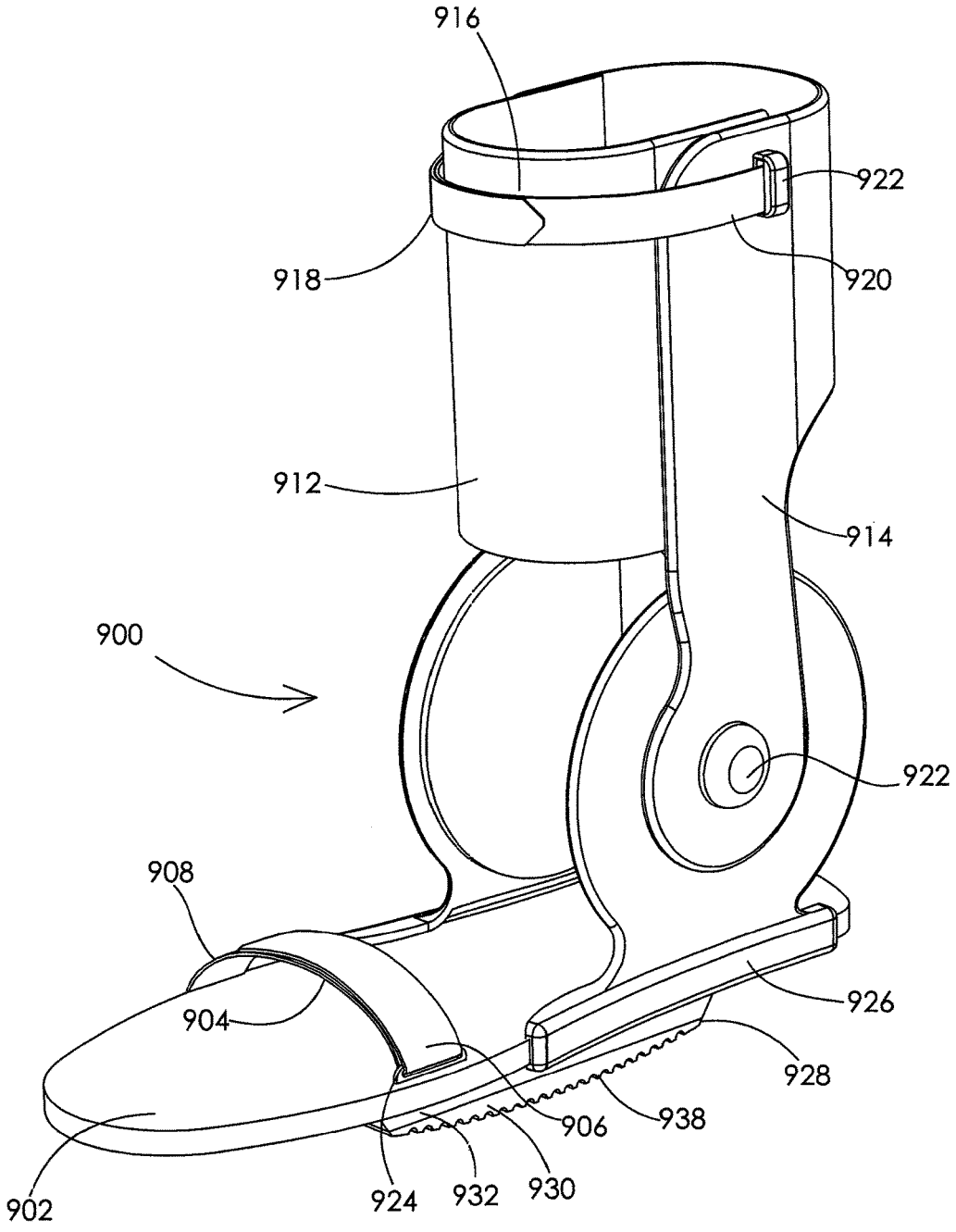

FIG. 18 shows a perspective view of another item of footwear of the present invention that can be used as a tightrope trainer and that has a brace that is shown here strapped in a closed position.

Figure 19:
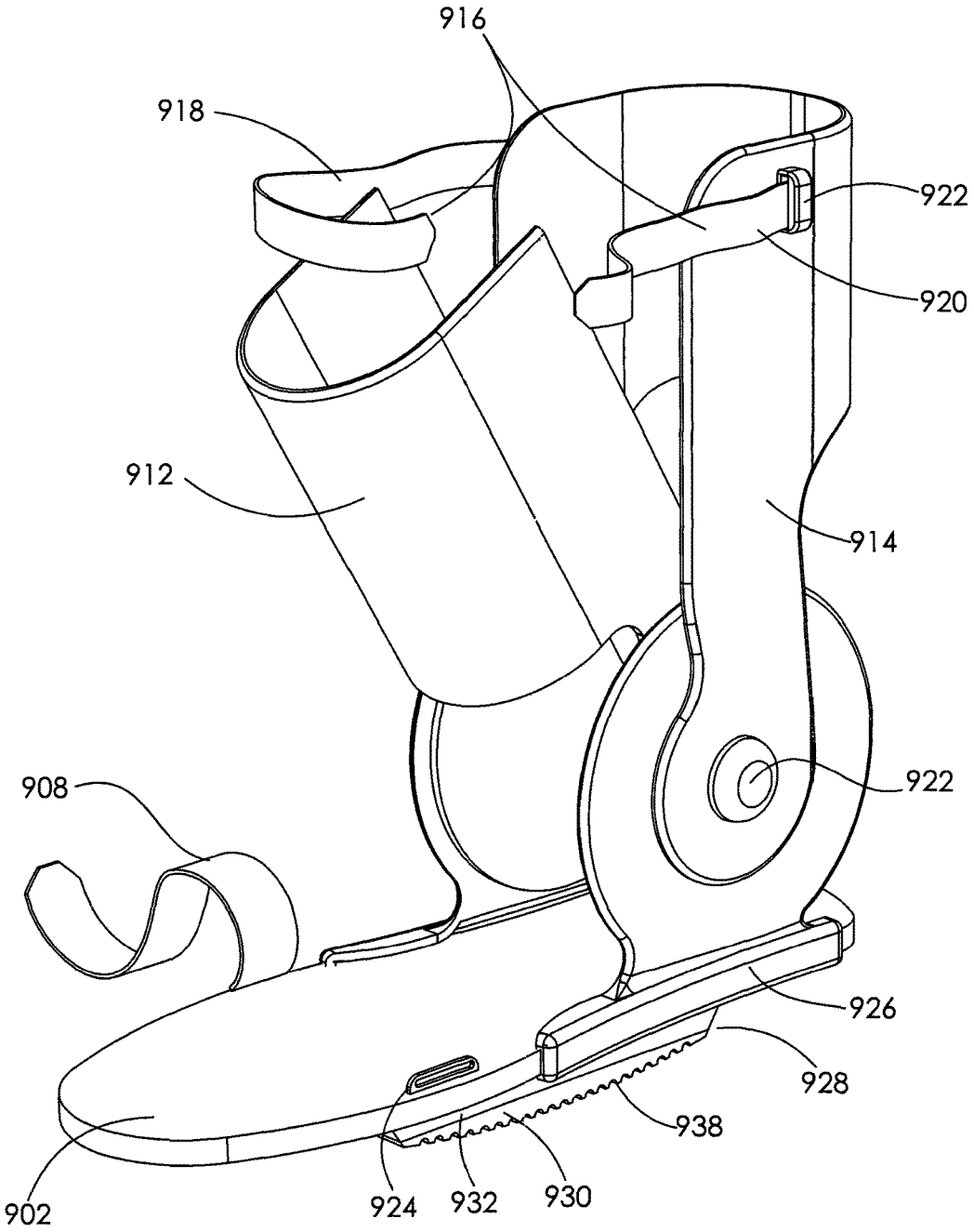

FIG. 19 shows the item of footwear shown in FIG. 18, but with straps released and the brace in an open position.

Figure 20:
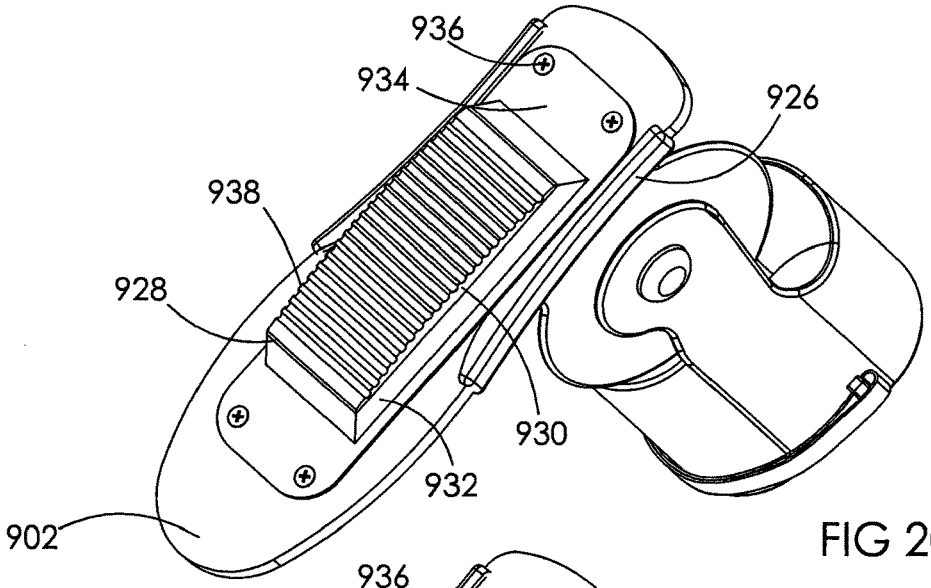

FIG. 20 shows a view of the item of footwear shown in FIGS. 18 and 19 when seen from underneath so that a balancing member can be seen that is fixed to a mounting plate, with the mounting plate being held in place by screws.

Figure 21:
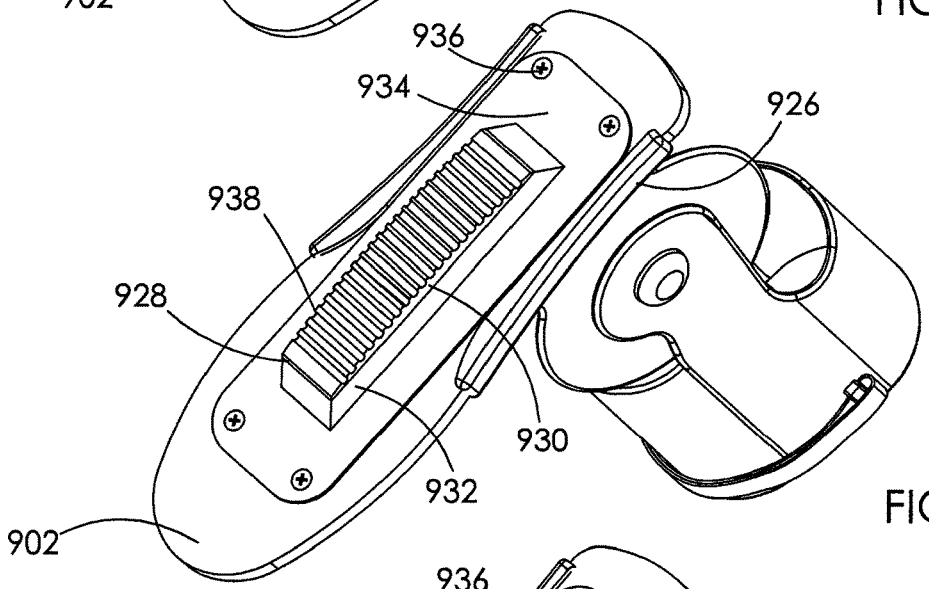

FIG. 21 is similar to FIG. 20, but with the balancing member shown in FIG. 20 having been replaced by a narrower balancing member.

Figure 22:
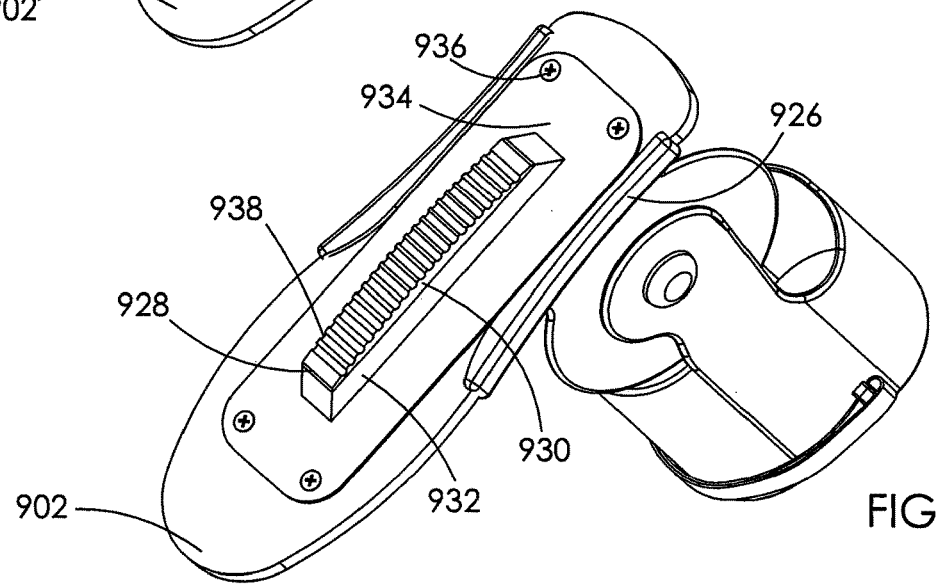

FIG. 22 is similar to FIG. 21, but with the balancing shown in FIG. 21 having been replaced by a still narrower balancing member.

Figure 23:
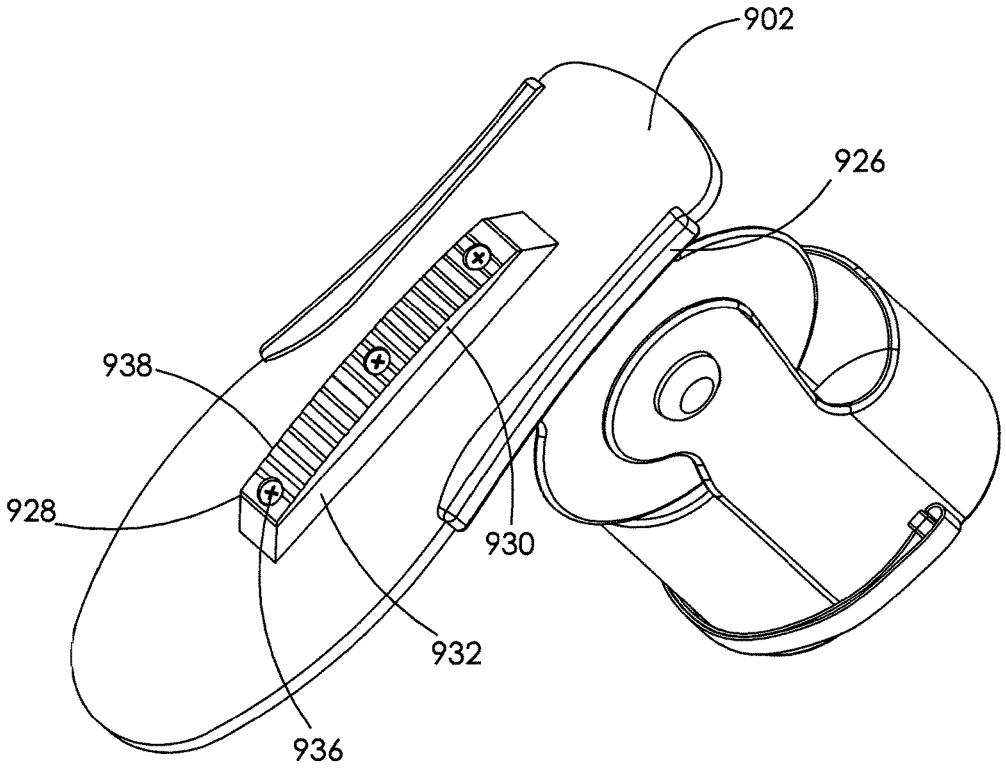

FIG. 23 is similar to FIG. 22, apart from the fact that there is no mounting plate and the screws are instead screwed through the balancing member itself.

Figure 24:
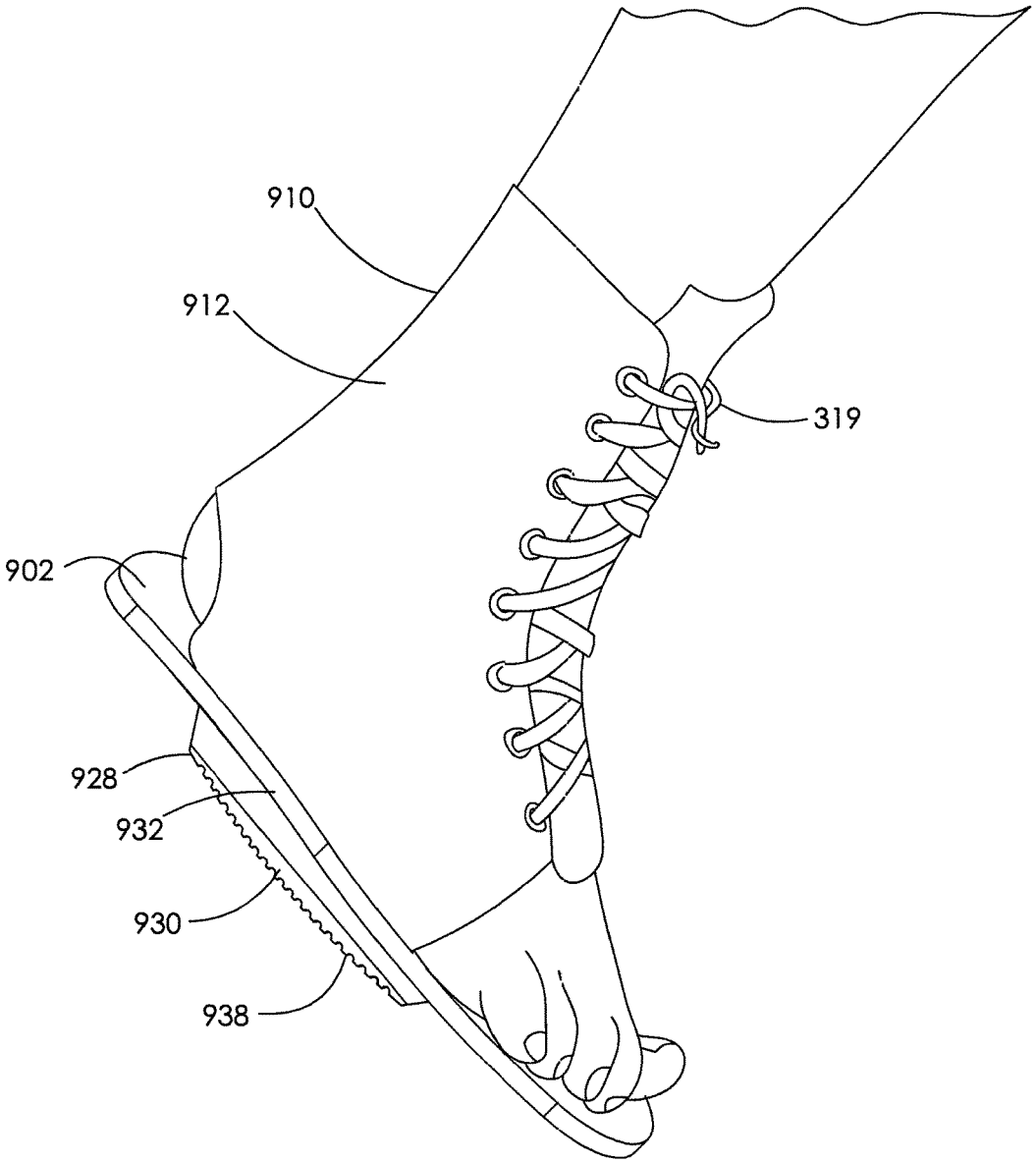

FIG. 24 shows a perspective view from above and to one side of an alternative item of footwear of the present invention that has an upper region similar to that of a laced-up sandal.

Figure 25:
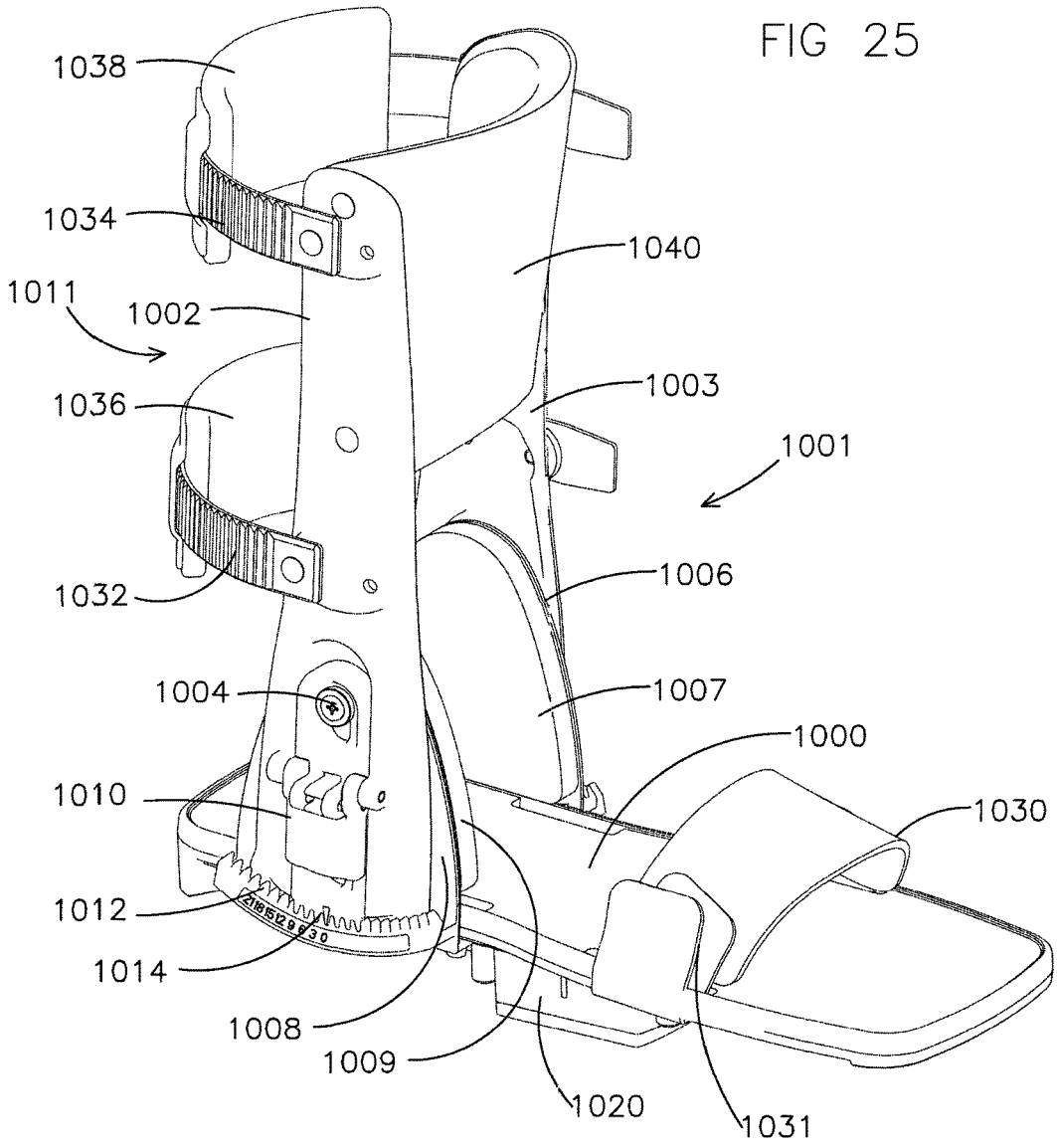

FIG. 25 shows a perspective view of an intended production model of a multi-purpose trainer of the present invention, when shown from the front and the right hand side.

Figure 26:
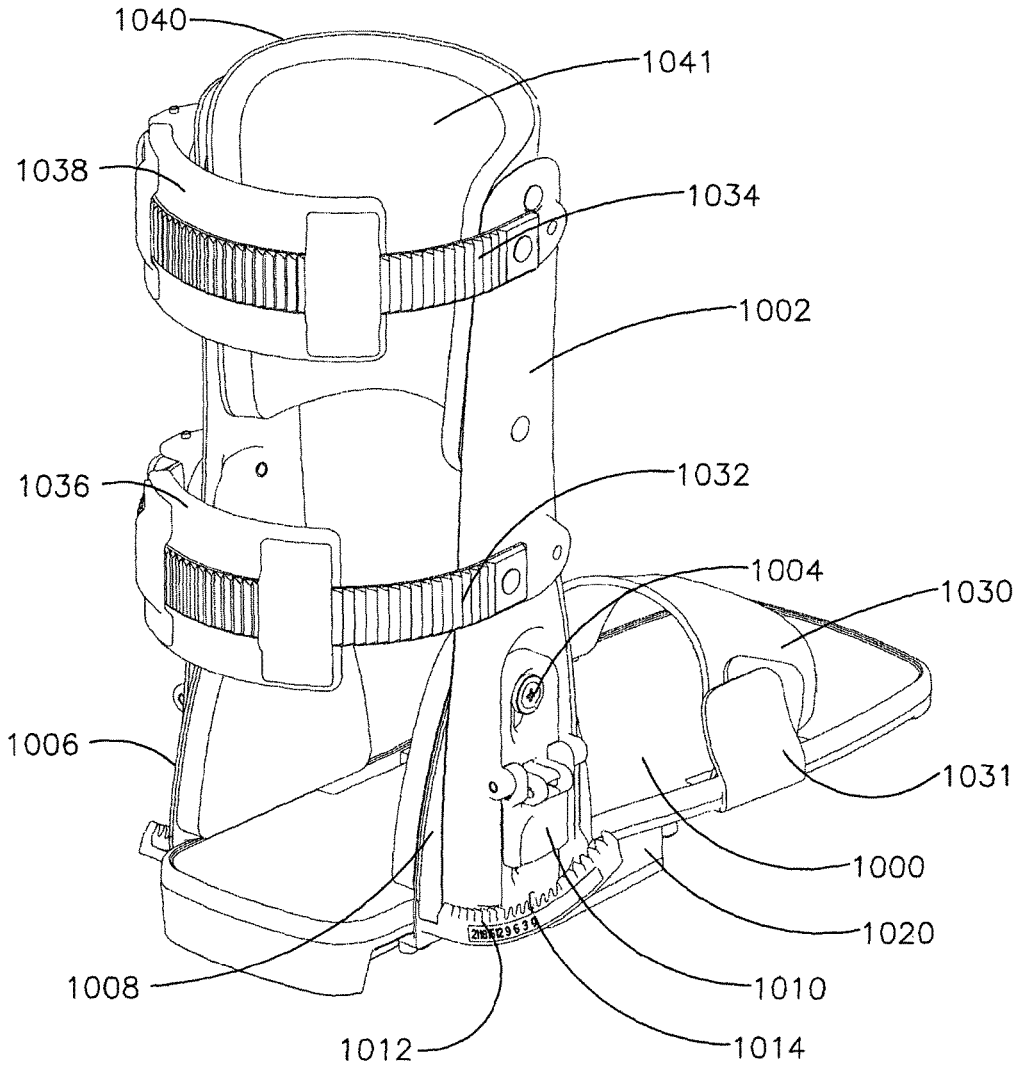

FIG. 26 is similar to FIG. 25, but is a view taken from the rear and the right hand side.

Figure 27:
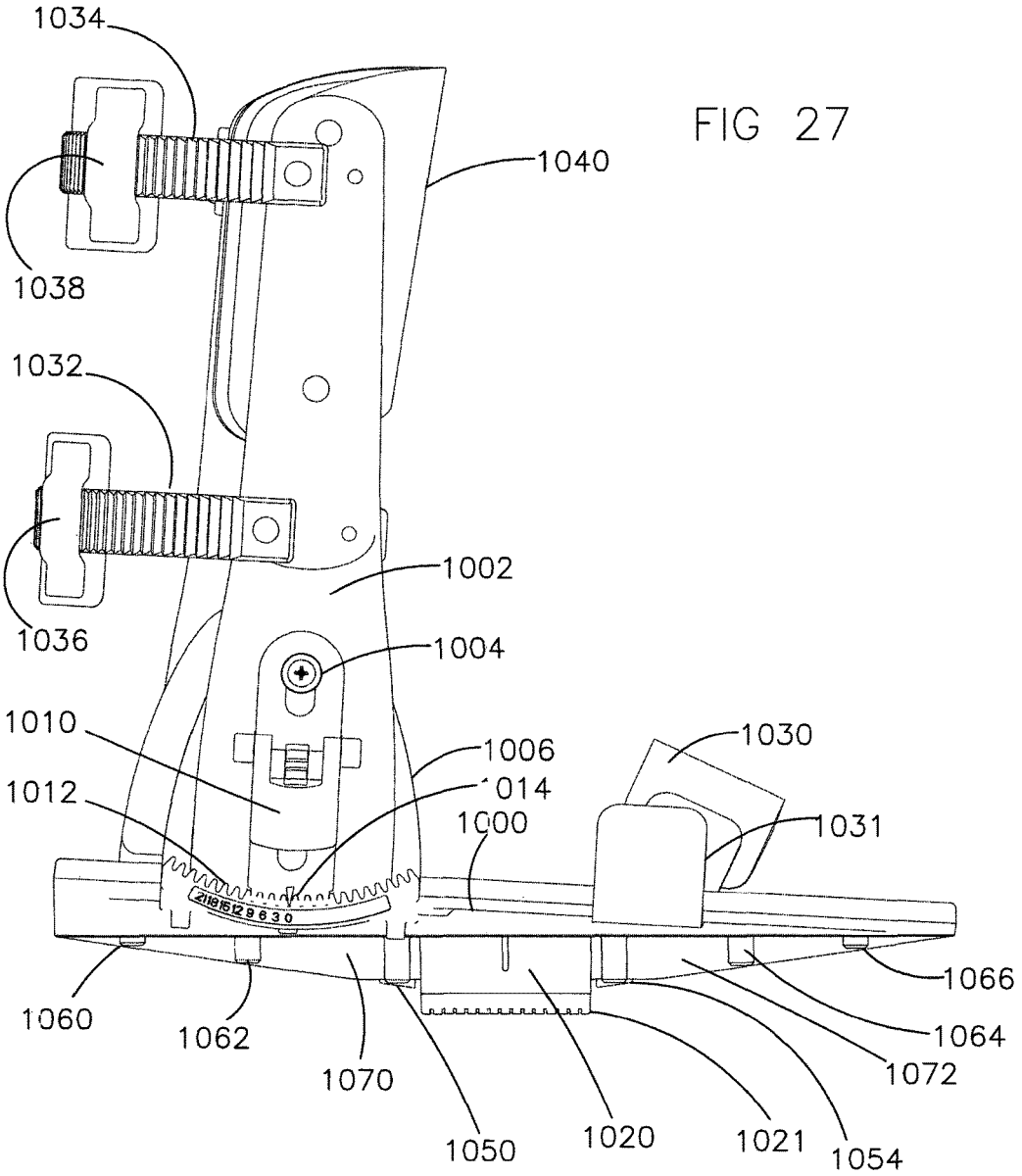

FIG. 27 is similar to FIG. 26, but is a side-on view from the right hand side.

Figure 28:
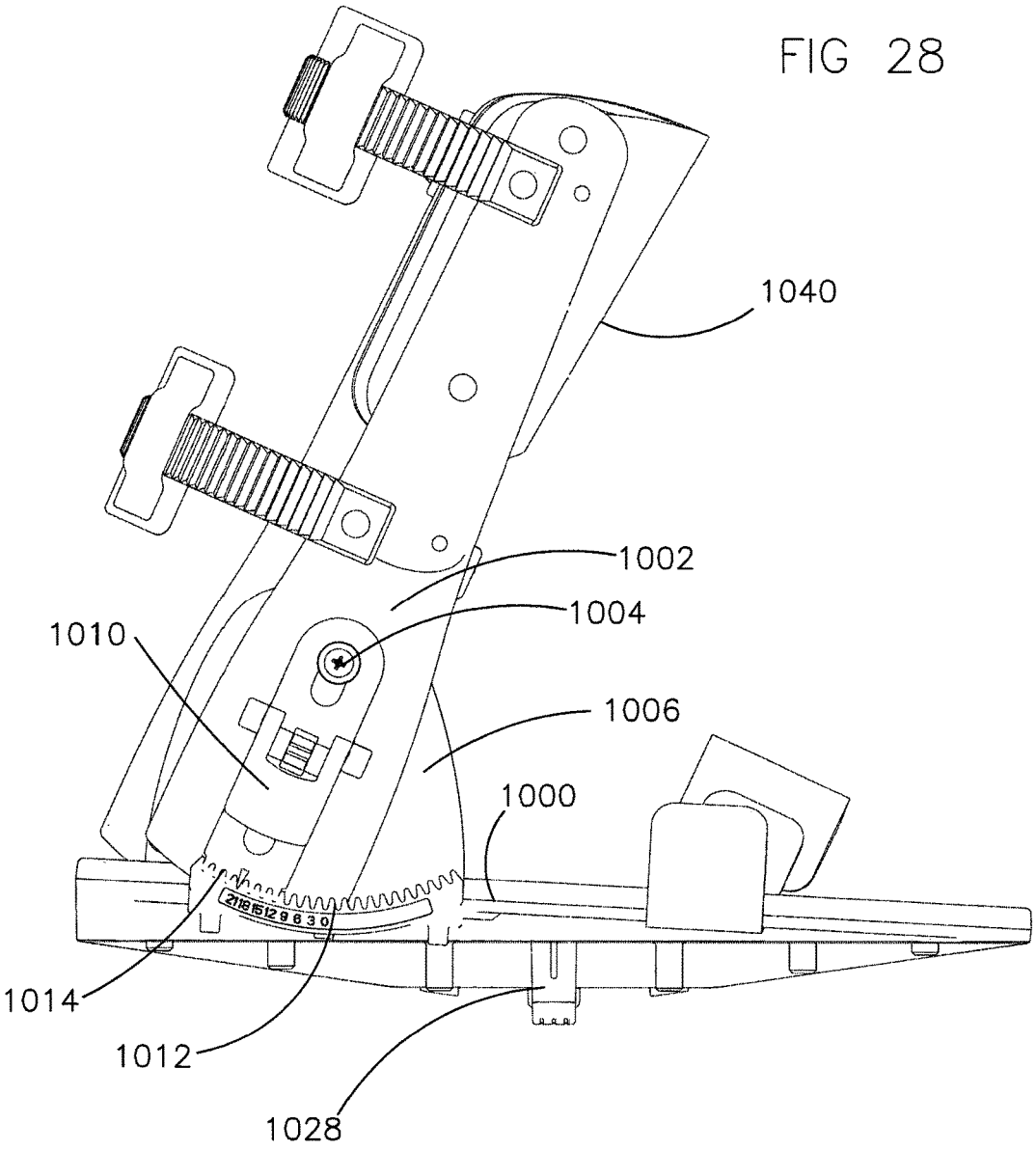

FIG. 28 is similar to FIG. 27, but here the brace is shown having been angled forwards, with the angle indicator indicating 21 degrees, rather than 0 degrees.

Figure 29:
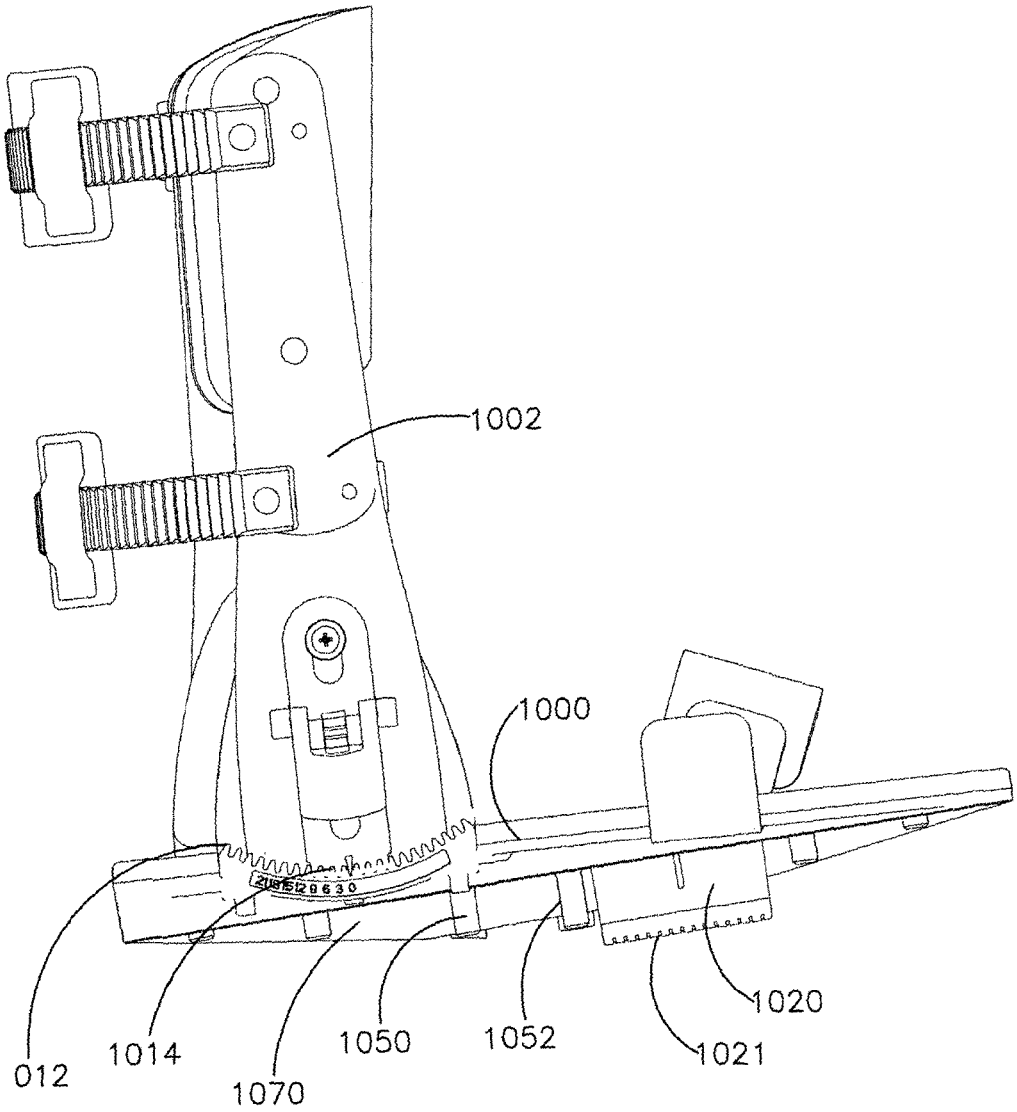

FIG. 29 is similar to FIG. 27, but shows the same balancing block in a more forwards position.

Figure 30:
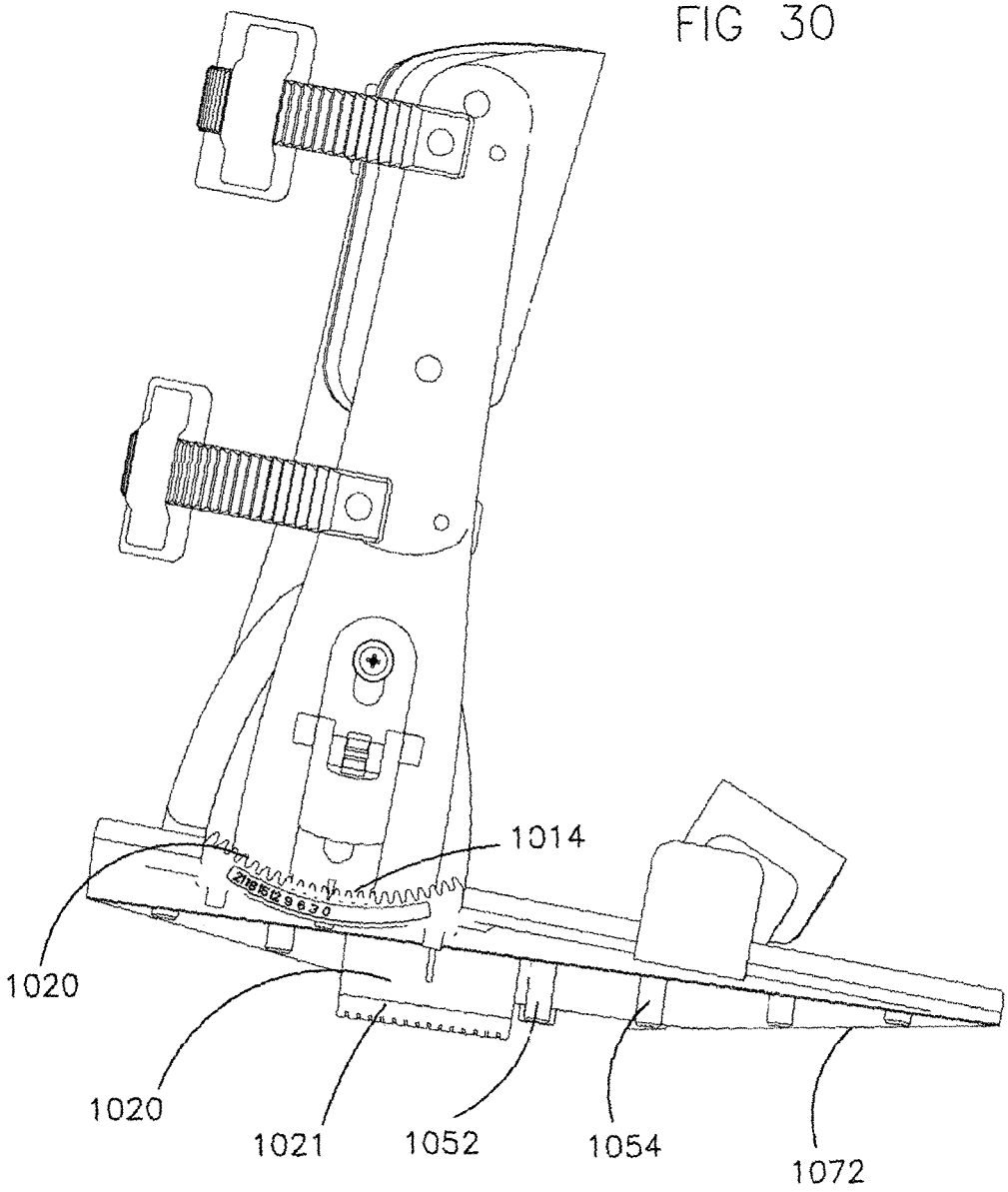

FIG. 30 is similar to FIG. 27, but shows the same balancing block in a more rearwards position.

Figure 31:
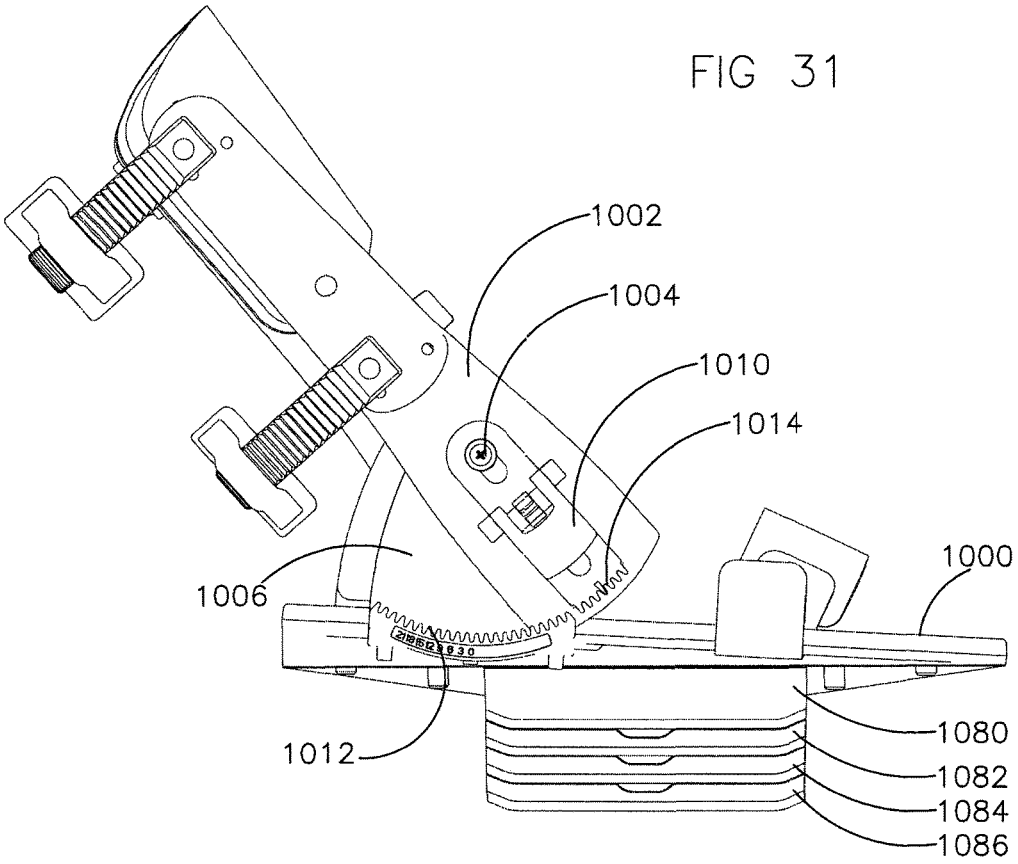

FIG. 31 shows a side view of a trainer of the present invention that comprises a stack of four balancing blocks and has a brace angled rearwards.

Figure 32:
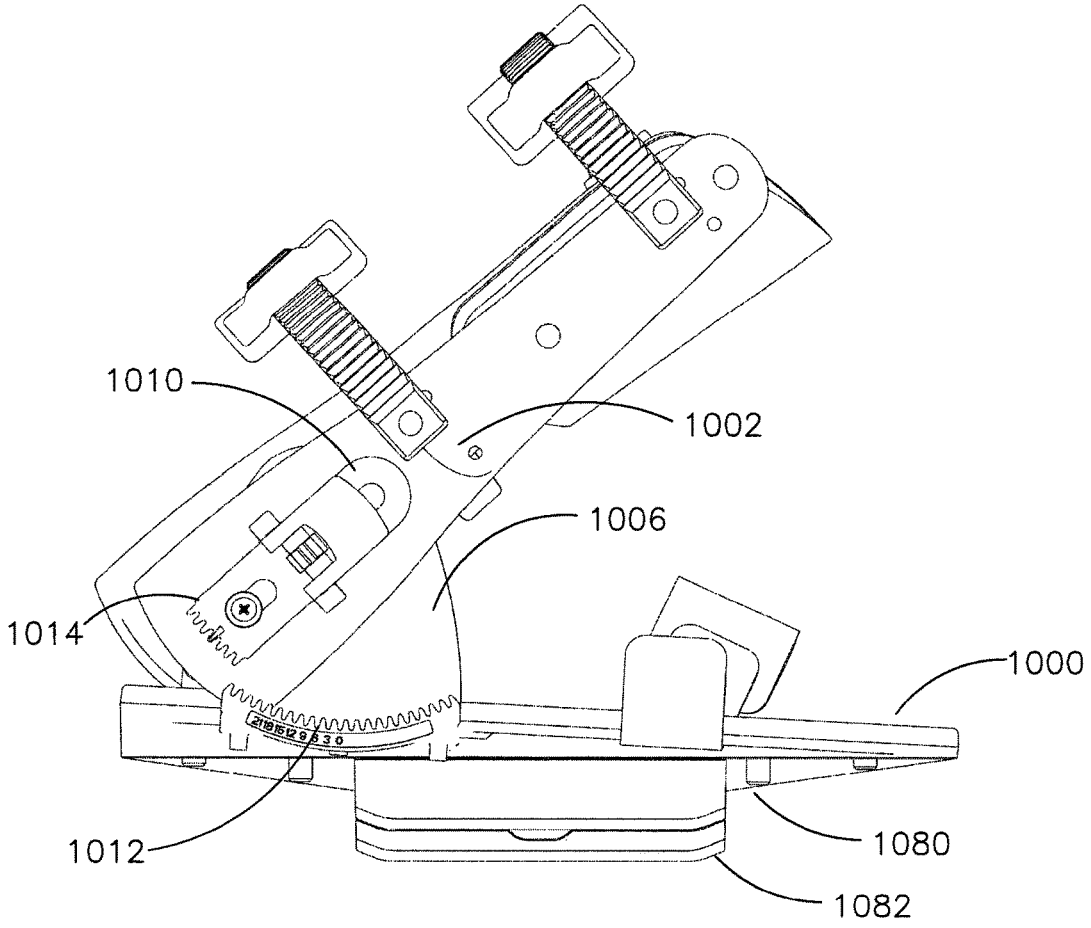

FIG. 32 is similar to FIG. 31, but has two of the balancing blocks shown in FIG. 31 removed and has the brace angled forwards.

Figure 33:
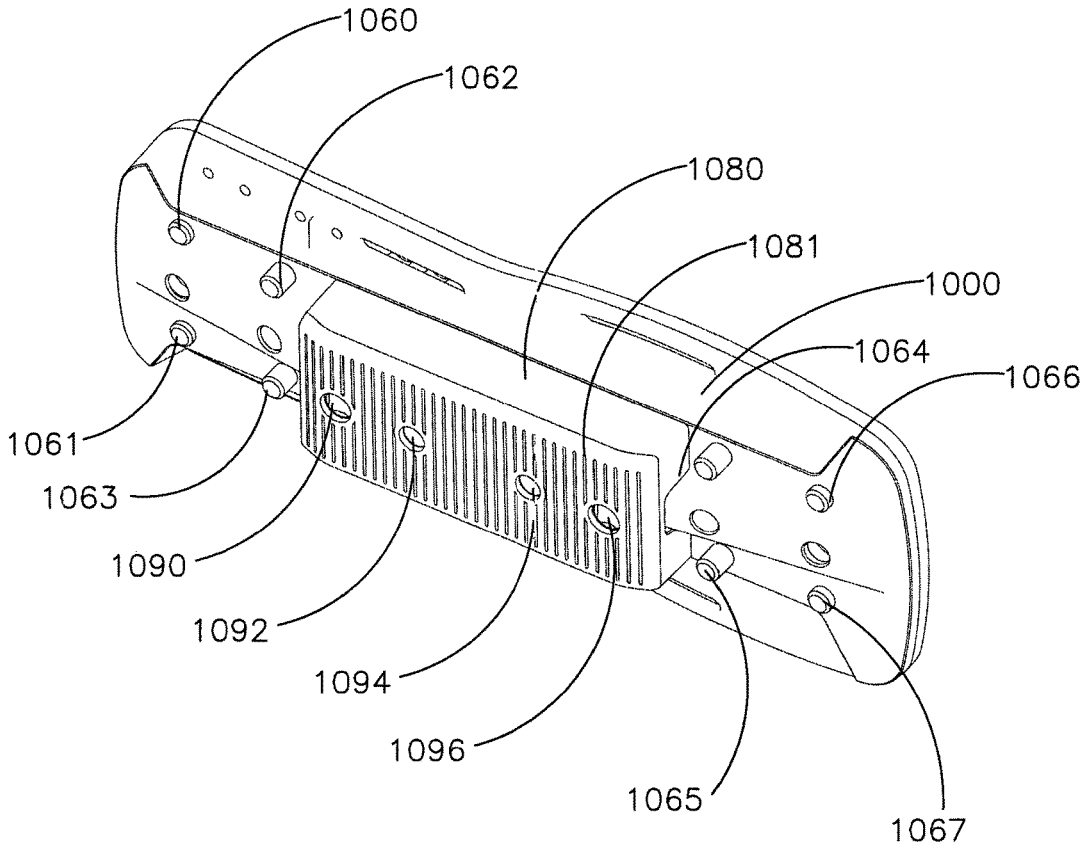

FIG. 33 shows a view from underneath and to one side of an item of footwear of the present invention with the brace not shown (for simplicity) and with a single balancing block present.

Figure 34:
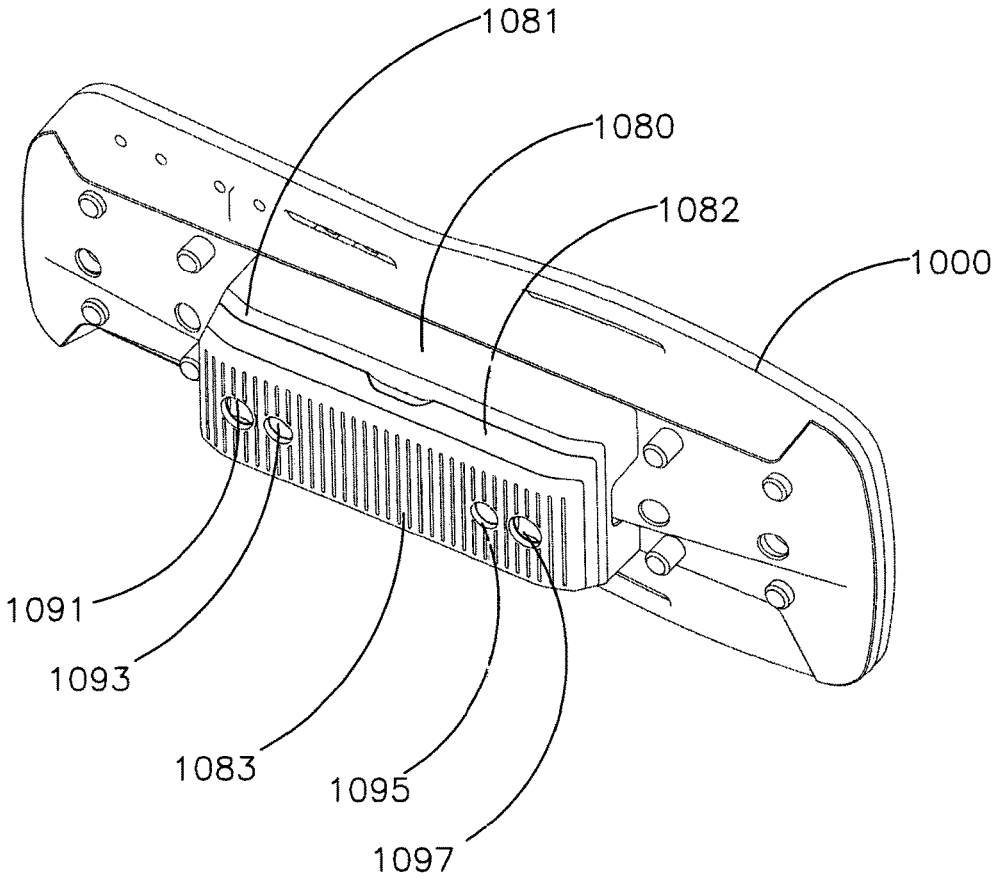

FIG. 34 is similar to FIG. 33, but has an additional balancing block.

Figure 35:
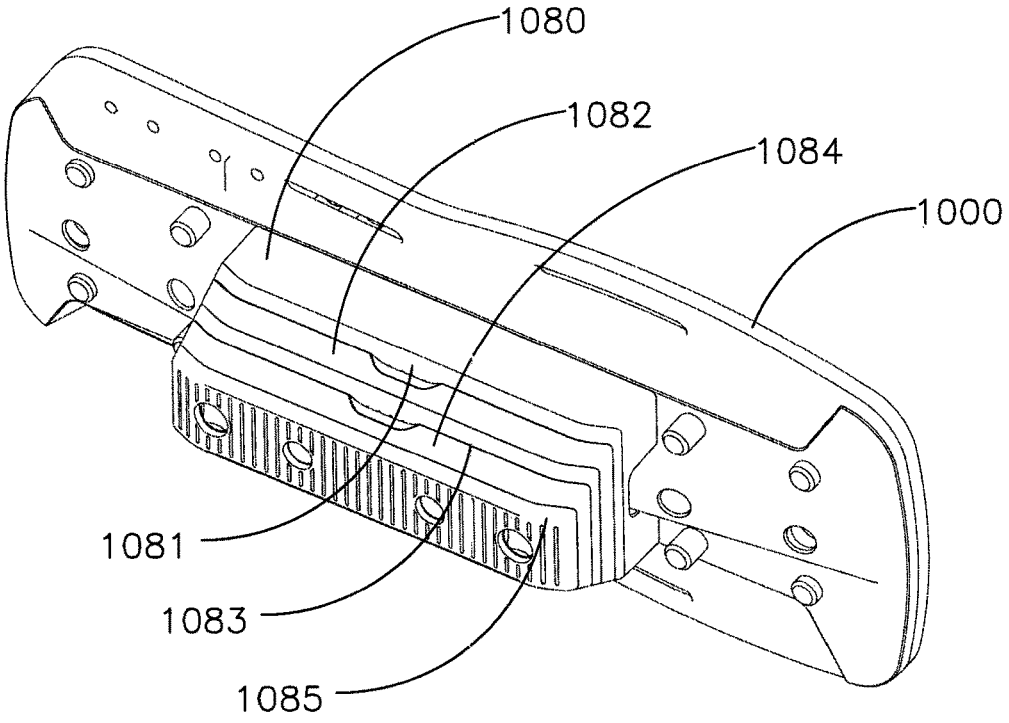

FIG. 35 is similar to FIG. 34, but with a further balancing block.

Figure 36:
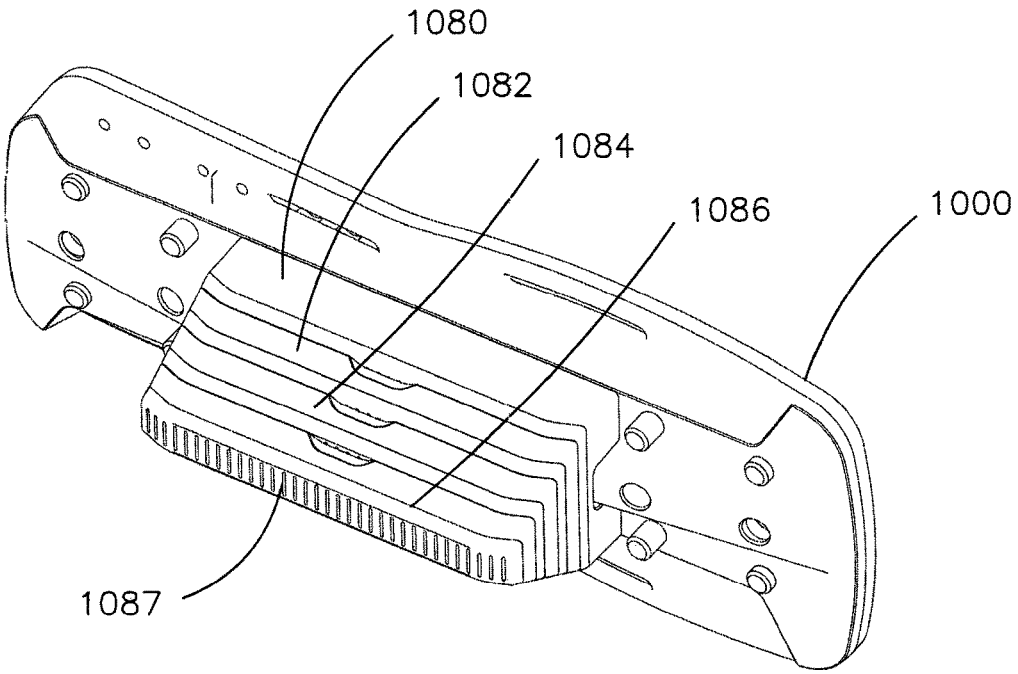

FIG. 36 is similar to FIG. 35, but with a still further layer balancing block.

Figure 37:
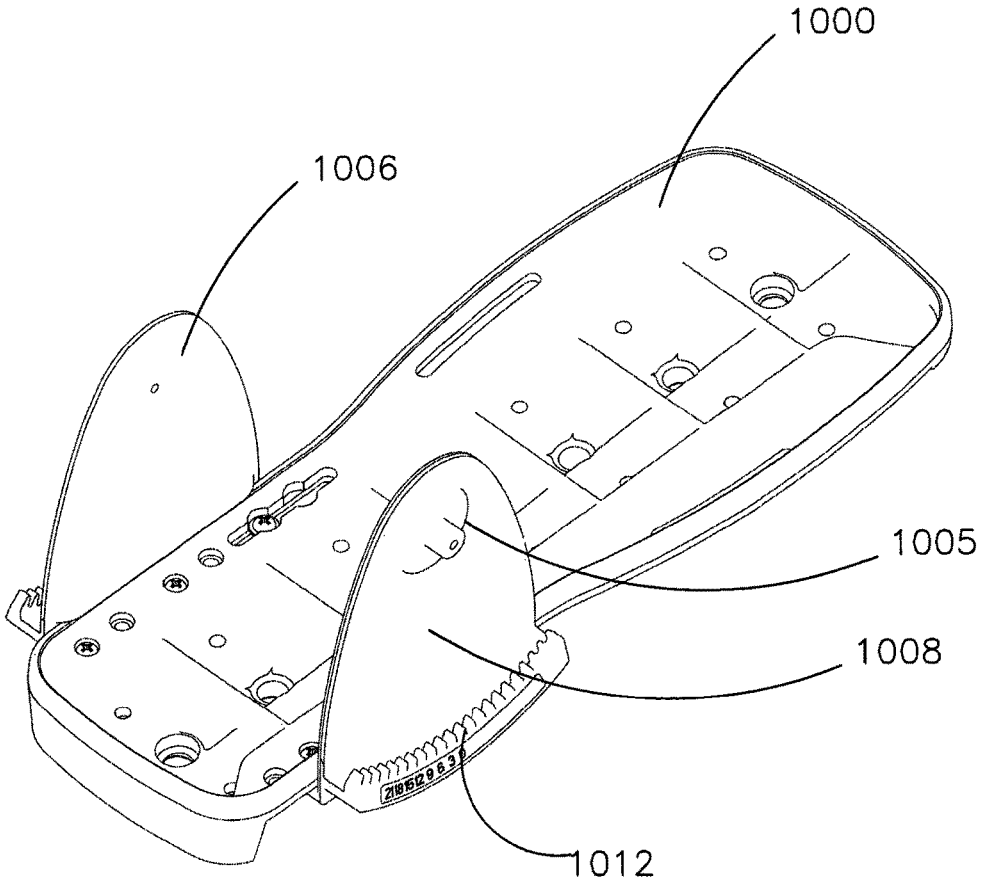

FIG. 37 is a view from above and to one side of a trainer of the type illustrated in FIGS. 25 to 36, but with the balancing block(s), brace and toe strap removed and with an upper covering of the platform also removed.

Figure 38:
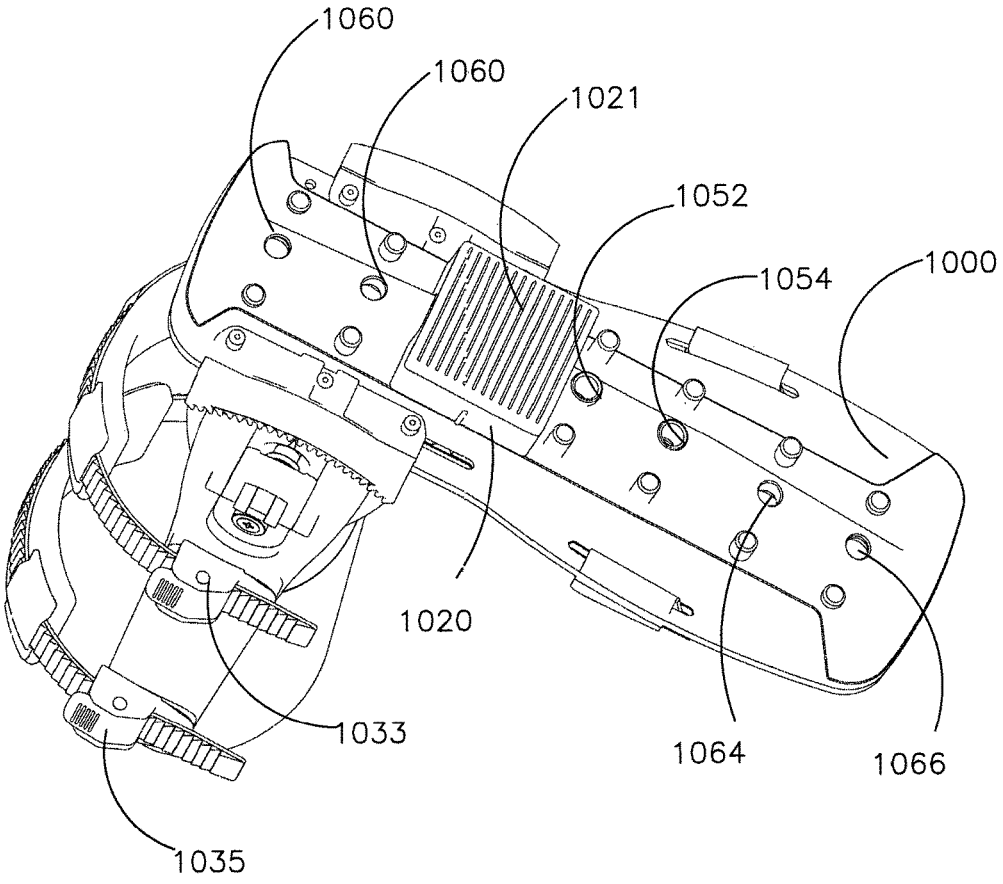

FIG. 38 shows an underside view of the trainer shown in FIG. 25.

Figure 39:
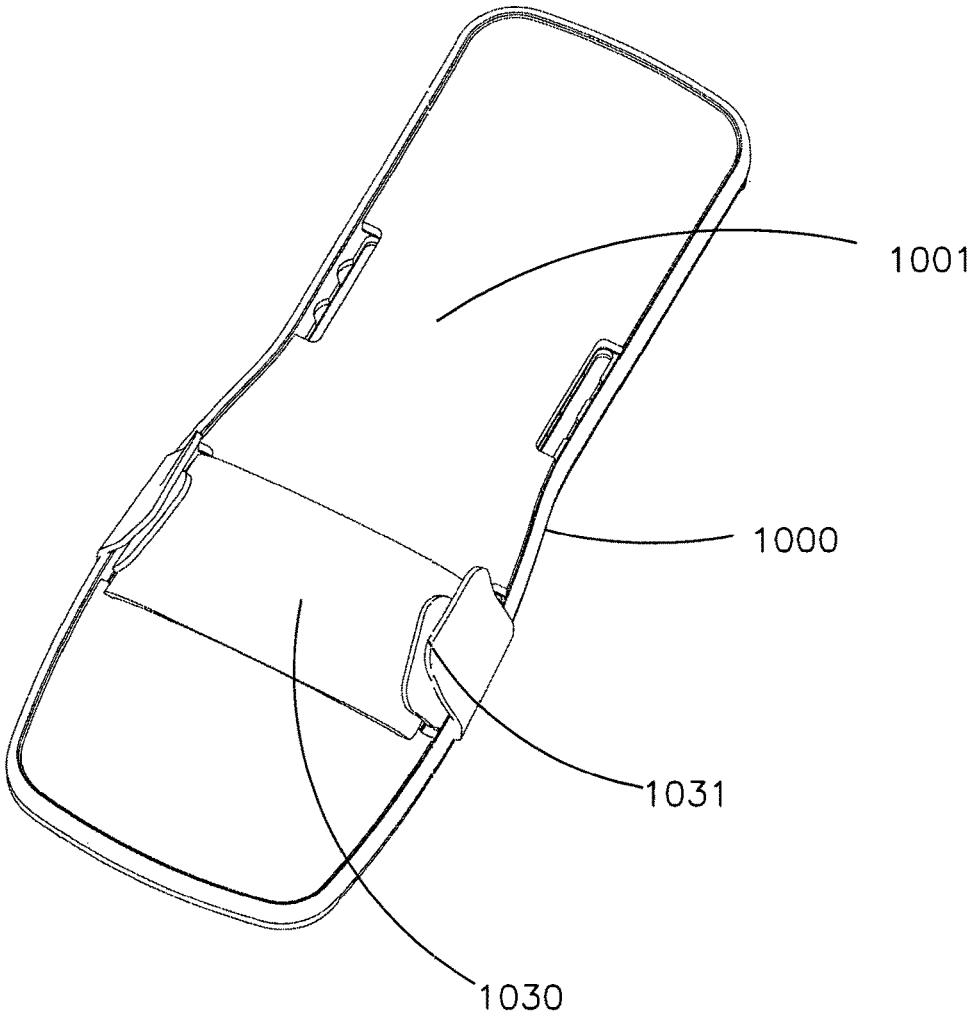

FIG. 39 shows a plan view of the platform of the trainer shown in FIG. 25 with a toe strap included, but with the brace, and the side supports for the brace removed.

Figure 40:
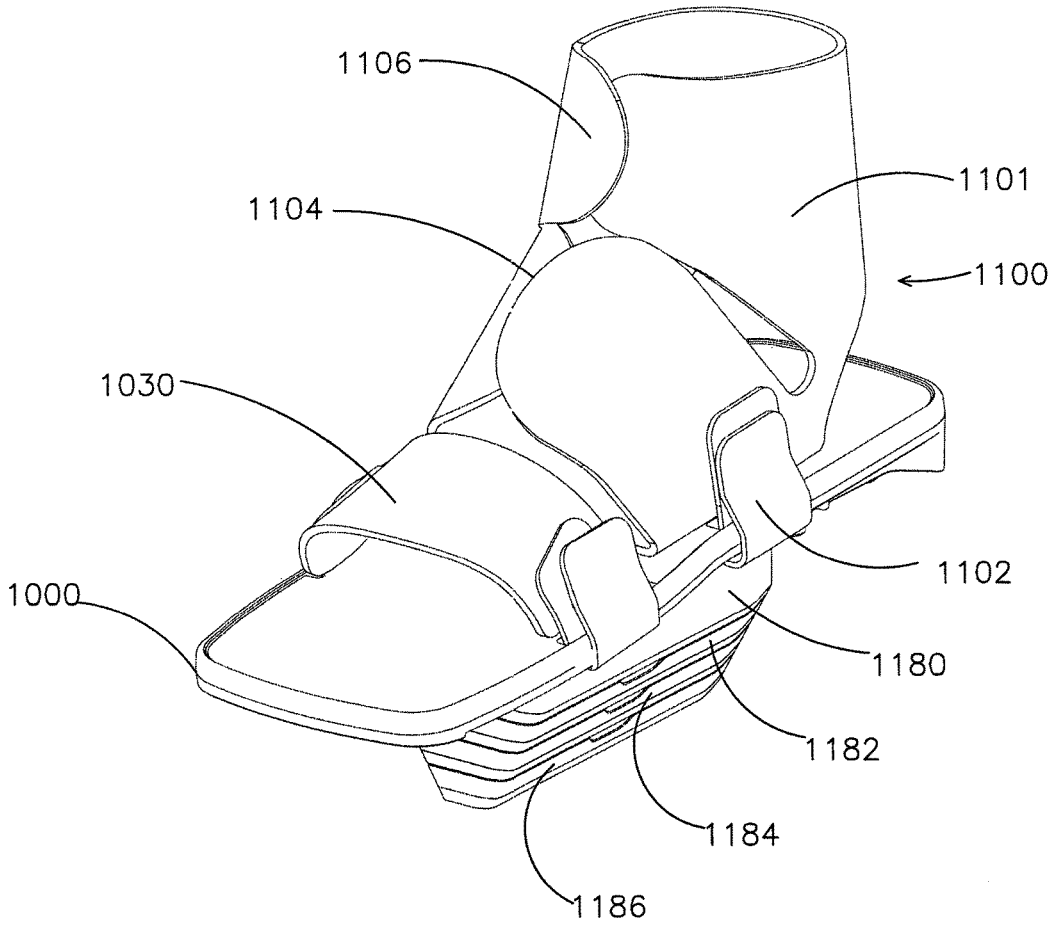

FIG. 40 shows a trainer that has multilayer balancing blocks corresponding to those illustrated in FIG. 31, but has an alternative brace structure that does not include struts.

Figure 41:
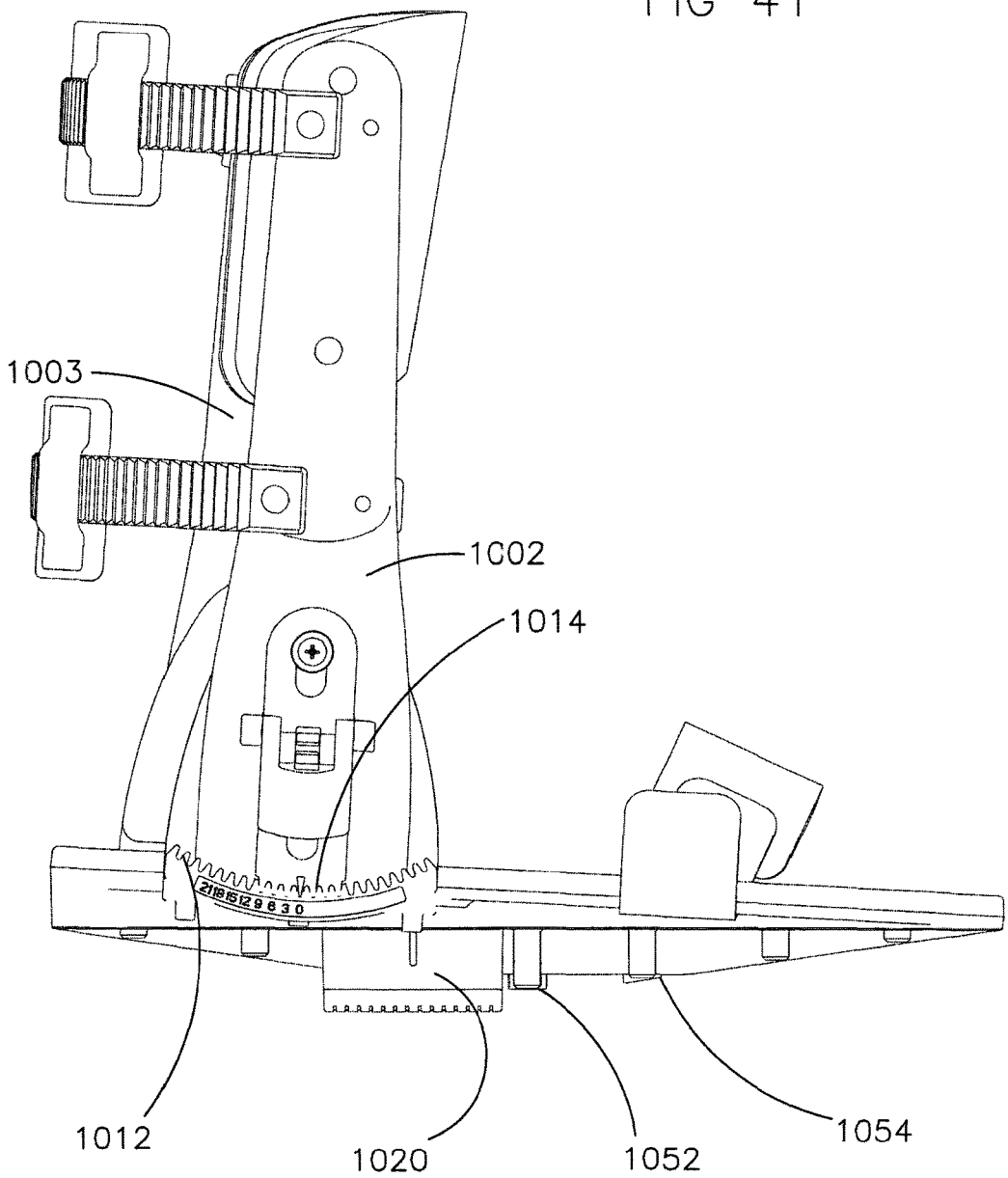

FIG. 41 is similar to FIG. 27, but has the balancing block located further back along the underside of the platform.

Figure 42:
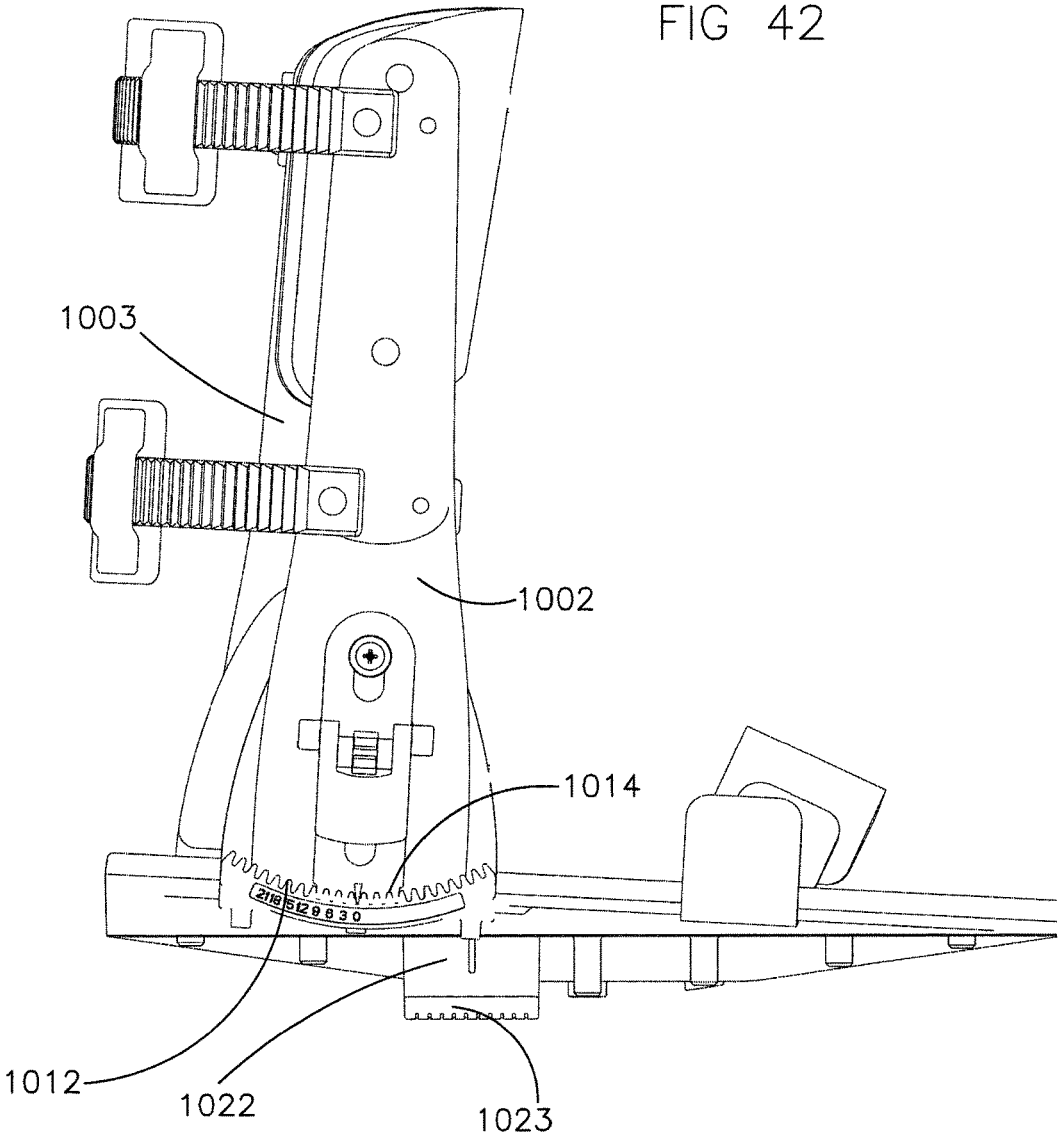

FIG. 42 is similar to FIG. 41, but with the balancing block having been replaced by a smaller balancing block.

Figure 43:
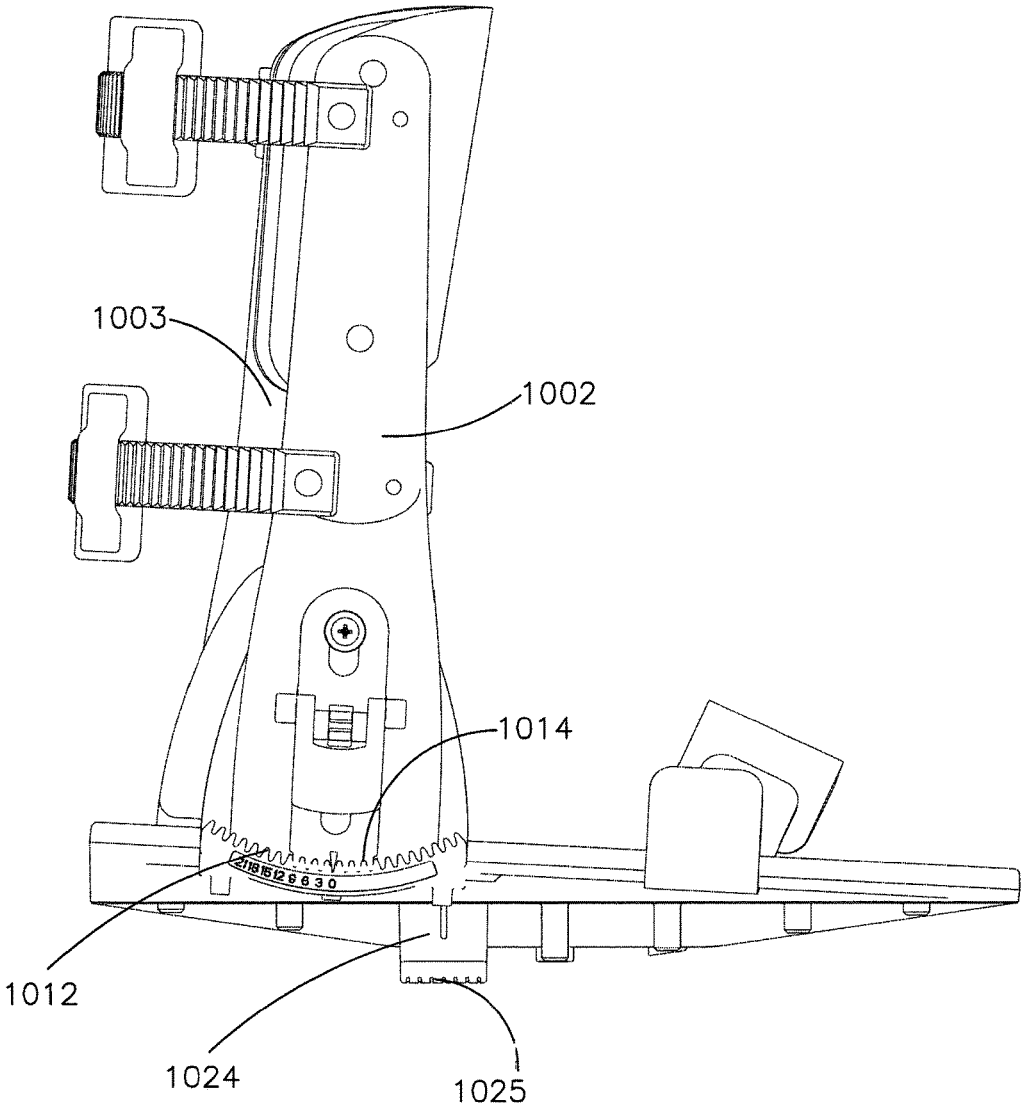

FIG. 43 is similar to FIG. 42, but with the balancing block having been replaced by a still smaller balancing block.

Figure 44:
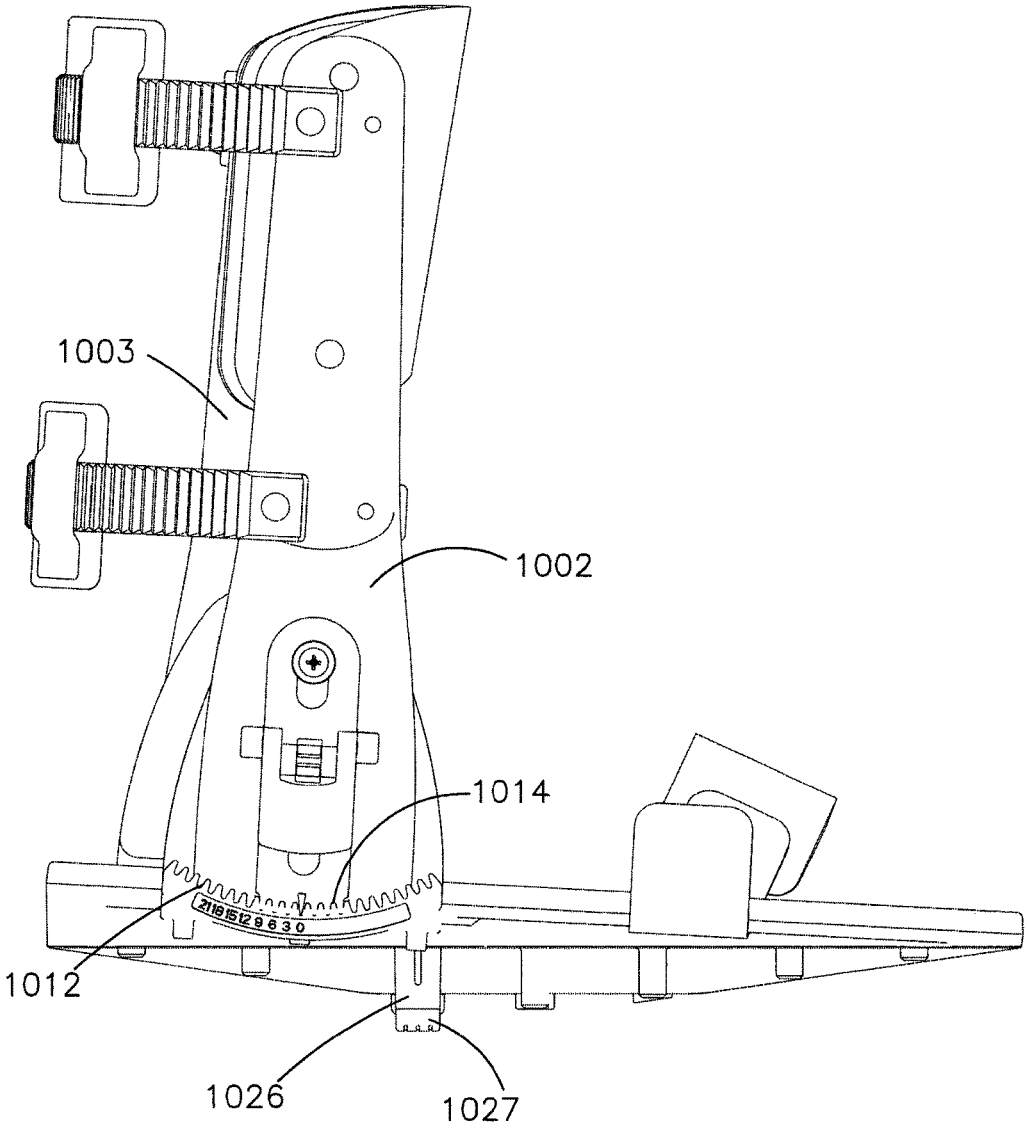

FIG. 44 is similar to FIG. 43, but with the balancing block having been replaced by a yet smaller balancing block.

Figure 45:
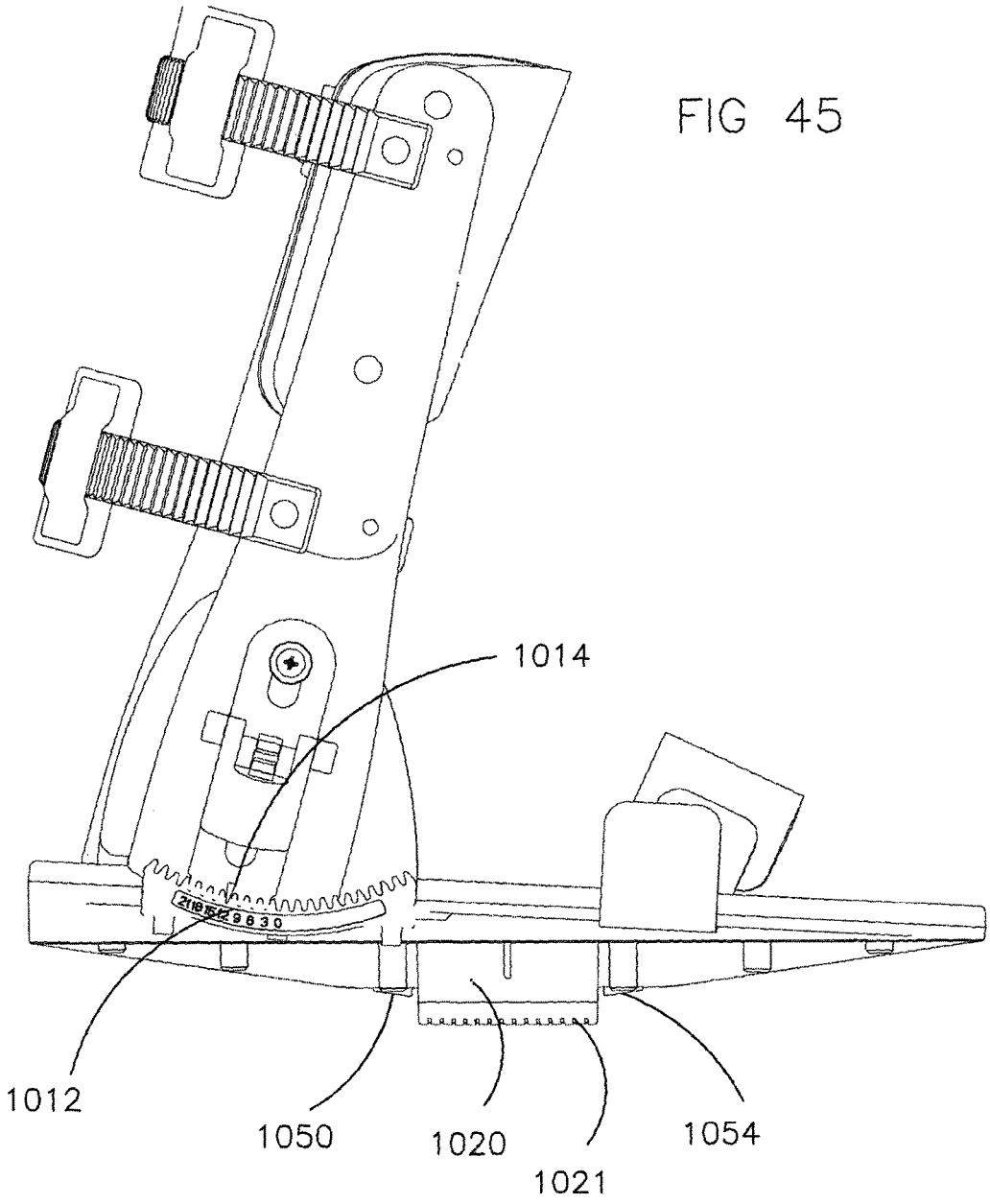

FIG. 45 is similar to FIG. 27, but with the brace angled forwards.

Figure 46:
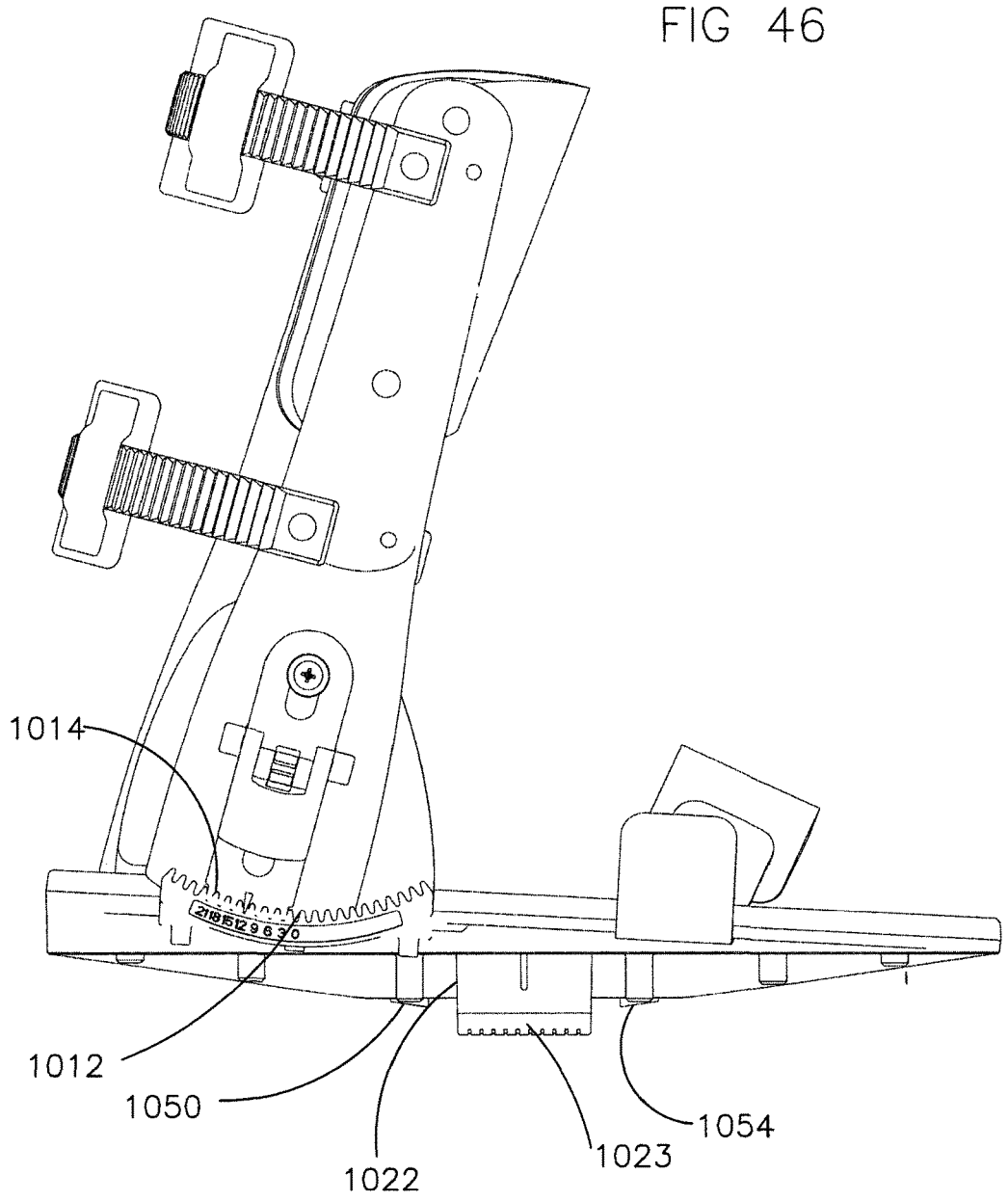

FIG. 46 is similar to FIG. 45, but with the balancing block having been replaced by a smaller balancing block.

Figure 47:
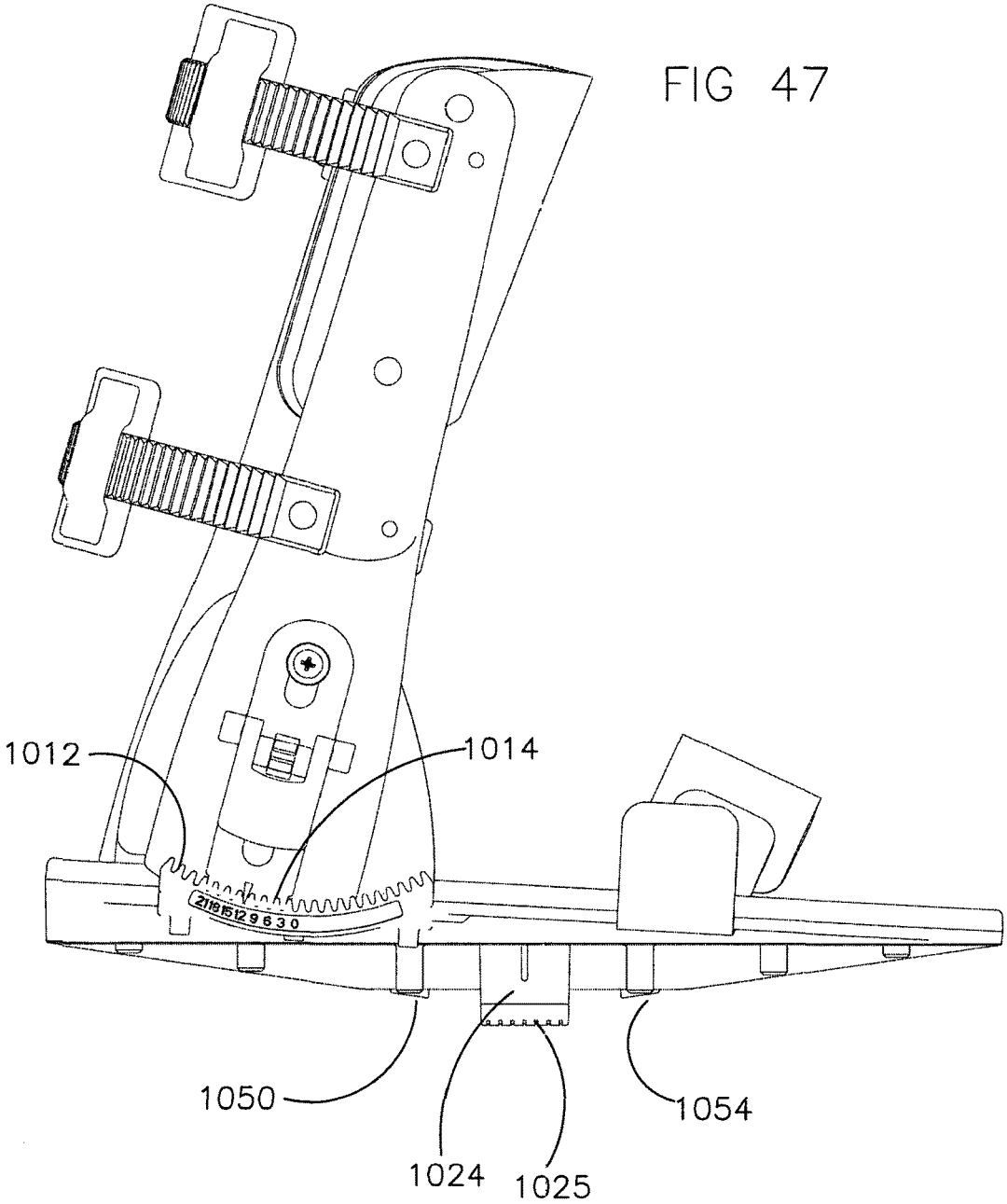

FIG. 47 is similar to FIG. 46, but with the balancing block having been replaced by a still smaller balancing block.

Figure 48:
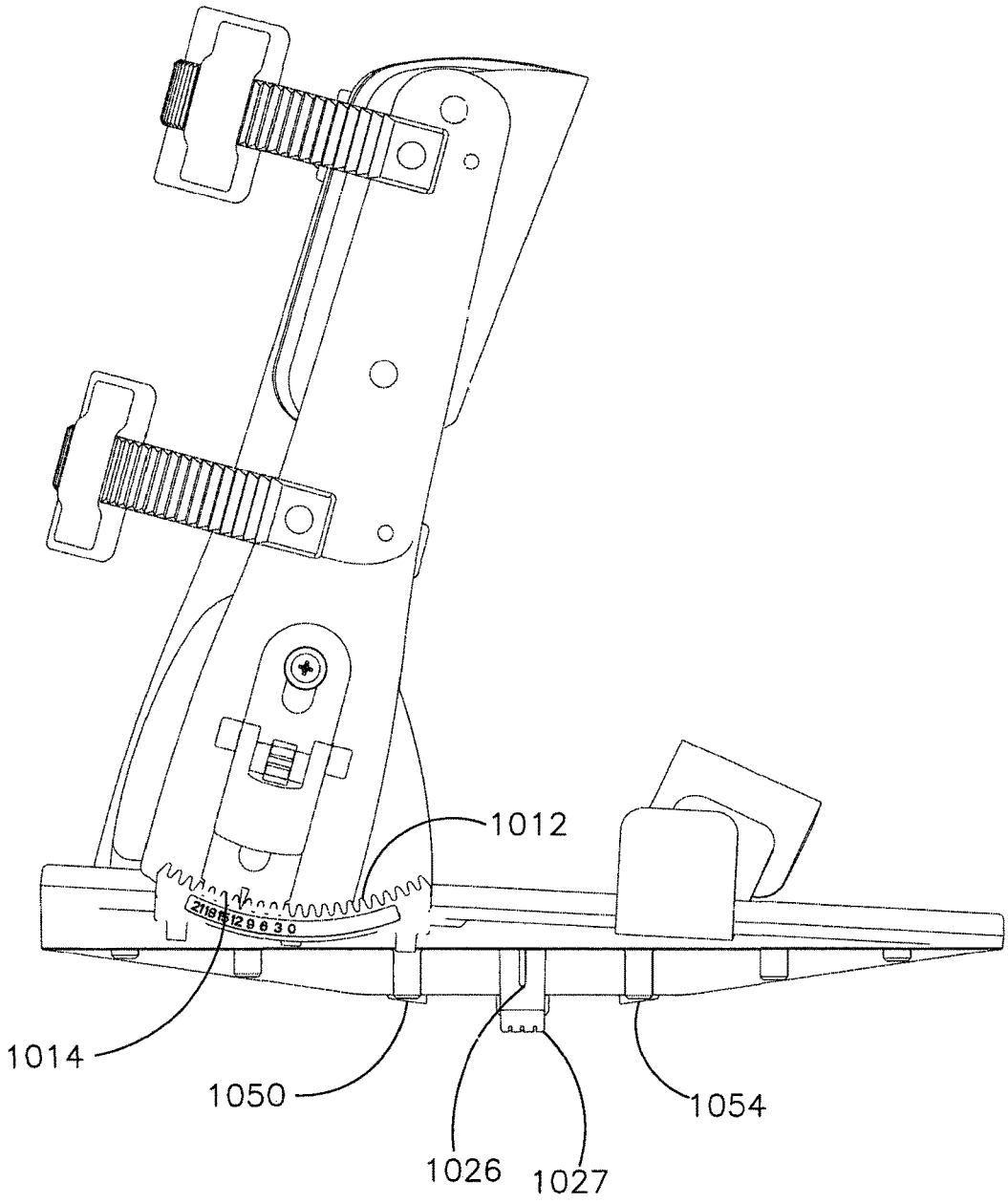

FIG. 48 is similar to FIG. 47, but with the balancing block having been replaced by a yet smaller balancing block.

Figure 49:
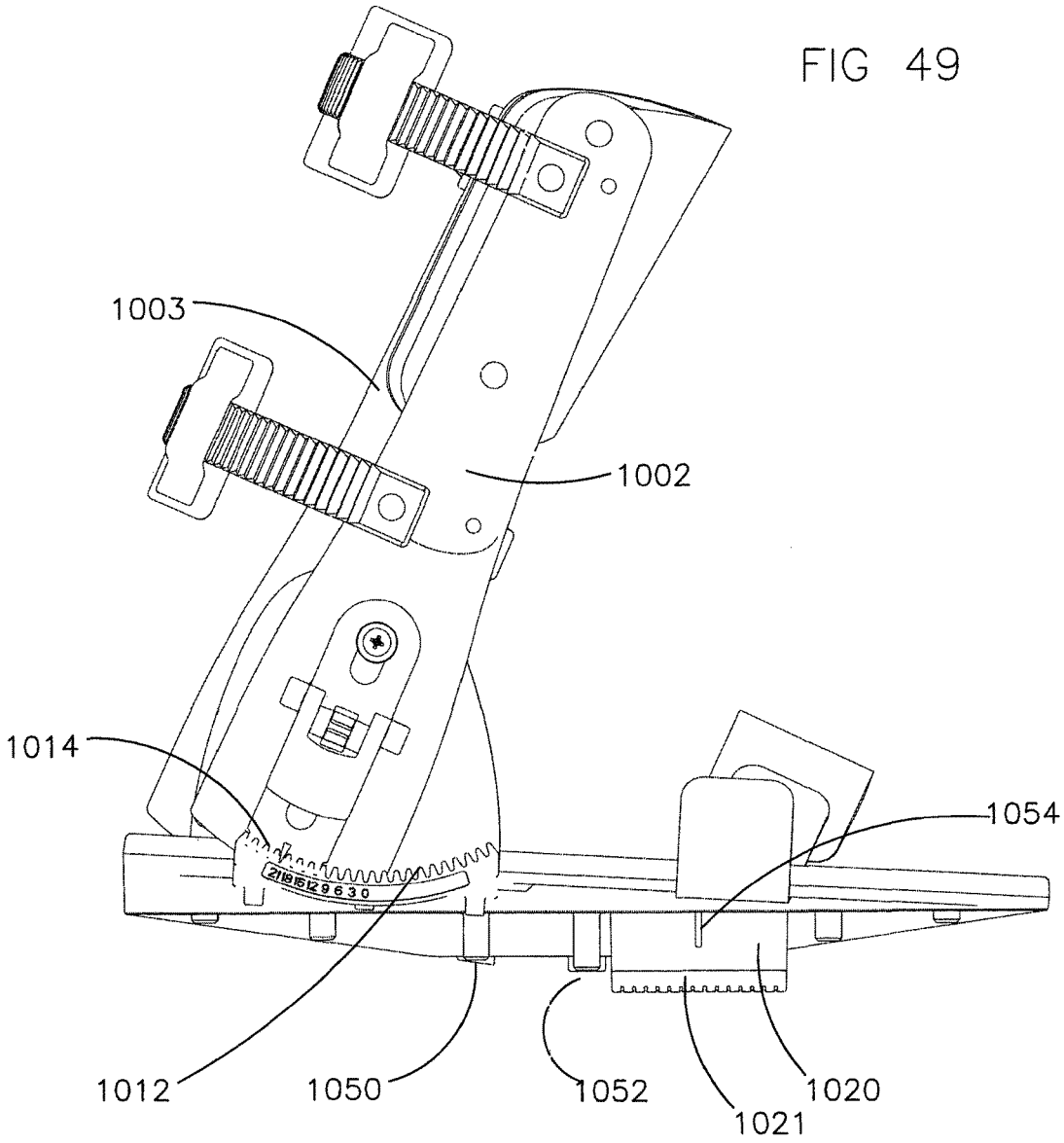

FIG. 49 is similar to FIG. 45, but with the balancing block located further forwards and the brace set at a more acute angle relative to the platform.

Figure 50:
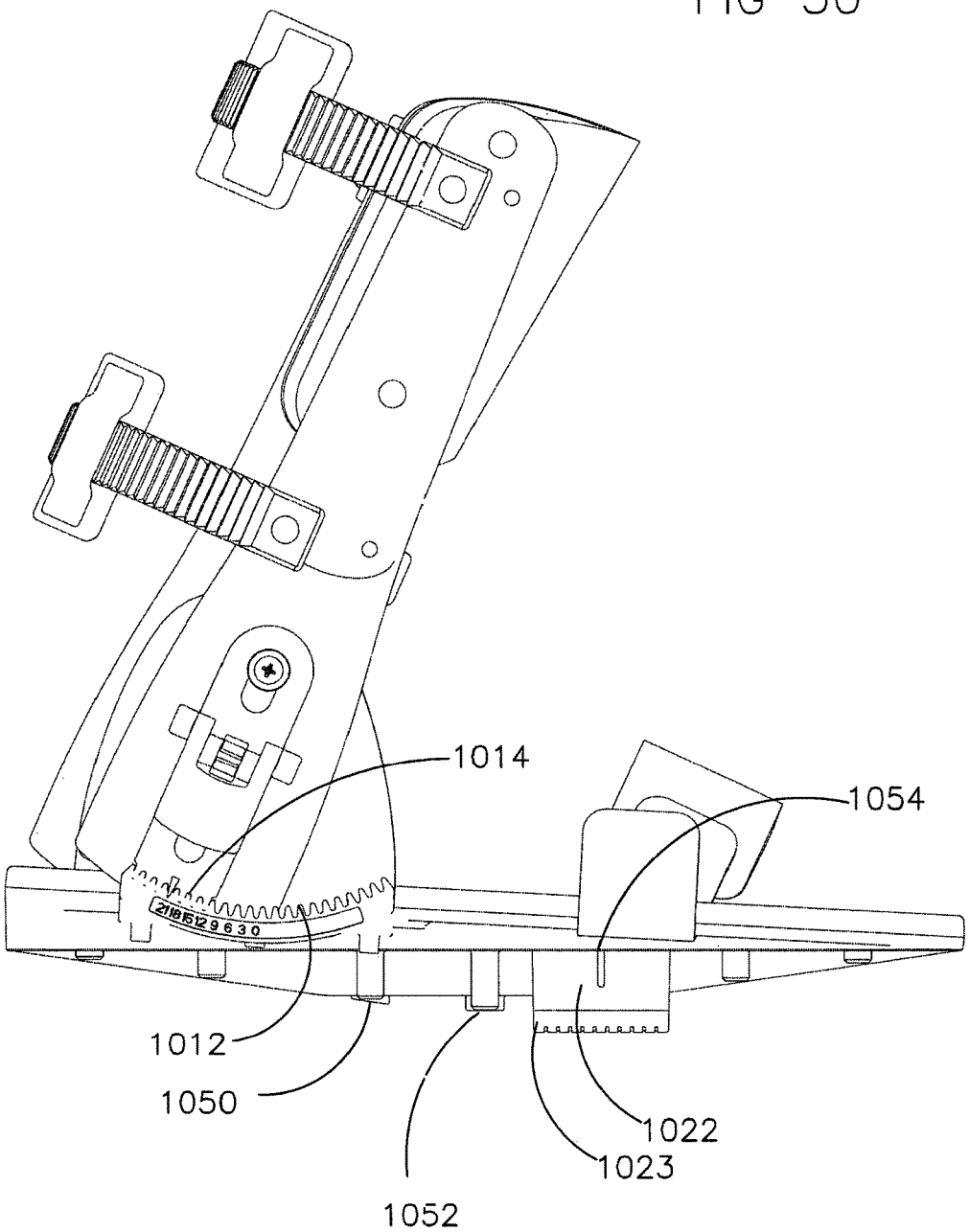

FIG. 50 is similar to FIG. 49, but with the balancing block having been replaced by a smaller balancing block.

Figure 51:
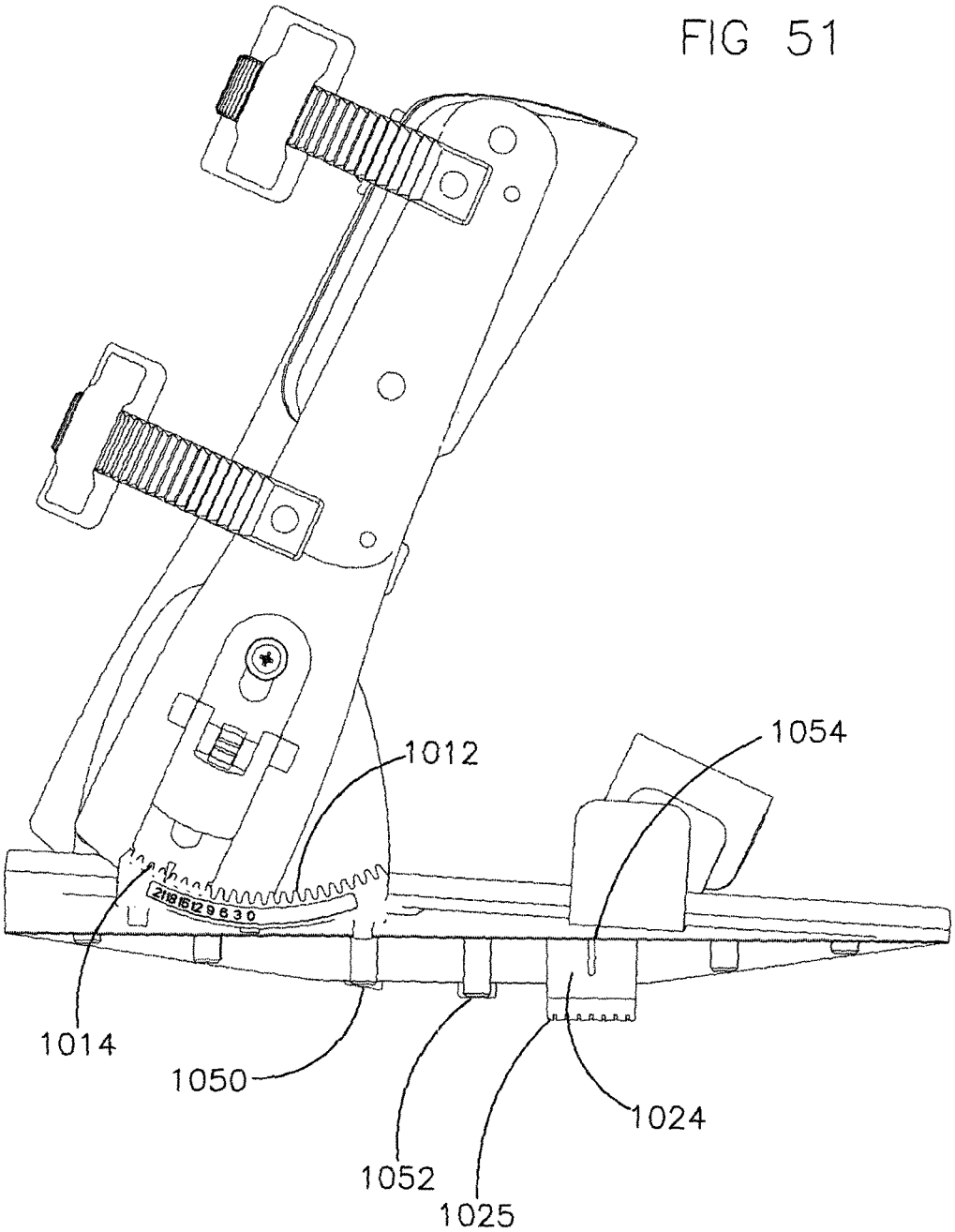

FIG. 51 is similar to FIG. 50, but with the balancing block having been replaced by a still smaller balancing block.

Figure 52:
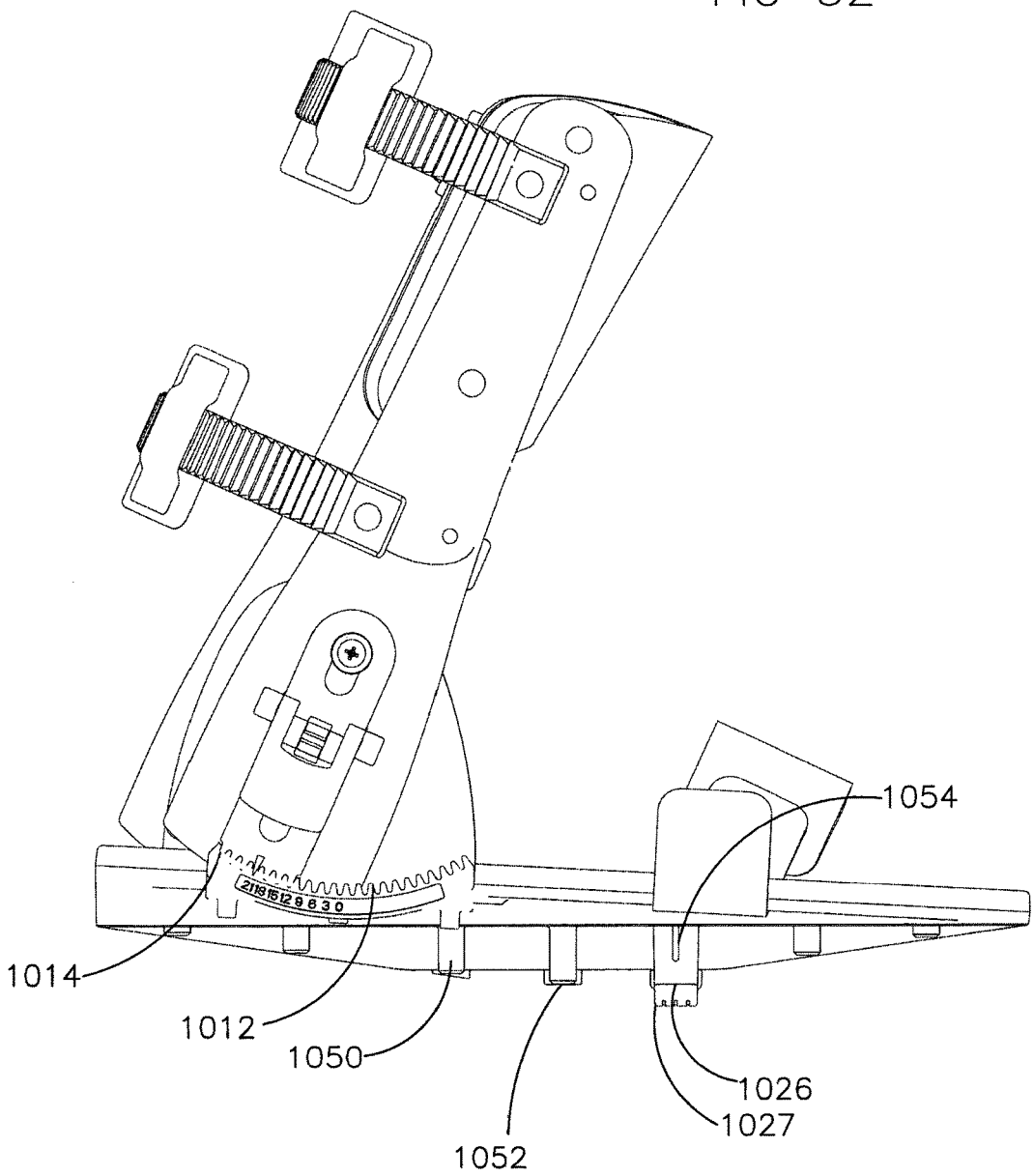

FIG. 52 is similar to FIG. 51, but with the balancing block having been replaced by a yet smaller balancing block.

EXAMPLE 1

An item of footwear of the present invention that is in the form of a "barefoot trainer" 1 (i.e. without a user needing to wear shoes) is shown in FIG. 1.

It can be seen that an upper part of the barefoot trainer 1 is in the form of a brace 100, which acts as an ankle restrictor, as discussed later. The brace 100 of the trainer 1 is shown in a position where it is about to be slotted into three apertures (slots 104) in a base 200, with the three downwardly pointing arrows 101 illustrating how it is slotted into position.

The brace 100 is shaped to fit around the back of the leg of a wearer of the training aid 1. It braces the ankle in position. It may optionally include padding, lining or cushioning for the comfort of a user, although in this embodiment this is not shown for simplicity.

In this embodiment the brace 100 includes a rigid curved element 107. This has a posterior part 105 that fits closely against the back of the heel of a wearer and extends above the heel. In this figure it extends to just below the calf region. (However in other embodiments, as discussed later, a strut that is longer may be provided and may, for example, reach the calf region.)

In this embodiment the curved element 107 includes a lower part 106 that extends below the heel of the user so as to lie underneath a portion of the user's foot, including the heel and midsole portion. The curved element 107 is formed of relatively rigid material so that the ankle can be held securely in place without substantial movement hereof when the brace 100 is in use. The curved element may, for example, be formed of a metal, a plastics material or a composite material (e.g. carbon fibre). The material should be resilient. (A small amount of flex may be permitted, as long as the ankle is kept substantially immobile.)

In order to achieve fastening, the brace 100 includes an upper fastener 102 that can be fastened around the shin region of the lower leg of a user and a lower fastener 103 that can be fastened over a part of lower part of the foot (typically over a mid-foot portion of the foot between the heel and the toes).

In this embodiment each fastener 102, 103 comprises two connecting parts that are connected together by a hook an eye arrangement, such as by Velcro™ material. The connection is not show in the figure, because it is on the other side of the item of footwear (the right side), relative to the side that is shown in the figure (the left side). As an alternative to a hook and eye system, any other releasable attachment means can of course be used, such as a buckle, catch, clip, tie or other fastener.

The fasteners 102, 103 are desirably adjustable so that a tight fit around the foot and leg can be achieved.

Thus it is desired that tension can be adjusted around the foot and leg. Preferably tension can be adjusted at a plurality of locations (corresponding in this embodiment to the positions of the fasteners 102, 103.) This can assist in ensuring that the brace 100 is sufficiently tightly secured so as to substantially limit ankle movement. Adjustable fastening is also useful in being able to accommodate a range of different foot sizes/or shapes. Adjustable fastening can be achieved by providing sufficiently long lengths of Velcro™ or other hook and eye fastening material. (In other embodiments it can be done, by providing appropriately spaced holes in a strap that a buckle can engage, by providing a clip, clamp, catch or tie that can be used for adjustment of tension, etc.)

Although in this figure two adjustable fasteners 102, 103 are provided, it is possible to provide just one or to provide three or more. If a single fastener is used it should be sufficiently large/wide to ensure that movement of the ankle is restricted. If two or more fasteners 102, 103 are used, then the size can be reduced, because the number and positioning of fasteners can itself facilitate restriction of movement.

In the embodiment illustrated in FIG. 1 it can be seen that the trainer 1 is a relatively open item of footwear, whereby parts of the feet including the toes and part of the heel can be seen. This can be useful if the user (e.g. via a mirror) wishes to view parts of a foot to see which are moving/flexed. This can also be useful if a coach is instructing the wearer of the item of footwear. It will therefore be appreciated that in some respects the item of footwear 1 resembles an open-toed sandal. This is useful for user compliance, because a user will normally be easily able to put it on/take it off, being familiar with sandals.

As discussed earlier, three downwardly protruding elements 104 are shown on the underside 106 of the curved element 107. In this embodiment the elements 104 fit tightly into the apertures 201 and this keeps the upper 100 parts and lower parts 200 together during use via a tight fit. This is sometimes known as a press fit, a push fit, a friction fit or an interference fit. (In FIG. 1 the elements 104 and apertures 201 are simply shown schematically and therefore the tight fit is not seen.) The downwardly protruding elements 104 can be forced into the apertures 201 by the weight of a user, as shown in the figure.

It can be seen from the figure that the brace 100 can be secured to the lower part in several different positions. The figure illustrates a generally central position in which the three downwardly protruding elements 104 fit into three central slots 201. However it is also possible for the brace 100 to be fitted to a more forward or more rearward location of the lower part 200. This is because there are appropriately positioned slots along most of the length of the lower part. This is useful in taking into account different foot sizes. It is also useful in taking into account different positions that it may be desired to adopt.

Thus, for example, in FIG. 1 it can be seen that the balancing block 300 is located directly underneath the mid-point of the foot. In respect of some sports or activities (or in the opinions of some coaches) this may be considered the sweet spot, where it is desired to focus balance, as discussed earlier.

However if the brace 100 is moved one slot 201 further forward, relative to the lower part 200, the balancing block 300 will then be located slightly closer the heel. In the embodiment shown it would then lie underneath a point that is about a third of the way along the length of the foot, when measured from the back of the heel (the preferred "sweet spot" for focussing balance of the present invention, as discussed earlier.)

If the brace 100 is moved one slot further backwards relative to the lower part 200, the balancing block 300 will be located slightly closer to the toes in the case of the foot illustrated. This is less desirable than position shown in FIG. 1. However, if, for example, a larger foot than the foot shown is used with the trainer 1 then moving the brace 100 one slot forward relative to what is shown in FIG. 1 could be useful (e.g. in positioning the centre point of the foot over the balancing block 300). Different foot sizes corresponding to different users can therefore be accommodated.

Of course once the members 104 have engaged the slots 201 it will be necessary to disengage them if it is desired to move the brace 100 to a different position along the platform 203

When it is desired to disengage the brace 100 from the lower part 200 the user can hold the lower part 200 stationary (or press down on it) whilst lifting the foot upwards. This effectively pulls the brace 203 and lower part 200 apart. This can be conveniently done whilst the user is sitting down.

Alternatively, the user may grip or press down on the back of the lower part 200 whilst attempting to lift the heel upwards, but keeping his/her toes in a fixed position. This pivoting motion that can gradually release the members 104 from the slots 201, with the member 104 that is closest to the back of the heel of the user being released first.

Other alternatives for disengagement include having a helper assistant pull the brace 100 and the lower part 200 apart (again preferably while the user is seated), by using a tool, (e.g. a lever or screwdriver), to prise them apart, etc. If a tool is provided this can advantageously be included in any of the kits of the present invention described earlier.

Turning now to the lower parts of the trainer 1, it can be seen that the platform 203 is strengthened by a strengthening element 204. The strengthening element 204 provides increased rigidity. It extends across most of the length of the trainer apart from the region where the balancing block 300 is located.

The balancing block 300 is located underneath the platform 203, as discussed earlier. It is releasably secured to a part of the base 202 by a screw or other releasable securing means (not shown). Thus it can be released and replaced with another balancing block 300 of a different size and/or shape if desired, to make balancing more difficult or easier.

In FIG. 1 the balancing block shown 300 has a relatively large ground-contacting surface area 301.

In order to increase the difficulty in balancing this balancing block 300 can be replaced with another one having a smaller ground-contacting surface area 301. Thus, for example, if (as here) the block 300 is generally cylindrical, other cylindrical blocks 300 with ground contacting surfaces of gradually reduced diameter can be provided.

In the embodiment shown in FIG. 1 the main body of the balancing block 302 is formed of a relatively hard material (e.g. a hard plastics material) and the lowermost part 303 is formed of a material that is softer (e.g. a natural or synthetic rubber material), so as to reduce the risk of damage to a floor. The lowermost part 303 preferably comprises material that is scratch and/or slip resistant. It may have sloped or curved lower edges to aid in balancing/pivoting. This can help in protecting a floor and in balancing.

A range of suitable balancing blocks are discussed in EP 2485617 in connection with the SKiA Sweetspot Trainer. These/similar balancing blocks can be used in the present invention. The exact shape is not crucial as long as the balancing block 302 can be used in training by a user to improve one or more balancing skills.

Whichever balancing block 302 is used, the brace 100 in this example serves to substantially restrict the flexion and/or extension of a wearer of the training aid during balancing. It also acts to keep the shin of the wearer at a substantially fixed position relative to the platform 203 on which the brace 100 is mounted. As discussed in later examples, the brace 100 can be set at an angle, if desired, so that the shin is also forced to be at a given angle relative to the platform 203.

EXAMPLE 2

Example 2 is similar to Example 1, apart from the fact that at least one of the downwardly projecting members 104 is provided with a release means 403. This is illustrated in FIG. 2.

FIG. 2 provides a transverse cross section showing how a downwardly projecting element 104 with concave outer sides 401 fits into a slot 201. The slot 201 is located in an upper layer 202 of the platform 203. (FIG. 1 shows where the upper layer 202 is located.)

It can be seen that the downwardly projecting element 104 is held in place in the slot 201 by convex inner side walls 402 of the base 201 fitting close to/against the concave outer sides 401 of the downwardly projecting element 104. The convex inner side walls 402 are complementary in shape to the concave outer sides of the downwardly projecting element 104.

When it is desired to release the downwardly projecting element 104 from the slot 201, a wearer or a helper can press down on side levers 403. This forces the convex inner walls 402 away from the concave outer sides 401 of the downwardly projecting element 104. This allows the downwardly projecting element 104 to be lifted easily out of the slot 201. Typically this is done by the user simply lifting his/her foot upwards, given that (as illustrated schematically in FIG. 1) the downwardly projecting element 104 is a component of the brace 100 and the user will have the brace 100 releasably secured to his/her foot (e.g. by straps 102 and 103, as also illustrated in FIG. 1).

The foregoing description explains how the downwardly projecting element 104 can be removed from the slot 201. Insertion of the downwardly projecting element 104 into the slot 201 can be achieved by the reverse action. Thus the levers 403 are pressed down so as to move the concave inner walls 402 slightly outwards and thereby to allow the downwardly projecting element 104 to be pushed down into position by the weight of a user wearing the brace 100.

The levers 403 can be released once the element 104 has been pressed down far enough into the slot 201 so that the base of the downwardly projecting element 401 (i.e. the widest part) has moved past the narrowest part of the slot 201 (corresponding the "bulges" of the convex inner walls 402). It will then fit into position and will be releasably secured until it is desired to remove it.

EXAMPLE 3

Figure 3:
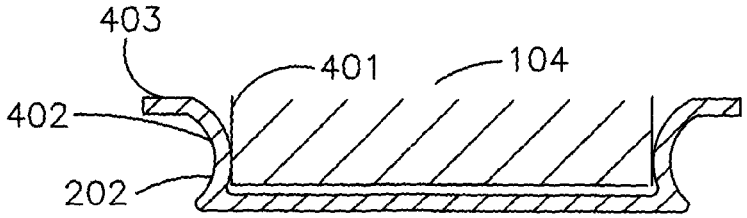
FIG. 3 shows a cross-section illustrating how a downwardly protruding member with straight sides can be received in a slot with concave inner walls.

This example is illustrated by FIG. 3. FIG. 3 is similar to FIG. 2, apart from the side walls 401 of the downwardly projecting element 104 being straight rather than convex.

In this embodiment the fit of the of the downwardly projecting element 104 into the slot 201 is an interference fit, because the convex inner walls 402 of the press against the straight sided walls 401 of the downwardly projecting element 104 to hold it in place. This is facilitated by the resilient deformability of the material from which the upper layer 202 of the platform 203 is formed. The downwardly projecting element 104 can be removed from the slot 201 when desired. In order to achieve release a wearer can press down on levers 403 and can lift his/her foot upwards with the brace 100 attached thereto.

In both of the situations illustrated in FIGS. 2 and 3 and in the respective examples (Examples 2 and 3) release means are provided. It is provided here via levers 403, but any other facilitators of release can be used. (The release means will normally cause at least one component to move or change shape so that disengagement of engaging parts can occur.)

It is not necessary to provide a plurality of release means. A single release means may be provided. Thus, for example, one downwardly protruding element 104 may be releasably secured in position so that it can be released by release means and the others may simply fits into slots 201 without needing/being provided with any particular release means. Furthermore, in some embodiments no particular release means need be provided.

EXAMPLE 4

This example is illustrated by FIGS. 4 and 5, which, as explained earlier, provide side views of a further training aid 500 of the present invention. FIG. 4 shows this training aid 500 without a toe strap. FIG. 5 shows the training aid with a toe strap 501.

The brace 507 includes a rigid strut 502. A "heel receiving part" 503 (the concave lower part) can be seen at the base of the strut 502. It has a slot 513 for receiving a strap (strap not shown). Towards the top of the strut 502 a "lower leg receiving part" 504 is located. This is also concave (the concave upper part) and is shaped here to fit around a rear part of the foot above the heel and below the calf. It can however be slid up or down the strut 502 to any desired position. It includes a slot 512 for receiving a strap (strap not shown). Once it has been slid to a desired position it can be retained there by friction. In an alternative embodiment it may be releasably secured to the strut by a releasable retaining means (not shown), such as a releasable clamp or catch.

It will be appreciated that if the strut 502 is long enough, a similar arrangement could be used for a brace 507 that reaches the calf region. Here the concave upper part 504 may be large enough to engage the rear of the calf or a part thereof The angle of the strut 502 relative to the platform 506 may also be set slightly differently to allow for the fact that a calf bulges.

The brace 507 acts to keep the shin of a wearer at a substantially fixed position (here an angled position) relative to the platform 506 on which the brace 507 is mounted. The brace 507 also acts as a restrictor for substantially restricting flexion and/or extension of an ankle of a wearer.

In the embodiment shown there is releasable securing element (here a catch 508) that releasably secures the brace 507 to the platform 506. Such a catch 508 is provided on each side of the platform 506. (Only one can be seen in the side view shown.) When the catches 508 are released the brace 507 can moved to another desired position along the platform 506 (e.g. for a user with a different foot size). When it is at the desired position it can then again be releasably secured relative to the platform 506 by engaging the catches 508.

If desired, the brace 507 may be mounted on a rail (not shown) or may be otherwise slidably mounted so that it can be slid along the platform 506 when the catches are released. Alternatively it may simply be lifted off the platform 506 after being released and then put down again at a new desired position along the platform 506 before being releasably secured.

EXAMPLE 5

This example is in respect of a crude working model that has some similarities with the training aid illustrated schematically in FIGS. 4 and 5.

This working model 600 is illustrated in FIGS. 6 and 7, being shown from different sides in these figures.

Here a rigid strut 601 is provided (e.g. a metal strut) that is secured to a concave receiving element 602 that is shaped to receive a calf of the wearer. This "calf receiving element" is formed of resilient plastics material. It has a slot 603 in each side that receives a strap 604. The strap 604 is shown fastened tightly so that concave receiving element 602 is secure around a user's calf.

It can also be seen from the figure that a metal heel block 606 is provided. This has rigid side walls and a rigid rear wall, with a slot being 607 provided in each side wall for receiving a strap 608. This strap 608 is fastened over the foot of a user and prevents the foot moving forwards. The rear wall of the heel block 606 prevents the foot moving backwards. (If necessary, padding 609 can be provided as shown. This can be useful if the foot is relatively small and/or, if, as here, the heel block 606 is uncomfortable in the absence of padding.)

The two fastening straps 604, 608 secure the foot and lower leg in position in the brace 612.

The heel block 606 is slightly wider at the bottom that at the top. This is because it has two inner horizontal channels that receive the sides of the platform 610 and thereby allow the block to be 606 slid along the platform 610, once securing screws 611 (which normally hold it in a desired position) have been released.

Thus, once the securing screws 611 are released, the brace 612 can be slid along the platform 610 until a desired position is reached. The screws 611 are then screwed into the sides of the platform 610 to releasably secure the heel block 606 in place at the new position along the platform 610. The new position may for example be one that is desirable for a different foot size, a different balancing action, different weight distribution, etc.

In this embodiment the screws 611 screw into the material of the platform 610. It is however possible for complementary bores for receiving screws to be provided in the platform walls so that the material of the platform is not affected by screwing into it. These bores may be spaced at a number of regular intervals along the side of the platform 610 so as to take into account a corresponding number of positions where the brace 612 can be moved to. They are preferably reinforced, e.g. with a metal or plastics surround.

A spacer 613 is provided that has a sloping rear surface 614. The spacer 613 is located between the heel block 606 and the strut 601 and is secured to both of these (e.g. by screws or by a strong adhesive). The angled rear wall 614 of the spacer 613 causes the strut 601 to be set at a desired angle. (A different spacer with a rear wall at a different angle can of course be used if it is desired to provide a different angle at which the strut is set relative to the platform 610.) This in turn forces the shin of a wearer of the training aid to adopt a corresponding angle. (The angle between the platform and the shin is illustrated on the figure.) By keeping the shin at a relatively fixed position and securing the foot and leg in position by straps as illustrated (or other retaining means) ankle torsion and/or flexion is restricted.

A balancing block 615 is also shown that is releasably secured to the underside of the platform 610.

EXAMPLE 6

This is illustrated by FIG. 8 9 and is an alternative arrangement to that described in Example 50. Here the brace 700 has a generally unitary structure rather than having a part that engages the heel and a different part that engages a higher part of the back of the leg.

It can be seen that the brace 700 has an upright back wall 701. This restricts movement of the calf of the wearer and the back of the heel of the wearer. Sloping side walls 702 are also provided. These are wider at the base than at the top. This helps provide rigidity, whilst also restricting foot movement.

As for Example 5, screws 711 are provided that can be released to allow the brace 700 to be slid along the platform 710 to a new position. The screws 711 can then be screwed into the sides of the platform 710 to releasably secure the brace 700 in a new position relative to the platform 710. (Again, as discussed earlier, complementary bores may be provided for receiving the screws, if desired.) It should be appreciated that the brace 700 shown here is a relatively crude one and is simply a working example of a brace having a unitary structure.

Upper 712 and lower 713 straps help secure the brace 700 in place relative to lower leg of a user. A brace that is shaped to fit more snugly against the contours of the lower leg art of the leg could of course be provided instead and could also still provide a unitary structure. It could, for example, be made by casting, moulding, by three dimensional printing, etc.

EXAMPLE 7

This embodiment is not illustrated by additional figures, but is the same as that illustrated in FIG. 6, apart from the brace being used to brace the user's foot whilst the foot is inside a shoe (not shown).

If required, the brace and/or platform shown in FIG. 6 could be made wider and/or longer to allow for the dimensions of a shoe, although this is not needed for the working model shown in FIG. 6, given that the brace and platform are already quite large.

The straps shown in FIG. 6 can of course also be made longer and/or positioned slightly differently, if this is needed to accommodate a shoe, although this is again not needed with the working model shown in FIG. 6. Thus in this example the brace will restrict undesired movement of a user's foot within the shoe. In particular, the brace will still act as a restrictor for substantially restricting flexion and/or extension of the ankle of a wearer within the shoe. As with the other examples, the user's shin is kept at a substantially fixed position relative to the foot and platform when the user is balancing or attempting to balance.

EXAMPLE 8

This embodiment is illustrated by FIG. 9. It is very similar to that shown in FIG. 8, but with the unitary brace structure 700 essentially turned through 180° and a large aperture provided through it in the form of an arch 714 that allows the front of a foot to be inserted through it. (This is not needed in Example 8.)

Here the shin region of the front of the leg is close to a front wall 717 of the brace 700, the front wall being located in front of the shin. During use, the shin presses against the front wall 717, either directly or through intermediate cushioning (here a foam insert 716), Straps 712, 713 are again provided through apertures in the brace 700. Thus the brace 700 is again strapped tightly against both a user's lower leg (via the top strap 712) and foot (via the lower strap 713).

The embodiment illustrated here is more preferred than that described in Example 6. Although both embodiments were found to work as training aids, the user found it easier to use the training aid when the rigid part of the brace 700 was in front of the lower leg rather than behind it. Thus the "front" brace was found be preferred to the "rear" brace.

FIG. 10 is also useful for comparison. It shows the embodiments described in Example 7 and the present example (and shown in FIGS. 8 and 9 respectively) side by side. In FIG. 10 the Example 7 embodiment (having a rear brace 700, as shown in FIG. 8) is worn on the right foot and the Example 8 embodiment (having a front brace 700. as shown in FIG. 9) is worn on the left foot. (FIG. 11 is similar to FIG. 10, but is a rear view.)

It was again confirmed by the user that the front brace 700 was easier to use and gave better performance than the rear brace, although both functioned sufficiently well to provide confidence in proceeding further with the invention. It should be recalled that this example simply illustrates a crude working prototype. Thus, a more comfortable brace that is shaped to fit more snugly against the contours of the one or more parts of the lower leg could be provided instead.

EXAMPLE 9

This is the same as the embodiments described in Example 8, apart from the brace being used to brace the user's foot whilst the foot is still inside a shoe (not shown). Here the front of the shoe with the user's foot inside it would protrude through the arch 714. (Of course dimensions of components can be changed if this is necessary to accommodate a shoe.)

As with the other examples, the shin of the user would also be kept at a substantially fixed position relative to the foot and platform when the user is balancing or attempting to balance.

The brace would also still act as a restrictor for substantially restricting flexion and/or extension of the ankle of a wearer within the shoe.

EXAMPLE 10

This example is illustrated by FIGS. 12 to 17, which show a version of the training aid 820 in which the angle of a brace 800 relative to the platform 811 can be adjusted.

The location of a balancing block 814 underneath the platform 811 can also be adjusted, so that it can be positioned at several spaced apart locations. (This can be useful for various sports or activities, as discussed later.)

It can be seen that, unlike earlier examples, the training aid 820 comprises two vertical plates 801, 802 that are connected together by a releasable nut and bolt 803. The plates 801, 802 are roughly triangular in shape although this is not essential. The shape can vary significantly, as long as the plates can perform their function.

The upper plate 801 includes a plurality of spaced apertures 804. Here the apertures are spaced along an arc (see e.g. FIG. 13). In contrast, the lower plate 802 has only a single aperture 804.

The upper plate 801 is shown abutting to a rigid shin guard 806. The lower plate 802 is above a rigid arch 807 into which a foot can be inserted. The arch 807 can be considered in some respects as a large foot strap that limits foot movement, although it does not tighten like a strap.

In the embodiment illustrated the brace 800 is secured by two straps 808, 809 around the lower leg. One strap 808 passes through an aperture between upper plate 801 and the shin guard 806. The other strap 809 passes over a tongue 810 that extends from the top of the arch 807 towards the shin guard 806.

Given that the arch 807 and shin guard 806 are each quite strong and resilient and that each of these is also connected to one of the rigid plates 801, 802, the front face of the shin guard 806 is effectively locked in position at a given angle relative to the vertical (or to the platform 811) when the plates 801, 802 are secured to one another by the nut and bolt 803. This therefore causes the shin to adopt a corresponding angle during balancing.

As discussed above, the foot is restricted by the arch 807 into which it is inserted and the platform on which it rests. The straps 808, 809 also help prevent any undesired movement.

Thus the brace 800 still acts as a restrictor for substantially restricting flexion and/or extension of the ankle during balancing.

In some sports/activities it is desirable for a user to practice balancing not only when in a relatively upright position, but also when a user is leaning, crouching, etc. In particular, it can be desirable for a user to practice leaning forwards or backwards at a given angle to the vertical. In the case of skiing, for example, it may be desired to lean forwards with a user's shin at one or more angles that correspond to angles at which it would be when in a ski boot set on a ski. Thus it can be useful to be able to adjust the angle between the front of the shin and the vertical.

In the embodiment illustrated by this example, this can be done by removing the nut and bolt 803 and then moving the upper plate 801 relative to the lower plate 802 until a desired aperture of the upper plate 801 is aligned horizontally with the single aperture of the lower plate 802. The bolt 803 can then be passed through both apertures and secured by tightening a nut.

If the plates 801, 802 are secured together using the lowermost aperture of the upper plate 801 then in this embodiment the angle at which the front face of shin pad 806 is set will be at or close to vertical. This also means that the shin will be forced to adopt a corresponding angle. Alternatively, if the plates 801, 802 are secured together using the uppermost aperture of the upper plate then the angle the front of the shin pad 806 adopts will be relatively far from the vertical and the shin a wearer of the brace 800 will be at a corresponding angle.

FIG. 13 illustrates a situation where the angle of the front of the shin pad is set at 22 degrees from the vertical (i.e. 68 degrees from the horizontal platform 811). FIG. 14 illustrates a situation where said angle is almost vertical (i.e. 2 degrees from the vertical and 88 degrees from the horizontal platform 811).

Angles between these values can be set by using different apertures 804 for locking plates 801 and 802 together. Thus a range of angles can be provided that encompass angles (sometimes known as "ski boot angles") that a skier may wish to practice adopting when balancing.

Other ranges of angles can of course be provided with other training aids and the above range is not limiting. In some situations if the angle from the vertical is increased (so that the shin of a wearer of the brace is angled further forwards) it may also be desired to move the balancing block 812 further forwards relative to the brace 800. This can be seen by comparing FIGS. 15 and 16, as discussed below.

In FIG. 15 it can be seen that the balancing block 812 is relatively central. The "set angle" for the shin pad 806 is 2 degrees from the vertical (88 degrees from the horizontal). In FIG. 16 the balancing block 812 is in a much more forward position. The "set angle" for the shin pad is 18 degrees from the vertical (62 degrees from the horizontal).

It should be appreciated that the balancing block 812 can be screwed into position at various spaced intervals along the platform 811. This is illustrated by FIG. 17. Here it can be seen that a pair of screws 805 is used to releasably secure a balancing block 812 (not visible in this figure) in position.

The pair of screws 805 have been screwed into the balancing block 812 through the front pair of a series of paired apertures 813. (The figure shows the location of the screws 805 for securing a balancing block 812 in the forwards position shown in FIG. 16. The screws would pass through a pair of apertures 813 further back for securing a balancing block 812 in the position shown in FIG. 15.)

Thus a balancing block 812 can be releasably secured at a plurality of different locations along the underside of the platform 811.

It should be appreciated that, as an alternative (or additional) option, it is possible to have the brace moveably mounted relative to the platform (e.g. as discussed in earlier examples). Thus, in some embodiments, the brace and balancing block can be moved relative to one another along the platform.

EXAMPLE 11

A different example of an item of footwear 900 that can be used as a balancing trainer of the present invention is shown in FIG. 18. It includes a platform 902 and a releasable foot securer 904 for releasably securing the front part of a user's foot to the platform during balancing.

The releasable foot securer 904 comprises two foot straps 906 and 908. Each strap 906, 908 is secured to the platform 902 by a platform fixing 924. The straps 906, 908 are releasably held together when the item of footwear is being worn by a hook and loop fastener system, e.g. Velcro™ (not shown).

A user can pull the straps 906, 908 apart when it is desired to release them, so as to also release the user's foot (also not shown). However, during use the hook and loop fastener system is strong enough to keep the straps 906, 908 together.

The item of footwear 900 also comprises a lower leg engager in the form of a brace 910. It can be seen that the brace 910 comprises a front part 912 and a rear part 914, with the brace 910 being in a closed position around the lower part of a user's leg (not shown) when secured by a releasable brace securer 916.

The releasable brace securer 916 comprises two brace straps 918 and 920. As for the foot straps 906, 908 described earlier, the brace straps 918, 920 are held together by a hook and loop fastener system and can be pulled apart by a user when it is desired to separate the straps 918, 920. Each strap 918, 920 is secured to the brace 910 by a side fixing 922

As can be seen from FIG. 19, when the brace strap 916 is open, the front part 918 can be pivoted forwards about pivot 922, whilst the rear part 920 stays in a fixed, upright position. This allows a user to place a foot within the brace 910 or to remove it from the brace 910.

In this example the brace 910 is formed of a rigid resilient material. It is connected to the platform via shoulders 926. If desired, the shoulders 926 and a lower part of the brace 910 may be integrally moulded together with the platform 902 so as to provide a unitary structure. Alternatively an adhesive or other fixing means (e.g. rivets, screws, or a click fit, snap fit or interference fit system) may be used fix the brace 910 to the platform 902.

The brace 910 substantially restricts lateral movement of the lower part of the leg. This is useful in reducing the risk of injury.

A balancing member 928 in the form of a balancing block can be seen located underneath the platform 902 in FIGS. 18 and 19. The balancing member 928 can also be seen in FIGS. 20 to 22. It has a non-slip ground contacting layer 930 formed for example from a synthetic rubber material. Ridges 938 are also provided that further reduce the risk of the balancing member 928 slipping. The remainder of the balancing member 928 is formed of a hard material 932 (e.g. a hard plastics material).

It can be seen from FIG. 20 that a balancing member 928 is fixed to a mounting plate 934 and the mounting plate 934 is releasably secured to the platform by screws 936. These screws 936 fit into corresponding screw-receiving apertures in the underside of the platform 902 (not shown). When the screws 936 are unscrewed, the mounting plate 934 and associated balancing member 928 can be removed. It can then be replaced with another mounting plate 934 and associated balancing member 928.

FIG. 21 shows another mounting plate 934 having been screwed into position via the same screws 936 as those used in FIG. 20. Here it can be seen that the balancing member 928 shown is of the same length as the one shown in FIG. 20, but is of a narrower width. This allows a user to focus balancing skills on a narrower ground contacting area.

Once the user has become accomplished at balancing on the balancing member illustrated in FIG. 21 the mounting plate 134 and the associated balancing member 928 can also be removed and can then be replaced with a still narrower balancing member 928 and associated mounting plate 134. The still narrower balancing member 928 is illustrated in FIG. 22. Again the same screws 136 can be used, because the mounting plate 934 has the same shape, with the screw holes being positioned at the same locations.

It should be noted that a user can revert from a relatively narrow to a relatively wide balancing member 928 if it turns out that the user is losing confidence or needs further practice on a relatively wide balancing member. Thus, for example a user practising on the balancing member 928 shown in FIG. 22 and finding it too difficult to balance on this, or losing confidence, may decide to replace it and the associated mounting plate 934 with the balancing member 928 and associated mounting plate 934 shown in FIG. 21 (or in FIG. 20) until the user has improved confidence and/or improved balancing skills.

The user may then revert again to the balancing member 928 and associated mounting plate 934 shown in FIG. 22.

FIGS. 18 to 22 illustrate a left item of footwear. In practice, a user will of course wear left and right hand items of footwear on his/her left and right feet respectively and will have a corresponding balancing member 928 and associated mounting plate 934 underneath the sole 902 of each foot.

The user can perform any desired balancing exercise, but it is preferred that the user attempts to balance whilst moving forwards or backwards and placing one foot in front of the other. If desired, the user may attempt to follow a marked line, track or other indicator.

Thus, for example, in the case of tightrope walking training, a user may attempt to follow a line the thickness of a tightrope on the floor or a floor covering. The balancing exercises may of course be varied depending on what a user is practising to do.

For example a user practising for moving along a gymnastic beam quickly may decide to step quickly with one foot placed in front of the other (e.g. whilst attempting to follow a marked line, track or other indicator).

In the case of training for tightrope walking, the user will normally step slowly and may even use an aid (e.g. a balancing pole held by the user as is often done whilst tightrope walking).

Whatever sport or activity the user is training for, the invention allows the user to focus balancing on an increasingly narrow area. The balancing members can easily be removed and replaced using a screw-driver. Alternatively, if a screw head is shaped for receiving an Allen key rather than a screwdriver, this can be used instead.

It is of course also possible not to use one or more screws and to use other releasable attachment means instead, e.g. one or more releasable clips, catches, etc., provided that the releasable attachment means allows the balancing member to be maintained in position during use, until it is desired to remove it.

EXAMPLE 12

This example is the same as Example 11, apart from the fact that no mounting plate is used and the screws 936 are screwed through the balancing member 928 itself, as illustrated in FIG. 23.

Here it can be seen that the screws 936 are countersunk a little so as not to protrude from the balancing member 928. This helps to prevent screw heads from interfering with balancing. It also helps prevent/reduce the risk of damage to a floor or other ground surface.

EXAMPLE 13

Here a brace 940 is provided (see FIG. 24) that is different from the one used for Examples 11 and 12.

It comprises an upper 942 formed of leather or of another strong fabric material. It again functions to restrict lateral movement of part of the lower leg. It also helps restrict ankle flexion and/or extension.

The upper 942 is fixed to the platform 902. This can be achieved by stitching, adhesive or any other suitable fixing means. The upper 942 may optionally be reinforced by a strut or another reinforcing member (not shown). This can help increase rigidity. For example a region at the back of the lower leg may be reinforced (e.g. with a strut or support). Any suitable resilient material can be used for reinforcement, e.g. a plastics material, a metal or metal alloy material, a composite material, wood, etc.

Here the upper 942 is shown as being open-toed and also as having an open heel portion. Thus it resembles the upper of certain sandals. This is not however essential and the upper 942 may enclose the heel and/or toes.

Laces 944 are shown that are about to be tied. However straps, catches or any other releasable securing means can of course be used as an alternative.

In this embodiment the upper 942 releasably secures both the user's foot and the user's leg in position relative to the platform. Thus, unlike FIGS. 14 and 15, there is no need for additional strapping over the foot.

A balancing member 928 is provided that is the same as the one shown in FIG. 19. Thus it has a non-slip ground contacting layer 930 comprising a plurality of ridges 938. The remainder of the balancing member 928 is formed of a relatively hard material 932. The balancing member 928 is attached to the base of the platform 902 by screws (not visible in this figure but corresponding to the screws 936 shown in FIG. 19). Thus the balancing member 928 can be removed by unscrewing it from the underside of the platform and then screwing in another balancing member 928 of a different width.

As discussed earlier, it is preferred in some embodiments that, as training progresses, narrower balancing members 928 are used. The length of the balancing members 928 is preferably the same.

EXAMPLE 14

This is as for any preceding example, apart from the fact that the item of footwear is large enough to be used by a user who is already wearing a shoe or another item of footwear. Thus a platform, brace, straps, etc., can be shaped accordingly so that a foot of a user wearing the item of footwear can be accommodated and the user can practice balancing in accordance with a method of the present invention.

EXAMPLE 15

This example illustrates an intended production model of an item of training footwear 1001 (also known as a trainer) of the present invention. It is illustrated by FIGS. 25 to 38 and by FIGS. 41 to 52.

The trainer 1001 is used to balance or attempt to balance on a ground-contacting surface of a balancing block (described later). It includes a platform 1000 on which a foot of a user stands whilst the user is balancing or attempting to balance. Thus this platform 1000 is sometimes also referred to herein as the "standing platform" 1000.

The trainer 1001 includes a brace 1011. The brace 1011 includes struts 1002, 1003, which are operably connected to side supports 1006, 1008 and can be pivoted relative to the side supports about a pivot 1004, along which there is an axis of pivoting.

Starting with FIGS. 25 to 27, these show alternative views of a trainer 1001 comprising a standing platform 1000 and a single balancing block 1020 releasably secured underneath the platform 1000.

The trainer 1001 shown here can be used for training a user in adopting a correct position during skiing, skating, surfing, and other sports and activities that benefit from accurate fore-aft balance.

The standing platform 1000 in this embodiment has an upper surface that is at a small angle to the horizontal (here an angle that is at, or about 3 degrees to the horizontal), when the user is correctly balanced on a flat, generally horizontal ground surface (e.g. a level floor). Thus, if the balancing block 1020 has a generally flat underside 1021, when this is flat against a generally horizontal ground surface ground surface, the upper surface of the platform 1000 will be at said small angle to the horizontal.

A front strap 1030 holds the front of a user's foot in place. It can be tightened or loosened by an adjustable fastener 1031 (e.g. via a releasable hook and eye system, such as a Velcro™ system).

The side supports 1006, 1008 are fitted towards the rear of the standing platform 1000. They are positioned to lie adjacent a user's ankle. Indeed it is preferred that the aforesaid axis of pivoting through pivot 1004 passes through or proximal to the effective centre of flexion and extension of the ankle joint.

Both a left foot and a right foot version of the trainer 1001 will of course normally provided. The invention therefore includes a pair of trainers.

One of the side supports (in these figures the side support 1008) is located slightly more forwards along the platform than the other one (than side support 1006). This takes account of the normal structure and anatomical function of the ankle. The more forwardly located side support 1008 can be referred to here as the medial ankle support and the more rearwardly located support 1006 can be referred to as the lateral ankle support (to correspond with the ankle regions that these supports are closest to).

The side supports 1006, 1008 are lined with padding 1007, 1009 to provide comfort and support.

The rigid struts 1002 and 1003 are operably linked to the side supports 1006, 1008 at pivot point 1004. As discussed earlier a screw is present at each pivot point and the screws can be loosened to allow pivoting or tightened when no further pivoting is desired (i.e. when a desired angle of the brace 1011 relative to the platform 1011 has been set).

An anterior shin pad 1040 connects the two struts 1002, 1003. The shin pad 1040 is also lined with padding 1041 to ensure comfort and support. At the rear, two releasable ratchet straps 1032, 1034 with support pads 1036, 1038 connect the two struts 1002, 1003, and can be tightened to ensure a snug/tight fit, or can be loosened when the user wants to remove the trainer 1001.

The side supports 1006, 1006 include arcuately arranged teeth 1012 marked in degrees from the vertical. They can be engaged with complementary teeth 1014 by operating a lever 1010 located on each strut 1002, 1003 below the pivot point. The struts 1002, 1003 are then locked in a desired position (i.e. at a desired angle relative to the platform 1000).

When the lever 1010 is released then the teeth 1012, 1014 become disengaged from and pivoting of the struts 1002, 1003 about the pivot 1004 can occur until another desired angle of the struts 1002, 1003 relative to the platform has been reached. The lever 1010 can then be operated again to lock the struts 1002, 1003 in position until it is desired to release them.

In FIGS. 25 to 27 the rigid struts 1002 and 1003 have been set at a right angle to the standing platform 1000. Here an angle of 0 degrees is indicated (which indicates a perpendicular orientation relative to the platform 1000.).

The underside of the trainer has three alternative positions at which the balancing block 1020 may be located during use. There is a rearwards position 1050, a central position 1052 (obscured in certain views, where the block is already fitted in this position) and a forwards position 1054. There are also four positions for fitting balancing blocks during storage, i.e. positions 1060, 1062, 1064 and 1066. It can also be seen that there is central ridge that has a front part 1072 and a rear part 1070 (sometimes referred to herein as the front ridge 1072 and rear ridge 1070 respectively, although they are part of the same ridge). This adds to strength and rigidity.

FIG. 28 is similar to FIG. 27, but the balancing bock 1008 of FIG. 27 has been replaced in FIG. 28 with one 1028 that is of the same width, but is not as long. The brace 1002 has been set here at a smaller (more acute) angle relative to the standing platform 1000 than in FIG. 27. Thus it is no longer perpendicular to the platform 1000.

FIG. 29 is similar to FIG. 27, but the balancing block 1020 is in the most forwards fitting position 1054. FIG. 29 also illustrates the maximum extent the rear of the platform 1000 can tip downwards with the block 1020 in this position until the rear strengthening ridge 1070 comes into contact with a level floor surface. When such contact occurs this acts as a stop that helps prevent accidents/reduce the risk of the rear of the platform 1000 user tipping backwards to an undesired extent. This can therefore increase stability/confidence of a user and reduce the risk of falls.

FIG. 30 is similar to FIG. 29, but here the balancing block 1020 has been fitted in the most rearwards fitting position 1050. This figure also illustrates the maximum degree that the front of the platform 1000 can tip downwards with the block 1020 in this position 1050 before the front strengthening ridge 1072 comes into contact with a floor surface. When such contact is achieved this again acts as a stop. Thus it helps prevent/reduce the risk of the front of the platform 1000 tipping downwards to an undesired extent.

FIG. 31 shows the standing platform 1000 fitted with a stack of 4 balancing blocks 1080, 1082, 1084, 1086 releasably secured underneath it. The balancing blocks 1080, 1082, 1084, 1086 are each longer than they are wide. In this figure the teeth 1012, and 1014 have been disengaged from one another by use of lever 1010 and the rigid struts 1002, 1003 have been pivoted rearwards on pivot 1004 to an angle of approximately 45 degrees.

FIG. 32 shows the standing platform 1000 fitted with a stack of 2 balancing blocks 1080, 1082 releasably secured underneath it that are both longer than they are wide. In this figure the teeth 1012, and 1014 have been disengaged from one another by use of lever 1010. This allows the rigid struts 1002, 1003 to freely pivot, to allow free movement of the ankle (for example to allow walking). In this figure they are pivoted forwards to an angle of approximately 45 degrees.

FIG. 33 shows the underside of standing platform 1000, with balancing block 1080 having a soft rubber-patterned underside 1081 fitted in position, Because this is much longer than the balancing block shown in FIGS. 25 and 26 it is fitted over all three of the positions referred to earlier as the rearwards, central and forwards positions 1050, 1052 and 1054. Balancing block 1080 is therefore substantially longer than it is wide. The underside of the balancing block 1080 has 4 fitting holes 1090, 1092, 1094, 1096 to receive further blocks. Thus a stack of balancing blocks can be formed and secured in position.

FIG. 34 is similar to FIG. 33, but with another balancing block 1082 attached to the underside 1081 of block 1080 by using fitting holes 1090, 1092, 1094, 1096. The block 1082 has a soft rubber-patterned underside 1083, which is narrower than the underside 1081 of block 1080. The underside of the additional block 1082 has 4 further fitting holes 1091, 1093, 1095, 1097.

FIG. 35 is similar to FIG. 34, but with a further balancing block 1084 attached to the underside 1083 of block 1082 using fitting holes 1091, 1093, 1095, 1097. The further block 1084 has a soft rubber-patterned underside 1085, which is narrower than the underside 1083 of block 1082>

FIG. 36 is similar to FIG. 35, with a still further balancing block 1086 attached to the underside 1085 of block 1084. The block 1086 has a soft rubber-patterned underside 1087, which is narrower than the underside 1085 of block 1084

FIG. 37, this shows side supports 1006, 1008 attached to the rear of the standing plate 1000, but with the remainder of the brace removed. A bore 1005 that receives a screw and through which an axis of pivoting passes (when the device is in use) is also shown.

FIG. 38 shows a view of the underside of the standing platform 1000. The central and front fitting points 1052 and 1054 for balancing blocks are shown (with the rear fitting point being obscured by a balancing block in position). The four storage points 1060, 1062, 1064 and 1066 are also shown, as are ratchet clips 1033, 1035 for releasable ratchet straps 1032, 1034.

Various embodiments within the scope of Example 15 will now be described with reference to the associated figures:

EMBODIMENT 1

FIGS. 41 to 44 show balancing blocks attached to the rear fitting position 1050 (i.e. behind central and front fitting positions 1052 and 1054). Rigid struts 1002, 1003 shown in these figures are fixed in a vertical position relative to the standing plate 1000, using interlocking teeth 1012, 1014 that are releasably locked in position.

FIG. 41 shows a balancing block 1020 fitted to the rear fitting position 1050.

FIG. 42 shows a smaller balancing block 1022 fitted to the rear fitting position 1050.

FIG. 43 shows an even smaller balancing block 1024 fitted to the rear fitting position 1050.

FIG. 44 shows a still smaller balancing block 1026 fitted to rear fitting position 1050.

The undersides 1012, 1023, 1025 and 1027 of balancing blocks 1020, 1022, 1024 and 1026 respectively are rubberised in order to reduce the risk of slipping and/or damaging a floor.

As a result of the positioning of the rigid struts 1002, 1003 a user using a device as shown in FIGS. 41 to 44 will be required to stand in a relatively upright posture. The centre of the balancing blocks in the rear fitting position corresponds closely to 'anatomical centre' (that is, the centre of fore-aft balance for an individual standing in a relatively upright posture), regardless of foot size.

Therefore, when used in this embodiment, this combination of settings allows users to experience an accurate simulation of being centrally balanced when standing. This is relevant for activities such as golf relaxation training, singing, voice training, and rehabilitation from injury.

EMBODIMENT 2

FIGS. 45 to 49 show balancing blocks attached to the central fitting position 1052, between rear and front fitting positions 1050 and 1054. The rigid struts 1002 and 1003 in these figures is fixed at an angle of approximately 12 degrees from vertical, using the interlocking teeth 1012, 1014.

FIG. 45 shows a balancing block 1020 fitted to central fitting position 1052.

FIG. 46 shows a smaller balancing block 1022 fitted to central fitting position 1052.

FIG. 47 shows an even smaller balancing block 1024 fitted to central fitting position 1052.

FIG. 48 shows an even smaller balancing block 1026 fitted to central fitting position 1052

The location of the central fitting position 1052 is designed to ensure that the balancing block lies directly underneath the centre of the foot of a user, when the brace is set at an angle of approximately 12 degrees from vertical, regardless of foot size. This combination of settings allows users to experience an accurate simulation of being centrally balanced on skis or skates. It also allows users to practice the dynamically-centred fore-aft balance skills required for sports such as skiing, ice-skating, roller-skating, in-line skating and surfing.

EMBODIMENT 3

FIGS. 49 to 52 show balancing blocks attached to the front fitting position 1054, i.e. forward of the rear and central fitting positions 1050 and 1052.

The rigid struts 1002, 1003 in these figures are fixed in a flexed position relative to the stank plate, at about 21 degrees from vertical, using the interlocking teeth 1012, 1014.

FIG. 49 shows balancing block 1020 fitted to the front fitting position 1054.

FIG. 50 shows a smaller balancing block 1022 fitted to the front fitting position 1054.

FIG. 51 shows an even smaller balancing block 1024 fitted to the front fitting position 1054.

FIG. 52 shows a still smaller balancing block 1026 fitted to the front fitting position 1054.

The location of the central fitting position 1054 is designed to ensure that the balancing block lies under the ball of the foot of a user, when the brace is set at an angle of approximately 21 degrees from vertical, regardless of foot size. This combination of settings allows users to experience an accurate simulation of being balanced on the ball of the foot and to practice the dynamic fore-aft balance skills required for sports such as horse riding and MTB cycling.

EXAMPLE 16

This example is illustrated by FIGS. 39 and 40. It concerns an alternative trainer 1100 to the trainers discussed in Example 15. In Example 16 the trainer has a brace 1101 that allows some free flexion and extension of the ankle for walking movements, while still providing lateral stability for the ankle joint. The brace 1101 does not include any struts. It can be attached to the standing platform 1000 that is shown on FIG. 39. (The platform 1000 shown in FIG. 39 corresponds to the platform for the embodiments discussed in Example 15, but with the brace and side supports removed. Thus the platform 1000 can be used for various examples and embodiments.)

The front foot strap 1030 and the fastener 1031 shown in FIG. 40 are the same as those shown in FIG. 39. However balancing blocks 1080, 1082, 1084, 1086 have been fitted to the underside of the standing platform 1000 and a brace 1101 has been attached to the top of the platform 1000 using releasable fasteners 1102. The brace 1101 is fitted around the foot by using a hook and eye system (e.g. a Velcro™ system) provided on straps 1104 and 1106.

GLOSSARY

Some terms that are used herein are discussed in further detail below:

"Brace"

This term is used to describe a device for fitting around or against at least a part of a lower foot and/or leg that is not a shoe. It holds at least part of a wearer's foot and/or leg in a desired position so that movement of said at least part is substantially restricted. The brace is not part of a separate shoe (or boot).

It is therefore different, for example, from a rigid ski boot where the boot itself holds a user's lower leg in a desired position and there is no separate brace.

In the context of the present invention the brace functions to hold at least part of user's foot or leg in a desired position for balancing or attempting to balance on a balancing block (or a stack of balancing blocks). This can be while the user is walking or otherwise traversing over ground (e.g. when training in tightrope walking) or while the user stays in a given location whilst balancing or attempting to balance The brace may include one or more elongate rigid and/or resilient components (e.g. struts). It is not however essential that these are present.

In some embodiments the brace allows sufficient flexion and/or extension of the ankle for walking or for other actions where during training a user uses the footwear to traverse ground. In other embodiments the brace may serve to prevent or substantially restrict flexion and/or extension of the ankle. In any event it is desired that the brace substantially restricts lateral movement of the foot relative to the platform.

"Shoe"

The term "shoe" as used herein includes sports shoes, work shoes, leisure shoes, slippers, sandals, boots or any other supporting footwear used for walking on or carrying out an activity. The brace may be used to brace a user's foot when the user is barefoot or, in certain embodiments when the user is wearing a shoe.

"Training"

This means practising a skill or activity. In the context of the present invention it will generally involve repeating a balancing procedure to try to obtain an improvement. It does not require success/immediate success. One or more failures in balancing/practising balancing will be entirely usual.

It is envisaged that most users will be able to improve their balancing skills by correct use of trainers of the present invention. They may for example be balance for a longer period and/or focus balancing over a smaller area and/or improve balancing posture and/or improve weight distribution, etc.

The invention claimed is:

1. A kit comprising a pair of items of footwear, wherein each item of footwear comprises:

a) a brace that is configured to be releasably secured to at least part of a leg-of a wearer;

b) a platform that is operably connected to the brace, said brace comprising rigid struts configured to restrict lateral movement of a foot of the wearer relative to the platform; and c) the platform having an underside comprising a plurality of locations for releasably securing a balancing member, each location of the plurality of locations being spaced a discrete distance apart from one another and comprising a projection depending from the underside of the platform, wherein each location of the plurality of locations is configured to be received in the balancing member to releasably connect the balancing member to the platform, a first location of the plurality of locations and a second location of the plurality of locations being longitudinally aligned with each other relative to a longitudinal dimension of the platform; and wherein the balancing member is one of a plurality of balancing members, and the kit includes the plurality of balancing members for each item of footwear so that one balancing member of the plurality of balancing members can be replaced with another balancing member of the plurality of balancing members that has a smaller ground-contacting area, or so that each item of footwear can have said another balancing member with the smaller ground-contacting area stacked underneath the platform;

and wherein the brace is configured to secure the at least part of the wearer's leg during balancing training so as to help train the wearer in adopting or trying to adopt a desired position for balancing and the balancing member secured underneath the platform at one of the plurality of locations for the balancing training.

2. The kit according to claim 1 wherein the plurality of balancing members comprises at least three balancing members for each item of footwear, each of the at least three balancing members having a different sized ground-contacting area than the others so as to provide at least three different degrees of difficulty in balancing.

3. The kit according to claim 1 wherein an angle adjustment mechanism is provided for each item of footwear, so that an angle at which the brace is set can be adjusted.

4. The kit according to claim 3 wherein the angle can be adjusted by up to at least five degrees from a vertical.

5. The kit according to claim 3 wherein a releasable locking mechanism is provided so that the brace can be locked at a given angle relative to the platform until the releasable locking mechanism is released.

6. The kit according to claim 3 wherein each item of footwear is provided with an angle indicator that indicates the angle at which the brace is set.

7. The kit according to claim 1 wherein the plurality of balancing members provided for each item of footwear, or at least ground-contacting surfaces thereof, are all of substantially a same length, but all differ in width.

8. The kit according to claim 7 wherein, when in use, a longitudinal axis of each balancing member is configured to be generally aligned with a central longitudinal axis running from a back to a front of the foot of the wearer and/or running along the longitudinal dimension of the platform from a front to a back of the platform.

9. The kit according to claim 1 wherein the brace is configured to keep a shin of the wearer at a substantially fixed angle relative to the platform when the wearer is balancing or attempting to balance using each item of footwear.

10. A method of training a user to improve weight distribution or balance in respect of a sport, activity, exercise or posture, the method comprising the user wearing a pair of items of footwear of the kit according to claim 1 and then the user balancing or attempting to balance upon the balancing member under each item of footwear; wherein the method is repeated:

a) with the balancing member under each item of footwear having been replaced with said another balancing member that has the smaller ground-contacting area, or b) with said another balancing member having the smaller ground-contacting area being stacked underneath the balancing member.

11. The kit of claim 1 wherein the balancing member comprises a first balancing member of a stack of the plurality of balancing members.

12. The kit according to claim 11 further comprising the stack to be formed of the plurality of balancing members and for the plurality of balancing members to be releasably secured underneath the platform at the one of the plurality of locations for the balancing training, with the balancing member having a smallest ground-contacting area of the plurality of balancing members in the stack being located at a bottom of the stack.

13. The kit according to claim 11 wherein the plurality of balancing members provided for each item of footwear, or at least ground-contacting surfaces thereof, are all at least 10% longer, when measured along a central longitudinal axis running from a front to a back of the underside of the platform, relative to a respective width of the plurality of balancing members.

14. The kit of claim 1 wherein a bottom end of each strut of the rigid struts comprises a plurality of engaging teeth for engaging with a plurality of platform engaging teeth to releasably lock an angular position of a longitudinal dimension of each rigid strut relative to the longitudinal dimension of the platform.

15. An item of footwear comprising: a) a brace that is configured to be releasably secured to at least part of a wearer's leg and/or foot;

b) a platform that is operably connected to the brace, said brace comprising rigid struts configured to restrict lateral movement of the wearer's foot relative to the platform; and c) the platform having an underside comprising a plurality of locations for releasably securing a balancing member, each location of the plurality of locations being spaced a discrete distance apart from one another and comprising a projection depending from the underside of the platform, wherein each location of the plurality of locations is configured to be received in the balancing member to releasably connect the balancing member to the platform, a first location of the plurality of locations and a second location of the plurality of locations being longitudinally aligned with each other relative to a longitudinal dimension of the platform.

16. The item of footwear according to claim 15 wherein the brace is movably and/or pivotally mounted relative to the platform, but can be releasably locked in position relative to the platform, when desired.

17. A balancing training system comprising a pair of items of items of footwear, wherein each item of footwear comprises:

a brace releasably securable to at least part of a leg of a wearer and configured to secure the leg during balancing training so as to help train the wearer in adopting or trying to adopt a desired position for balancing;

a platform that is operably connected to the brace, said brace comprising rigid struts configured to restrict lateral movement of a foot of the wearer relative to the platform; and the platform having an underside comprising a plurality of locations releasably connectable to a plurality of balancing members, each location of the plurality of locations being spaced a discrete distance apart from one another and comprising a projection depending from the underside of the platform; a first location of the plurality of locations and a second location of the plurality of locations being longitudinally aligned with each other relative to a longitudinal dimension of the platform, the first location releasably connected to a first balancing member of the plurality of balancing members and the second location releasably connected to a second balancing member of the plurality of balancing members; and wherein the first balancing member is releasably connectable to the second location and the second balancing member is releasably connectable to the first location, and the first balancing member and the second balancing member have different ground-contacting areas relative to each other.

18. The system of claim 17 wherein the first balancing member and the second balancing member are connectable to each other such that when the first balancing member is connected to the platform, the second balancing member is connectable to the first balancing member on an opposite side of the first balancing member relative to said platform and said second balancing member having a smaller ground-contacting area relative to the ground contacting area of the first balancing member.

* * * * *